US008893329B2

(12) United States Patent
Petrovski et al.

(10) Patent No.: US 8,893,329 B2
(45) Date of Patent: Nov. 25, 2014

(54) CONTROL SCHEMES AND FEATURES FOR CLIMATE-CONTROLLED BEDS

(75) Inventors: Dusko Petrovski, Washington, MI (US); Barry Steele, Commerce, MI (US); Michael Brykalski, Monrovia, CA (US); John Terech, Milan, MI (US); David Marquette, Farmington Hills, MI (US)

(73) Assignee: Gentherm Incorporated, Northville, MI (US)

( * ) Notice: Subject to any disclaimer, the term of this patent is extended or adjusted under 35 U.S.C. 154(b) by 503 days.

(21) Appl. No.: 12/775,347

(22) Filed: May 6, 2010

(65) Prior Publication Data

US 2011/0115635 A1 May 19, 2011

Related U.S. Application Data

(60) Provisional application No. 61/176,042, filed on May 6, 2009.

(51) Int. Cl.
*A47C 21/04* (2006.01)

(52) U.S. Cl.
CPC ..... *A47C 21/044* (2013.01); *A47C 21/048* (2013.01)
USPC ..... 5/423; 5/421; 5/724; 5/726; 5/652.1; 5/652.2

(58) Field of Classification Search
USPC ..... 5/421, 423, 694, 704, 724, 726, 652.1, 5/652.2
See application file for complete search history.

(56) References Cited

U.S. PATENT DOCUMENTS 96,989 A 11/1869 Somes
771,461 A 10/1904 Clifford (Continued)

FOREIGN PATENT DOCUMENTS

DE 10238552 8/2001
DE 10115242 10/2002

(Continued)

OTHER PUBLICATIONS

International Search Report and Written Opinion for Application No. PCT/US2010/033922 (the PCT counterpart of this application) dated Jul. 9, 2010.

(Continued)

*Primary Examiner* — William Kelleher
(74) *Attorney, Agent, or Firm* — Knobbe, Martens, Olson & Bear, LLP

(57) ABSTRACT

A climate-conditioned bed includes an upper portion having at least a first climate zone and at least one fluid module associated with such a first climate zone. The fluid module comprises a fluid transfer device for selectively moving a fluid and a thermoelectric device for selectively heating or cooling a fluid. The bed additionally includes one or more control modules configured to regulate the operation of the fluid module, at least one input device configured to allow an occupant to select a setting or mode associated with the first climate zone and at least a first temperature sensor configured to detect a temperature associated with the first climate zone of the thermally-conditioned bed. In some embodiments, the fluid module is operatively connected to the control module. The control module is configured to adjust at least one operational parameter of the fluid module based on, at least in part, the setting or mode selected by an occupant using the at least one input device, and the temperature detected by the first temperature sensor.

27 Claims, 44 Drawing Sheets

(56) References Cited

U.S. PATENT DOCUMENTS 1,777,982 A 6/1929 Popp
2,461,432 A 2/1949 Mitchell
2,462,984 A 3/1949 Maddison
2,493,067 A 1/1950 Goldsmith
2,512,559 A 6/1950 Williams
2,782,834 A 2/1957 Vigo
2,791,956 A 5/1957 Guest
2,931,286 A 4/1960 Fry, Sr. et al.
2,976,700 A 3/1961 Jackson
3,030,145 A 4/1962 Kottemann
3,039,817 A 6/1962 Taylor
3,136,577 A 6/1964 Richard
3,137,523 A 6/1964 Karner
3,209,380 A 10/1965 Watsky
3,266,064 A * 8/1966 Figman ..... 5/726
3,529,310 A 9/1970 Olmo
3,550,523 A 12/1970 Segal
3,653,083 A 4/1972 Lapidus
3,928,876 A 12/1975 Starr
4,413,857 A 11/1983 Hayashi
4,423,308 A 12/1983 Callaway et al.
4,563,387 A 1/1986 Takagi et al.
4,671,567 A 6/1987 Frobose
4,685,727 A 8/1987 Cremer et al.
4,712,832 A 12/1987 Antolini et al.
4,777,802 A 10/1988 Feher
4,793,651 A 12/1988 Inagaki et al.
4,825,488 A * 5/1989 Bedford ..... 5/726
4,853,992 A 8/1989 Yu
4,905,475 A 3/1990 Tuomi
4,923,248 A 5/1990 Feher
4,981,324 A 1/1991 Law
4,997,230 A 3/1991 Spitalnick
5,002,336 A 3/1991 Feher
5,016,304 A 5/1991 Ryhiner
5,077,709 A 12/1991 Feher
5,102,189 A 4/1992 Saito et al.
5,106,161 A 4/1992 Meiller
5,117,638 A 6/1992 Feher
5,125,238 A 6/1992 Ragan et al.
5,265,599 A 11/1993 Stephenson et al.
5,335,381 A 8/1994 Chang
5,367,728 A 11/1994 Chang
5,372,402 A 12/1994 Kuo
5,382,075 A 1/1995 Shih
5,385,382 A 1/1995 Single, II et al.
5,416,935 A 5/1995 Nieh
5,419,489 A 5/1995 Burd
5,433,741 A 7/1995 Truglio
5,448,788 A 9/1995 Wu
5,473,783 A 12/1995 Allen
5,493,742 A 2/1996 Klearman
5,584,084 A 12/1996 Klearman et al.
5,597,200 A 1/1997 Gregory et al.
5,613,729 A 3/1997 Summer, Jr.
5,613,730 A 3/1997 Buie et al.
5,626,021 A 5/1997 Karunasiri et al.
5,626,386 A 5/1997 Lush
5,640,728 A 6/1997 Graebe
5,642,539 A 7/1997 Kuo
5,645,314 A 7/1997 Liou
5,675,852 A 10/1997 Watkins
5,692,952 A 12/1997 Chih-Hung
5,715,695 A 2/1998 Lord
5,850,741 A 12/1998 Feher
5,871,151 A 2/1999 Fiedrich
5,887,304 A 3/1999 von der Heyde
5,902,014 A 5/1999 Dinkel et al.
5,921,314 A 7/1999 Schuller et al.
5,921,858 A 7/1999 Kawai et al.
5,924,766 A 7/1999 Esaki et al.
5,924,767 A 7/1999 Pietryga
5,927,817 A 7/1999 Ekman et al.
5,934,748 A 8/1999 Faust et al.
5,948,303 A * 9/1999 Larson ..... 219/486
5,963,997 A 10/1999 Hagopian
6,003,950 A 12/1999 Larsson
6,006,524 A 12/1999 Park
6,019,420 A 2/2000 Faust et al.
6,048,024 A 4/2000 Wallman
6,052,853 A 4/2000 Schmid
6,059,018 A 5/2000 Yoshinori et al.
6,062,641 A 5/2000 Suzuki et al.
6,073,998 A 6/2000 Siarkowski et al.
6,079,485 A 6/2000 Esaki et al.
6,085,369 A 7/2000 Feher
6,109,688 A 8/2000 Wurz et al.
6,119,463 A 9/2000 Bell
6,145,925 A 11/2000 Eksin et al.
6,148,457 A 11/2000 Sul
6,161,241 A 12/2000 Zysman
6,171,333 B1 * 1/2001 Nelson et al. ..... 607/104
6,186,592 B1 2/2001 Orizaris et al.
6,189,966 B1 2/2001 Faust et al.
6,189,967 B1 2/2001 Short
6,196,627 B1 3/2001 Faust et al.
6,206,465 B1 3/2001 Faust et al.
6,223,539 B1 5/2001 Bell
6,263,530 B1 7/2001 Feher
6,291,803 B1 9/2001 Fourrey
6,336,237 B1 1/2002 Schmid
6,341,395 B1 1/2002 Chao
6,425,527 B1 7/2002 Smole
6,487,739 B1 12/2002 Harker
6,493,888 B1 12/2002 Salvatini et al.
6,493,889 B2 12/2002 Kocurek
6,497,720 B1 12/2002 Augustine et al.
6,509,704 B1 1/2003 Brown
6,511,125 B1 1/2003 Gendron
6,541,737 B1 4/2003 Eksin et al.
6,546,576 B1 4/2003 Lin
RE38,128 E 6/2003 Gallup et al.
6,581,224 B2 6/2003 Yoon
6,581,225 B1 6/2003 Imai
6,596,018 B2 7/2003 Endo et al.
6,598,251 B2 7/2003 Habboub et al.
6,604,785 B2 8/2003 Bargheer et al.
6,606,754 B1 8/2003 Flick
6,606,866 B2 8/2003 Bell
6,619,736 B2 9/2003 Stowe et al.
6,626,488 B2 9/2003 Pfahler
6,629,724 B2 10/2003 Ekern et al.
6,644,735 B2 11/2003 Bargheer et al.
6,676,207 B2 1/2004 Rauh et al.
6,684,437 B2 2/2004 Koenig
6,687,937 B2 2/2004 Harker
6,700,052 B2 3/2004 Bell
6,708,352 B2 3/2004 Salvatini et al.
6,711,767 B2 3/2004 Klamm
6,730,115 B1 5/2004 Heaton
6,761,399 B2 7/2004 Bargheer et al.
6,764,502 B2 7/2004 Bieberich
6,772,825 B2 8/2004 Lachenbruch et al.
6,782,574 B2 8/2004 Totton et al.
6,786,541 B2 9/2004 Haupt et al.
6,786,545 B2 9/2004 Bargheer et al.
6,808,230 B2 10/2004 Buss et al.
6,828,528 B2 12/2004 Stowe et al.
6,840,576 B2 1/2005 Ekern et al.
6,841,957 B2 1/2005 Brown
6,855,158 B2 2/2005 Stolpmann
6,855,880 B2 2/2005 Feher
6,857,697 B2 2/2005 Brennan et al.
6,857,954 B2 2/2005 Luedtke
6,871,365 B2 3/2005 Flick et al.
6,893,086 B2 5/2005 Bajic et al.
6,904,629 B2 6/2005 Wu
6,907,739 B2 6/2005 Bell
6,954,944 B2 10/2005 Feher
6,967,309 B2 11/2005 Wyatt et al.
6,976,734 B2 12/2005 Stoewe
6,977,360 B2 12/2005 Weiss
6,990,701 B1 1/2006 Litvak
7,036,163 B2 5/2006 Schmid

(56) References Cited

U.S. PATENT DOCUMENTS 7,036,575 B1 5/2006 Rodney et al.
7,040,710 B2 5/2006 White et al.
7,052,091 B2 5/2006 Bajic et al.
7,063,163 B2 6/2006 Steele et al.
7,070,231 B1 7/2006 Wong
7,070,232 B2 7/2006 Minegishi et al.
7,100,978 B2 9/2006 Ekern et al.
7,108,319 B2 9/2006 Hartwich et al.
7,114,771 B2 10/2006 Lofy et al.
7,124,593 B2 10/2006 Feher
7,131,689 B2 11/2006 Brennan et al.
7,134,715 B1 11/2006 Fristedt et al.
7,147,279 B2 12/2006 Bevan et al.
7,168,758 B2 1/2007 Bevan et al.
7,178,344 B2 2/2007 Bell
7,181,786 B2 2/2007 Schoettle
7,201,441 B2 4/2007 Stoewe et al.
7,272,936 B2 9/2007 Feher
7,296,315 B2 11/2007 Totton et al.
7,338,117 B2 3/2008 Iqbal et al.
7,356,912 B2 4/2008 Iqbal et al.
7,370,911 B2 5/2008 Bajic et al.
7,425,034 B2 9/2008 Bajic et al.
7,462,028 B2 12/2008 Cherala et al.
7,469,432 B2 12/2008 Chambers
7,475,464 B2 1/2009 Lofy et al.
7,478,869 B2 1/2009 Lazanja et al.
7,480,950 B2 1/2009 Feher
7,506,938 B2 3/2009 Brennan et al.
7,555,792 B2 7/2009 Heaton
7,587,901 B2 9/2009 Petrovski
7,591,507 B2 9/2009 Giffin et al.
7,640,754 B2 1/2010 Wolas
7,665,803 B2 2/2010 Wolas
7,708,338 B2 5/2010 Wolas
RE41,765 E 9/2010 Gregory et al.
7,827,620 B2 11/2010 Feher
7,827,805 B2 11/2010 Comiskey et al.
7,862,113 B2 1/2011 Knoll
7,866,017 B2 1/2011 Knoll
7,877,827 B2 2/2011 Marquette et al.
7,892,271 B2 2/2011 Schock et al.
7,908,687 B2 3/2011 Ward et al.
7,914,611 B2 3/2011 Vrzalik et al.
7,937,789 B2 5/2011 Feher
7,963,594 B2 6/2011 Wolas
7,966,835 B2 6/2011 Petrovski
7,996,936 B2 8/2011 Marquette et al.
8,065,763 B2 11/2011 Brykalski et al.
8,104,295 B2 1/2012 Lofy
8,143,554 B2 3/2012 Lofy
8,181,290 B2 5/2012 Brykalski et al.
8,191,187 B2 6/2012 Brykalski et al.
8,222,511 B2 7/2012 Lofy
8,256,236 B2 9/2012 Lofy
8,332,975 B2 12/2012 Brykalski et al.
8,359,871 B2 1/2013 Woods et al.
8,418,286 B2 4/2013 Brykalski et al.
8,434,314 B2 5/2013 Comiskey et al.
8,438,863 B2 5/2013 Lofy
RE44,272 E 6/2013 Bell
8,505,320 B2 8/2013 Lofy
8,516,842 B2 8/2013 Petrovski
8,539,624 B2 9/2013 Terech et al.
8,575,518 B2 11/2013 Walsh
8,621,687 B2 1/2014 Brykalski et al.
2002/0100121 A1 8/2002 Kocurek
2002/0129449 A1* 9/2002 Harker ..... 5/726
2003/0019044 A1 1/2003 Larsson et al.
2003/0046762 A1* 3/2003 Stolpmann ..... 5/421
2003/0070235 A1 4/2003 Suzuki et al.
2003/0084510 A1* 5/2003 Lin ..... 5/423
2003/0084511 A1 5/2003 Salvatini et al.
2003/0145380 A1 8/2003 Schmid
2003/0150060 A1 8/2003 Huang
2003/0160479 A1 8/2003 Minuth et al.
2003/0188382 A1 10/2003 Klamm et al.
2003/0234247 A1* 12/2003 Stern ..... 219/491
2004/0090093 A1 5/2004 Kamiya et al.
2004/0177622 A1 9/2004 Harvie
2004/0255364 A1 12/2004 Feher
2005/0011009 A1 1/2005 Wu
2005/0086739 A1 4/2005 Wu
2005/0173950 A1 8/2005 Bajic et al.
2005/0278863 A1 12/2005 Bahash et al.
2005/0285438 A1 12/2005 Ishima et al.
2005/0288749 A1 12/2005 Lachenbruch
2006/0053529 A1 3/2006 Feher
2006/0053558 A1 3/2006 Ye
2006/0087160 A1 4/2006 Dong et al.
2006/0130490 A1 6/2006 Petrovski
2006/0137099 A1 6/2006 Feher
2006/0137358 A1 6/2006 Feher
2006/0158011 A1 7/2006 Marlovits et al.
2006/0162074 A1 7/2006 Bader
2006/0197363 A1 9/2006 Lofy et al.
2006/0214480 A1 9/2006 Terech
2006/0273646 A1* 12/2006 Comiskey et al. ..... 297/408
2007/0035162 A1 2/2007 Bier et al.
2007/0040421 A1 2/2007 Zuzga et al.
2007/0069554 A1 3/2007 Comiskey et al.
2007/0086757 A1 4/2007 Feher
2007/0138844 A1 6/2007 Kim
2007/0158981 A1 7/2007 Almasi et al.
2007/0200398 A1 8/2007 Wolas et al.
2007/0204629 A1 9/2007 Lofy
2007/0251016 A1 11/2007 Feher
2007/0262621 A1 11/2007 Dong et al.
2007/0277313 A1 12/2007 Terech
2007/0296251 A1 12/2007 Krobok et al.
2008/0000025 A1 1/2008 Feher
2008/0028536 A1 2/2008 Hadden-Cook
2008/0047598 A1 2/2008 Lofy
2008/0087316 A1 4/2008 Inaba et al.
2008/0100101 A1 5/2008 Wolas
2008/0143152 A1 6/2008 Wolas
2008/0148481 A1 6/2008 Brykalski et al.
2008/0164733 A1 7/2008 Giffin et al.
2008/0166224 A1 7/2008 Giffin et al.
2008/0173022 A1 7/2008 Petrovski
2008/0223841 A1 9/2008 Lofy
2008/0263776 A1* 10/2008 O'Reagan et al. ..... 5/714
2009/0000031 A1 1/2009 Feher
2009/0025770 A1 1/2009 Lofy
2009/0026813 A1 1/2009 Lofy
2009/0033130 A1 2/2009 Marquette et al.
2009/0064411 A1* 3/2009 Marquette et al. ..... 5/423
2009/0106907 A1 4/2009 Chambers
2009/0126109 A1 5/2009 Lee
2009/0126110 A1 5/2009 Feher
2009/0193814 A1 8/2009 Lofy
2009/0211619 A1 8/2009 Sharp et al.
2009/0218855 A1* 9/2009 Wolas ..... 297/180.14
2010/0001558 A1 1/2010 Petrovski
2010/0011502 A1 1/2010 Brykalski et al.
2010/0146700 A1 6/2010 Wolas
2010/0193498 A1 8/2010 Walsh
2010/0235991 A1 9/2010 Ward et al.
2010/0325796 A1 12/2010 Lachenbruch et al.
2011/0041246 A1 2/2011 Li et al.
2011/0048033 A1 3/2011 Comiskey et al.
2011/0107514 A1 5/2011 Brykalski et al.
2011/0115635 A1 5/2011 Petrovski et al.
2011/0253340 A1 10/2011 Petrovski
2011/0258778 A1 10/2011 Brykalski et al.
2011/0271994 A1 11/2011 Gilley
2011/0289684 A1 12/2011 Parish et al.
2011/0296611 A1 12/2011 Marquette et al.
2011/0314837 A1 12/2011 Parish et al.
2012/0017371 A1* 1/2012 Pollard ..... 5/423
2012/0080911 A1 4/2012 Brykalski et al.
2012/0104000 A1 5/2012 Lofy
2012/0114512 A1 5/2012 Lofy et al.
2012/0131748 A1 5/2012 Brykalski et al.

(56) References Cited

U.S. PATENT DOCUMENTS

| | | | |
|---|---|---|---|
| 2012/0227182 | A1 | 9/2012 | Brykalski et al. |
| 2012/0261399 | A1 | 10/2012 | Lofy |
| 2012/0319439 | A1 | 12/2012 | Lofy |
| 2013/0086923 | A1 | 4/2013 | Petrovski et al. |
| 2013/0097776 | A1 | 4/2013 | Brykalski et al. |
| 2013/0097777 | A1 | 4/2013 | Marquette et al. |
| 2013/0206852 | A1 | 8/2013 | Brykalski et al. |
| 2013/0227783 | A1 | 9/2013 | Brykalski et al. |
| 2013/0239592 | A1 | 9/2013 | Lofy |
| 2013/0269106 | A1 | 10/2013 | Brykalski et al. |
| 2014/0007594 | A1 | 1/2014 | Lofy |
| 2014/0026320 | A1 | 1/2014 | Marquette et al. |
| 2014/0062392 | A1 | 3/2014 | Lofy et al. |
| 2014/0130516 | A1 | 5/2014 | Lofy |
| 2014/0131343 | A1 | 5/2014 | Walsh |

FOREIGN PATENT DOCUMENTS

| | | | |
|---|---|---|---|
| EP | 0 617 946 | | 3/1994 |
| EP | 0 621 026 | | 10/1994 |
| EP | 0 862 901 | | 9/1998 |
| EP | 0878 150 | | 11/1998 |
| EP | 1 804 616 | | 2/2012 |
| FR | 1 327 862 | | 5/1963 |
| FR | 2 790 430 | | 9/2000 |
| FR | 2 893 826 | | 6/2007 |
| GB | 2 251 352 | | 12/2000 |
| JP | 56-97416 | | 8/1981 |
| JP | S62-193457 | U | 12/1987 |
| JP | H04-108411 | A | 4/1992 |
| JP | H06-343664 | A | 12/1994 |
| JP | H07-003403 | U | 1/1995 |
| JP | H09-140506 | A | 6/1997 |
| JP | H10-165259 | A | 6/1998 |
| JP | H11-266968 | A | 10/1999 |
| JP | 2004-174138 | | 6/2004 |
| RU | 2297207 | | 4/2007 |
| WO | WO 97/17930 | | 5/1997 |
| WO | WO 99/02074 | | 1/1999 |
| WO | WO 01/78643 | | 10/2001 |
| WO | WO 01/84982 | | 11/2001 |
| WO | WO 02/11968 | | 2/2002 |
| WO | WO 02/058165 | | 7/2002 |
| WO | WO 03/051666 | | 6/2003 |
| WO | WO 2005/120295 | | 12/2005 |
| WO | WO 2007/060371 | | 5/2007 |
| WO | WO 2011/150427 | | 12/2011 |

OTHER PUBLICATIONS

Feher, Steve, Thermoelectric Air Conditioned Variable Temperature Seat (VTS) & Effect Upon Vehicle Occupant Comfort, Vehicle Energy Efficiency, and Vehicle Environment Compatibility, SAE Technical Paper, Apr. 1993, pp. 341-349.

Feher, Steve, Stirling Air Conditioned Variable Temperature Seat (SVTS) and Comparison with Thermoelectric Air Conditioned Variable Temperature Seat (VTS), SAE Technical Paper Series, International Congress and Exposition, No. 980661, Feb. 23-26, 1998, pp. 1-9.

Lofy, J. et al., Thermoelectrics for Environmental Control in Automobiles, Proceeding of Twenty-First International Conference on Thermoelectrics (ICT 2002), published 2002, pp. 471-476.

Okamoto et. al., The Effects of a Newly Designed Air Mattress upon Sleep and Bed Climate, Applied Human Science, vol. 16 (1997), No. 4 pp. 161-166.

Winder et al., Heat-retaining Mattress for Temperature Control in Surgery, Br Med J, Jan. 17, 1970 1:168.

I-CAR Advantage Online: The Climate Control Seat System, online article dated Aug. 27, 2001.

Product information for a "*Thermo-Electric Cooling & Heating Seat Cushion*"; retrieved on May 12, 2008 from http://www.coolorheat.com/.

Product information retrieved on Jan. 30, 2007 from http://store.yahoo.co.jp/maruhachi/28tbe20567.html.(no English translation available).

Product information for "Kuchofuku's air conditioned bed, clothing line," retrieved on Oct. 11, 2007 from http://www.engadget.com/2007/06/29/kuchofukus-air-conditioned-bed-clothing-line/.

Product information for "SleepDeep™," retrieved on or about Jun. 2008 from http://www.sleepdeep.se.

* cited by examiner

CONTROL SCHEMES AND FEATURES FOR CLIMATE-CONTROLLED BEDS

CROSS REFERENCE TO RELATED APPLICATIONS

This application claims the priority benefit under 35 U.S.C. §119(e) of U.S. Provisional Patent Application No. 61/176,042, filed May 6, 2009, the entirety of which is hereby incorporated by reference herein.

BACKGROUND

1. Field of the Inventions

The present application relates generally to climate control systems, and more specifically, to control schemes for environmentally-controlled beds and other seating assemblies.

2. Description of the Related Art

Temperature-conditioned and/or ambient air for environmental control of living or working space is typically provided to relatively extensive areas, such as entire buildings, selected offices, suites of rooms within a building or the like. In the case of enclosed areas, such as homes, offices, libraries and the like, the interior space is typically cooled or heated as a unit. There are many situations, however, in which more selective or restrictive air temperature modification is desirable. For example, it is often desirable to provide an individualized climate control for a bed or other seating device so that desired heating or cooling can be achieved. For example, a bed situated within a hot, poorly-ventilated environment can be uncomfortable to the occupant. Furthermore, even with normal air-conditioning, on a hot day, the bed occupant's back and other pressure points may remain sweaty while lying down. In the winter time, it is highly desirable to have the ability to quickly warm the bed of the occupant to facilitate the occupant's comfort, especially where heating units are unlikely to warm the indoor space as quickly. Therefore, a need exists to provide a climate-controlled bed assembly with improved heating, cooling and/or ventilation and enhanced control thereof.

SUMMARY

According to some embodiments, a climate-conditioned bed includes an upper portion having a first climate zone and one or more fluid modules (e.g., blowers, fluid transfer devices, thermoelectric devices, convective heaters, other heating, cooling or ventilation devices, etc.) associated with the first climate zone. In some embodiments, least one fluid module comprises a fluid transfer device for selectively moving a fluid and a thermoelectric device configured to selectively heat or cool a fluid. The climate controlled bed further includes at least one internal passageway through an interior of the upper portion, such that the internal passageway helps place at least one fluid module in fluid communication with at least one fluid distribution member located on or near a top of the upper portion. In some embodiments, at least one fluid distribution member is configured to generally distribute fluid toward an occupant along an area defined by the first climate zone. The bed additionally comprises a control module configured to regulate the operation of one or more fluid modules and an input device configured to permit an occupant to select a desired climate controlled setting or mode associated with the first climate zone. In one embodiment, at least one fluid module is operatively connected to the control module. In other arrangements, at least one input device is in data communication with the control module, wherein the input device is configured to receive instructions from an occupant regarding the desired climate controlled setting or mode. In some embodiments, the bed further includes one or more first temperature sensors configured to detect a first temperature associated with the first climate zone of the bed. The bed can also include one or more other sensors (e.g., over-temperature or fire sensors, humidity sensors, condensation sensors, pressure or occupant-detection sensors, etc.). In some embodiments, the control module is configured to adjust at least one operational parameter of the at least one fluid module based, at least in part, on the setting or mode selected by an occupant using the at least one input device, and/or the first temperature detected by the first temperature sensor.

According to some embodiments, a climate controlled bed additionally includes at least a second climate zone and at least one second fluid module associated with the second climate zone. In some arrangements, the bed further comprises at least a second temperature sensor configured to detect a second temperature associated with the second climate zone. In one arrangement, the control module is configured to adjust at least one operational parameter of the second fluid module based, at least in part, on the climate controlled setting or mode selected by an occupant using the at least one input device, and/or the second temperature detected by the second temperature sensor. In some embodiments, the climate controlled bed comprises at one additional climate zone (e.g., third, fourth, etc.), as desired or required. In certain embodiments, the first climate zone is located along a left side of the bed, and the second climate zone is located along a right side of the bed. In one embodiment, the first climate zone comprises at least two climate subzones, wherein the climate subzones are configured to be operated differently from each other and wherein fluid is supplied to each climate subzone from separate fluid modules. In some arrangements, the internal passageway of the upper portion is in fluid communication with a duct of a climate control system of a building in which the bed is located (e.g., duct, pipe, hose and/or other connection to a home's building's or other structure's HVAC system, central air, window air conditioning (AC) unit, heater, etc.). According to some embodiments, the control module of the bed is operatively connected to a control system of a climate control system of a building in which the bed is located.

According to some embodiments, a climate-conditioned bed further comprises a separate fluid source in fluid communication with the at least one internal passageway, wherein fluids or other materials contained within said separate fluid source are configured to be selectively delivered to through the at least one internal passageway, toward a top surface of the upper portion. In some arrangements, the fluids or other materials contained within the separate fluid source comprise at least one of a medicament (e.g., asthma medication, antibacterial medication, anti-fungal medication, anesthetic, etc.), a therapeutic agent, an insect repellent, a fragrance, steam or other vapor and/or the like. In some embodiments, a climate conditioned bed additionally includes at least one humidity or moisture sensor and/or any other type of sensor.

According to some embodiments, the upper portion (e.g., mattress) of a bed comprises at least one viscoelastic layer. In some arrangements, the viscoelastic layer comprises a plurality of first openings and a plurality of second openings. In one embodiment, the first and second openings extend throughout an entire depth of said viscoelastic layer. In other embodiments, the viscoelastic layer includes fewer or more openings, which may be of the same or different sizes, as desired or required. In some embodiments, the second openings are larger than the first openings. In several arrangements, the second openings are configured to generally distribute fluid being delivered from the at least one fluid module to a top of the upper portion, while the first openings are configured to assist in the breathability of the viscoelastic layer.

According to some embodiments, the control module is configured to be operatively connected to at least one separate device or system. In some embodiments, such a separate device or system comprises a thermostat or other controller for a building's climate control system, a multimedia device (e.g., iPhone, Blackberry, other Smartphone, iPod, iPad, an audio and/or video player, television, radio, multimedia device, etc.), a control unit, a computer, an internet connection or another network connection.

In some arrangements, a fluid module, a first temperature sensor and a control module are included within a single housing. In one arrangement, a climate-conditioned bed further comprises a temperature alarm configured to be activated when the temperature associated with a climate zone exceeds a threshold temperature. In some embodiments, a control unit is configured to shut down the supply of air or other fluids upon the detection of a fire or other over-temperature condition. In one arrangement, the control module is configured to thermally pre-condition the bed by activating the at least one thermal module according to a setting selected by an occupant. For example, a bed can be pre-conditioned (e.g., heated, cooled, ventilated, etc.) for a period of time prior to the time that a user anticipates using it.

According to some embodiments, a climate-conditioned seating assembly includes at least a first climate zone and at least one fluid module associated with the first climate zone. In one embodiment, the fluid module is configured to selectively transfer and environmentally-condition a fluid. The seating assembly additionally comprises a control module configured to regulate the operation of one or more fluid modules. In one embodiment, at least one fluid module is operatively connected to the control module. Further, the bed includes at least one user input device configured to allow an occupant to select a desired environmental control setting or mode associated with the first climate zone. In some arrangements, at least one fluid module is configured to deliver fluids through at least one interior passageway of the seating assembly, toward a top surface of said seating assembly. In one embodiment, the control module is configured to adjust at least one operational parameter of at least one fluid module based, at least in part, on (i) the environmental control setting or mode selected by an occupant, and/or (ii) a temperature associated with the at least first climate zone or the at least one fluid module. In some arrangements, the seating assembly is incorporated into a larger zonal system, wherein such a larger zonal system includes a main climate control system of an area (e.g., a home or other building's HVAC or other climate control system) in which the seating assembly is located. In one embodiment, the seating assembly is operatively connected to a control unit of the main climate control system. In some arrangements, at least one operational parameter of the at least one fluid module is configured to be adjusted based, at least in part, on an operational algorithm for the larger zonal system and at least one operational parameter of the main climate control system. In some embodiments, the seating assembly comprises a consumer bed, a ventilation bed, a low air loss bed, a hospital or other medical bed, a wheelchair, a vehicle seat, an office chair and/or any other type of seating device.

According to some embodiments, a climate-conditioned bed assembly includes a first climate zone and at least a second climate zone, at least one first fluid module associated with the first climate zone and at least one second fluid module associated with the second climate zone. In some embodiments, each of the first and second fluid modules comprises a fluid transfer device and a thermoelectric device, wherein the fluid transfer device is configured to transfer fluids through the bed assembly, and wherein the thermoelectric device is configured to selectively thermally-condition such fluids. In one embodiment, at least one first fluid module is configured to deliver fluids to the first climate zone and at least one second fluid module is configured to deliver fluids to the second climate zone. The bed additionally includes one or more control modules configured to regulate the operation of one or more of the fluid modules and/or other components of the bed. In several arrangements, each of the fluid modules is operatively connected to the control module. The bed additionally comprises one or more occupant input devices (e.g., remote control devices) configured to allow an occupant to select a climate control setting or mode for the first climate zone and/or the second climate zone. Such input devices can be configured to communicate with a control unit and/or any other components of the bed using one or more wireless and/or hardwired connections. In some embodiments, at least one control module is configured to adjust one or more operational parameters of at least one of the fluid modules based, at least in part, on the climate control setting or mode selected by an occupant;

wherein the control module is configured to adjust at least one operational parameters (e.g., blower flowrate, amount of heating or cooling of the thermoelectric device, etc.) of one or more fluid modules in order to maintain the desired climate control setting or mode in the first climate zone and/or the second climate zone, along an upper portion of the bed assembly. In some embodiments, the first climate zone is configured to be controlled independently of the second climate zone.

According to some embodiments, the desired climate control setting or mode is configured to vary over time as determined by a control algorithm and/or a software/hardware combination. In some embodiments, the bed comprises a thermal alarm such that the control module is configured to regulate at least one of the fluid modules to adjust a temperature (e.g., heat or cool) or feel (e.g., ventilate ambient air) along the upper portion of the first climate zone and/or the second climate zone to help awaken an occupant positioned thereon. In some arrangements, a climate controlled bed additionally includes one or more timers operatively connected to the control module, such that the timers are configured to regulate at least one of the fluid modules.

A climate-conditioned bed includes an upper portion having at least a first climate zone and at least one fluid module associated with such a first climate zone. The fluid module comprises a fluid transfer device for selectively moving a fluid and a thermoelectric device for selectively heating or cooling a fluid. The bed additionally includes one or more control modules configured to regulate the operation of the fluid module, at least one input device configured to allow an occupant to select a setting or mode associated with the first climate zone and at least a first temperature sensor configured to detect a temperature associated with the first climate zone of the thermally-conditioned bed. In some embodiments, the fluid module is operatively connected to the control module. The control module is configured to adjust at least one operational parameter of the fluid module based on, at least in part, the setting or mode selected by an occupant using the at least one input device, and the temperature detected by the first temperature sensor.

According to certain arrangements, a climate-conditioned bed additionally includes at least a second climate zone and at least a second fluid module associated with the second climate zone. The thermally-conditioned bed further comprises at least a second temperature sensor configured to detect a temperature associated with the at least a second climate zone. In some embodiments, the control module is configured to adjust at least one operational parameter of the second fluid module based on, at least in part, the temperature detected by the second temperature sensor.

In other embodiments, the first climate zone is located along a left side of the bed, and the second climate zone is located along a right side of the bed. In one configuration, the first climate zone comprises at least two climate subzones, wherein the climate subzones are adapted to be operated differently from each other. In other embodiments, the bed is in fluid communication with a building's HVAC system (e.g., central air, furnace, window air conditioner, etc.). In certain arrangements, the control module of the bed is operatively connected with a with a control system of a building's HVAC system.

According to other embodiments, the climate-conditioned bed further comprises a separate fluid source in fluid communication with a passageway of the bed's fluid distribution system, such that fluids or other materials contained within the separate fluid source are configured to be selectively delivered to the bed, toward an occupant. In one embodiment, the fluids or other materials contained within the separate fluid source comprise a medication (e.g., asthma medication, anti-bacterial or anti-fungal medication, anesthetic, etc.), a therapeutic agent, an insect repellent, a fragrance or any other substance.

In other arrangements, the climate-controlled bed includes at least one temperature sensor, humidity sensor, moisture sensor configured to detect the presence of water, sweat, urine or any other liquid, occupant detection sensor, timer and/or any other sensor or device. In one embodiment, the control module is configured to be operatively connected to at least one separate device or system, such as, for example, a multimedia device (e.g., mp3 player, iPod, iPad, other audio, video and/or other media player, etc.), a HVAC thermostat or other controller or control unit for a building (e.g., home, office or other commercial building, etc.) climate control system, a computer, a PDA, an internet connection or other network, etc. In certain embodiments, the climate-conditioned bed comprises a bed for home use, a medical bed, a wheelchair, vehicle seat, a stadium seat or any other type of seating assembly. In one embodiment, the climate controlled bed further includes a temperature alarm configured to be activated when the temperature associated with the at least a second climate zone exceeds a threshold temperature.

According to certain embodiments, a climate-conditioned seating assembly includes at least a first climate zone and at least one fluid module associated with the first climate zone. The fluid module is configured to selectively transfer and environmentally-condition (e.g., heat, cool, dehumidify, humidify, ventilate, filter or otherwise clean, etc.) a fluid. The seating assembly further comprises at least one control module configured to regulate the operation of the fluid module. In some arrangements, the fluid module is operatively connected to the control module. The seating assembly further includes at least one input device configured to allow an occupant to select a setting or mode associated with the first climate zone, wherein the control module is configured to adjust at least one operational parameter of the fluid module based on, at least in part, the setting or mode selected by an occupant and a temperature associated with the first climate zone.

In one embodiment, the climate-conditioned seating assembly is incorporated into a larger zonal system (e.g., a main HVAC system, other climate control device or system, etc.). In certain arrangements, the climate-conditioned seating assembly is operatively connected to a control system of a main HVAC system or other climate control device or system. In other embodiments, at least one operational parameter of the fluid module is configured to be adjusted based on, at least in part, a general operational algorithm for the larger zonal system and at least one operational parameter of a main HVAC system.

In certain arrangements, the climate-controlled assembly comprises a bed, medical bed, wheelchair, chair, vehicle seat, office chair, stadium seat or any other type of seating assembly. In one embodiment, the assembly is configured to collect and remove condensation formed within a portion of said assembly.

According to other embodiments, a climate-conditioned bed assembly includes at least one fluid module, wherein the fluid module is configured to selectively transfer and thermally-condition a fluid. The bed additionally includes at least one control module configured to regulate the operation of the fluid module. In one embodiment, the fluid module is operatively connected to the control module. The climate-controlled bed assembly further includes at least one input device configured to allow an occupant to select a setting or mode, wherein the control module is configured to adjust at least one operational parameter of the fluid module based on, at least in part, the setting or mode selected by an occupant and a temperature associated with the fluid being environmentally-conditioned. In certain embodiments, the control module is configured to adjust at least one operational parameter of the fluid module in order to maintain a desired temperature or a desired temperature range along an upper portion of the bed assembly.

In certain embodiments, the operational parameter of the fluid module being adjusted comprises a level of heating or cooling of a thermoelectric module, a flowrate of a fluid transfer device, a level of dehumidification or humidification and/or the like. In other arrangements, the desired temperature or the desired temperature range varies with time or as otherwise determined by an algorithm. In some configurations, the desired temperature or the desired temperature range increases or decreases within a predetermined time period so as to help awaken an occupant positioned thereon.

According to certain embodiments of the present application, a climate-conditioned bed includes an upper portion having a first climate zone and at least a second climate zone. At least one fluid module is associated with each of the first and second climate zones. The fluid module comprises a fluid transfer device for selectively moving a fluid and a thermoelectric device for selectively heating or cooling a fluid. The bed additionally includes at least one control module configured to regulate the operation of the fluid modules associated with the first and second climate zones. The fluid module is operatively connected to the at least one control module. The bed additionally includes at least one input device configured to allow an occupant to selectively alter the operation of the fluid module associated with the first climate zone and the second climate zone. Further, the bed comprises at least a first temperature sensor configured to detect a temperature associated with the first climate zone of the thermally-conditioned bed, and at least a second temperature sensor configured to detect a temperature associated with the second climate zone of the thermally-conditioned bed. In some arrangements, the first climate zone is configured to be selectively operatively differently than the first climate zone.

In other embodiments, the first climate zone is located along a left side of the bed, and wherein the second climate zone is located along a right side of the bed. In one arrangement, the first climate zone comprises at least two climate subzones, which are configured to be operated differently from each other. In other arrangements, the bed is in fluid communication with a home's HVAC system. In certain embodiments, the thermally-conditioned bed further comprises at least one humidity sensor. In one embodiment, the control module is configured to be operatively connected to at least one separate device or system (e.g., a media player, home HVAC thermostat, etc.).

According to other embodiments, an environmentally-conditioned bed or other seating assembly is configured to collect and remove condensation that is formed therein. For example, such condensation can be evaporated or other channeled away from the bed or other seating assembly, as desired or required.

BRIEF DESCRIPTION OF THE DRAWINGS

These and other features, aspects and advantages of the present inventions are described herein in connection with certain preferred embodiments, in reference to the accompanying drawings. The illustrated embodiments, however, are merely examples and are not intended to limit the inventions presented herein. The drawings include the following figures.

DETAILED DESCRIPTION OF THE PREFERRED EMBODIMENTS

The climate control devices disclosed herein, as well as the various systems and features associated with them, are described in the context of an environmentally (e.g., thermally) conditioned bed or other seating assembly (e.g., seat assemblies for automobiles, trains, planes, motorcycles, buses, other types of vehicles, wheelchairs, sofas, task chairs, office chairs, other types of chairs and/or the like) because they have particular utility in this context. However, the climate control devices, systems and methods described herein, or equivalents thereof, can be used in other contexts as well, such as, for example, but without limitation, other devices or systems where thermally-conditioned fluids are desired or required, electronic or other components where thermal or other environmental conditioning is desired or required and/or the like. As used herein with reference to air (or other fluids), beds (or other seating assemblies) and/or the like, the term "environmentally conditioned" is a broad term used in its ordinary sense and generally refers, without limitation, to temperature conditioning (e.g., cooling, heating, etc.), humidity conditioning (e.g., dehumidification, humidification, etc.), ventilation and/or the like.

To assist in the description of the disclosed embodiments, words such as up, upward, upper, top, down, downward, lower, bottom, vertical, horizontal, upstream, downstream and the other directional, direction-indicating words and/or the like are used to describe the accompanying figures. However, the illustrated embodiments can be located, configured and/or oriented in a variety of desired positions and should not be limited in scope by the use of such descriptive words herein.

Figure 1:
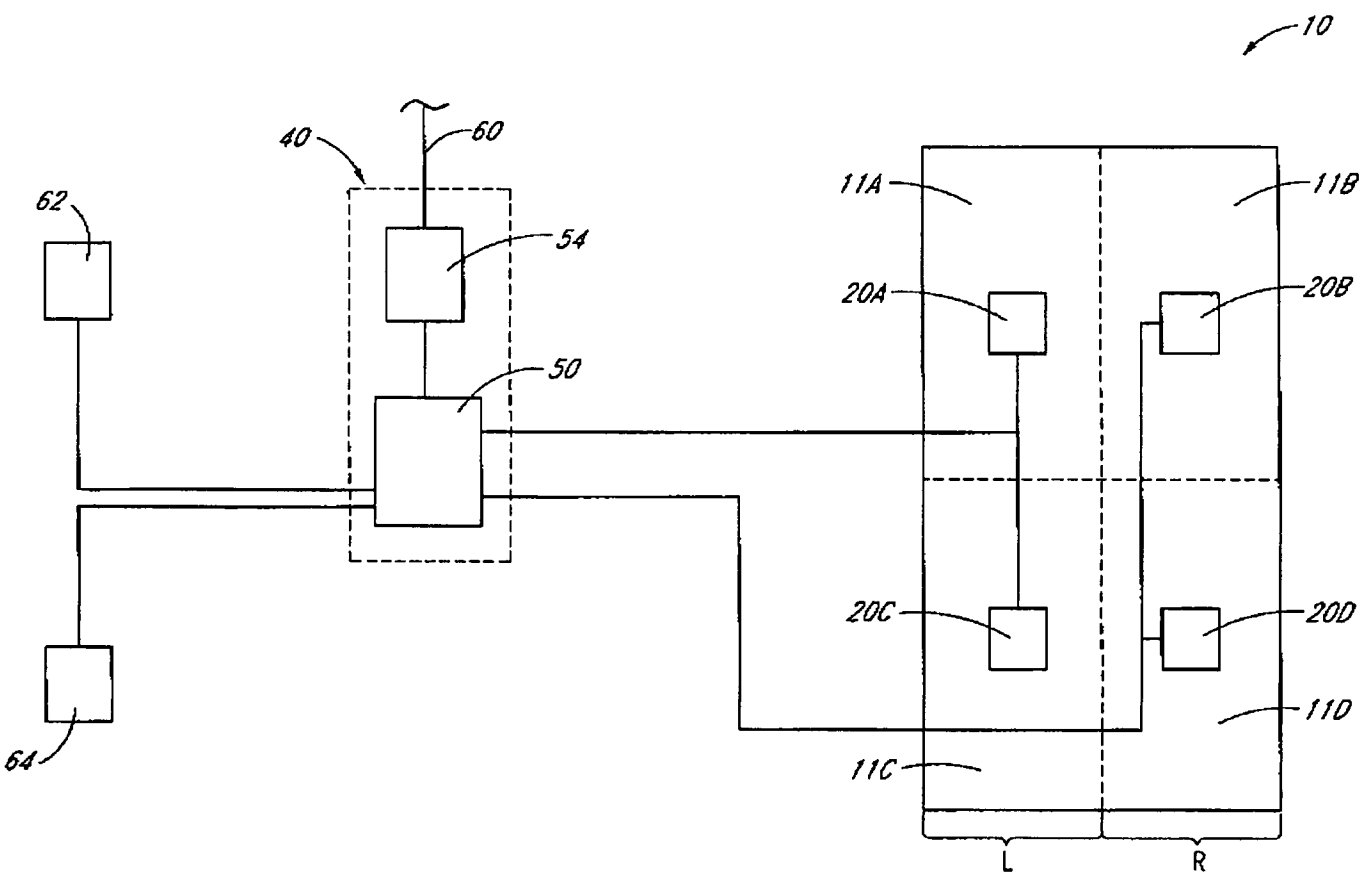
FIG. 1 illustrates a schematic of a climate-controlled bed and its various control components according to one embodiment.

FIG. 1 schematically illustrates one embodiment of a climate controlled bed assembly 10 and various components and systems that are operatively connected to it. As shown, the bed 10 can include two or more different zones, areas or portions that may be operated independently of one another. In the depicted arrangement, the bed 10 comprises a total of four climate zones 11A-11D. Alternatively, a bed 10 or other seating assembly can include more or fewer climate zones, as desired or required.

With continued reference to FIG. 1, two of the climate zones 11A, 11C are positioned along the left side L of the bed 10, whereas two of the climate zones 11B, 11D are situated along the right side R of the bed 10. In the depicted embodiment, each side of the bed (e.g., the left side L and the right side R) is further divided into two zones or areas. By way of example, the left side L includes a first climate zone 11A located along an upper portion of the bed 10 and a second climate zone 11C located along a lower portion of the bed 10. Such zones can permit an occupant to selectively adjust the climate control effect on his or her side of the bed, as desired or required. For instance, a bed occupant positioned along the left side L may choose to operate the first climate zone 11A at a warmer or cooler setting than the second climate zone 11B. Such configurations can advantageously allow a user to customize the heating, cooling, ventilation effect and/or other thermal or environmental effect on his or her side of the bed 10 without influencing the desired settings of a second user.

According to some embodiments, air or other fluid is supplied to each climate zone 11A-11D using one or more fluid modules 20A-20D. For example, in FIG. 1 each climate zone 11A-11D comprises one fluid module 20A-20D. Accordingly, each occupant can regulate the flow of thermally-conditioned and/or ambient air or other fluids that are delivered toward his or her side of the bed assembly 10. Further, as discussed, two or more climate zones can be provided along a portion of the bed intended to support a single occupant. Thus, an occupant can advantageously adjust the cooling, heating, ventilation and/or other thermal or environmental effect along various regions of his or her side of the bed 10 (e.g., head or neck area, leg area, main torso area, etc.), as desired.

According to some arrangements, each fluid module 20A-20D comprises a fluid transfer device (e.g., a blower, fan, etc.), a thermoelectric device (e.g., a Peltier circuit) or any other heating or cooling device capable of thermally conditioning a fluid (e.g., convective heater), one or more sensors (e.g., temperature, humidity, condensation, other types of sensors, etc.), other control features and/or any other component or feature, as desired or required. For convenience and ease of installation, for any of the embodiments disclosed herein, some or all of these components can be included within a single housing or other enclosure. For example, a bed assembly can include a fluid module (e.g., blower, thermoelectric device, etc.), one or more sensors (e.g., temperature, humidity, etc.), control unit or other controller and/or any other component or device within a single housing. Such an embodiments can help simplify the overall design of a climate controlled seating assembly, can help facilitate repairs, replacement, maintenance and other activities associated with upkeep of the seating assembly and/or provide one or more other benefits. Additional details regarding fluid modules that could be included in a climate-control bed or other seating assembly are provided in U.S. Pat. No. 7,587,901, filed as U.S. patent application Ser. No. 11/047,077 on Jan. 31, 2005 and issued on Sep. 15, 2009; U.S. patent application Ser. No. 11/546,928, filed on Oct. 12, 2006 and published as U.S. Publ. No. 2008/0087316 on Apr. 17, 2008; U.S. patent application Ser. No. 12/364,285, filed on Feb. 2, 2009 and published as U.S. Publ. No. 2009/0193814 on Aug. 6, 2009, the entireties of all of which are hereby incorporated by reference herein. As discussed in greater detail, each fluid module 20A-20D can be advantageously adapted to selectively provide thermally-conditioned (e.g., cooled, heated, etc.), thermally-unconditioned (e.g., ambient) and/or otherwise environmentally-modified (e.g., dehumidified) air or other fluids toward one or more bed occupants.

Figure 2A:
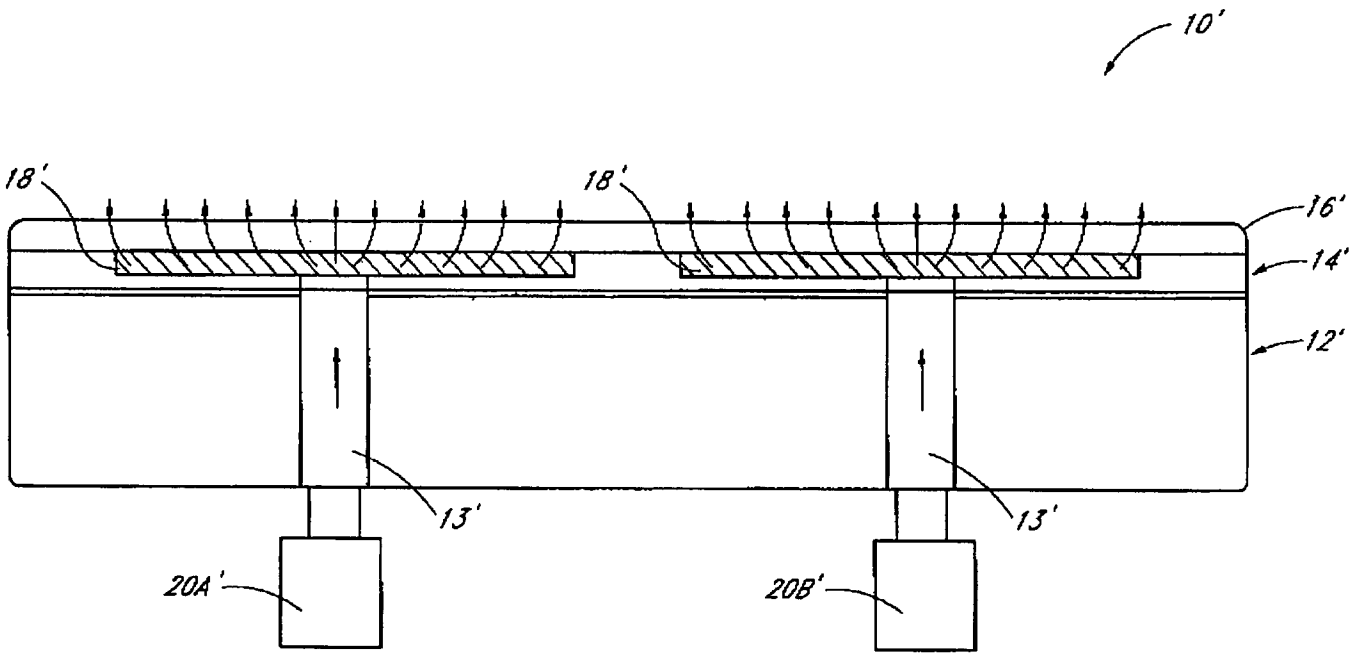
FIG. 2A schematically illustrates a cross-sectional view of one embodiment of a climate-conditioned bed having separate climate zones.

For example, with reference to the cross-sectional view of FIG. 2A, a mattress 12' or other upper support member of the bed assembly 10' can include one or more internal passages 13' or conduits through which fluids may be directed. In some embodiments, as shown in FIG. 2A, the fluid modules 20A', 20B' are positioned generally below the mattress 12' or other support member and are placed in fluid communication with one or more of the internal passages 13'. Accordingly, fluids can be selectively delivered from each fluid module 20A', 20B' to one or more fluid distribution members 18' located at or near an upper portion of the bed assembly 10' to create the desired heating, cooling and/or ventilation effect along that corresponding region or area of the bed. In any of the arrangements disclosed herein, adjacent climate zones 11A-11D of a bed assembly can be partially or completely isolated (e.g., thermally, hydraulically, etc.) from each other, as desired or required. Alternatively, adjacent climate zones can be configured to generally blend with one another, at least partially, without the use of specific thermal or hydraulic barriers separating them. In other embodiments, the manner in which environmentally (e.g., thermally) conditioned and/or unconditioned fluids are directed to an upper portion of a bed assembly can be different than illustrated in FIG. 2A. Additional embodiments of a climate controlled bed assembly are illustrated in FIGS. 22-28 herein.

Alternatively, as discussed herein with reference to FIGS. 16-19B, one or more of the passages or conduits of a bed assembly can be configured to receive air or other fluids from a home's main HVAC system (e.g., home air-conditioning and/or heating vent) and to selectively deliver such fluids toward one or more occupants of the bed. Additional disclosure and other details regarding different embodiments of climate controlled beds can be found in U.S. Publication No. 2008/0148481, titled AIR-CONDITIONED BED, and U.S. Patent Application No. 61/082,163, filed Jul. 18, 2008 and titled CLIMATE CONTROLLED BED ASSEMBLY, the entireties of both of which are hereby incorporated by reference herein.

Regardless of their exact design, layout and other features, climate-controlled bed assemblies can be configured to selectively provide air or other fluids (e.g., heated and/or cooled air, ambient air, etc.) to one or more occupants positioned thereon. Thus, the incorporation of separate and/or distinct climate zones 11A-11D in a bed 10 can generally enhance an occupant's ability to control the resulting heating, cooling, ventilation and/or other climate control effect. For example, such a bed can be adapted to create a different thermally-conditioned environment for each occupant. In addition, a particular occupant can vary the heating, cooling and/or ventilation scheme within his or her personal region or space (e.g., the head area of the bed can be operated differently than the midsection or lower portion of the bed).

With continued reference to the schematic of FIG. 1, the fluid modules 20A-20D of the bed assembly 10 can be operatively connected to a climate control module 50 or other electronic control unit (ECU). As shown, the control module 50 can be in a location remote to the bed 10. Alternatively, the control module 50, ECU and/or other control unit can be incorporated into one or more portions of the bed assembly (e.g., box spring, other support member, etc.). In turn, the control module 50 can be operatively connected to a power source 54 that is configured to supply the necessary electrical power to the various electronic components of the climate control system, such as, for example, the fluid transfer device, the thermoelectric device and/or other portion of the fluid modules 20A-20D, the control module 50 itself, the user input devices 62, 64 and/or any other item, device or system.

According to certain arrangements, the power source 54 comprises an AC adapter having a cable 60 that is configured to be plugged into a standard wall outlet, a DC adapter, a battery and/or the like. As illustrated schematically in FIG. 1, the control module 50 and the electrical power source 54 can be provided within a single housing or other enclosure 40. However, in alternative embodiments, the control module 50 and the power source 54 can be provided in separate enclosures, as desired or required.

As illustrated in FIG. 1, two or more fluid modules 20A-20D of a bed assembly 10 can be operatively connected to each other. Such cross-connections can facilitate the transmission of electrical current and/or data from the fluid modules 20A-20D to other portions of the climate control system, such as, for example, the control module 50 or other ECU, a power source 54, a user input device 62, 64 and/or the like. The connections between the different electrical devices, components and/or systems of a climate control bed assembly can be hardwired (e.g., using one or more cables, cords, wires, etc.) and/or wireless (e.g., using radio frequency, Bluetooth, other wireless technologies, etc.), as desired or required by a particular application or use. According to some embodiments, the fluid modules adapted to deliver fluids to a single side of the bed 10 (e.g., the left side L, the right side R, etc.) are connected to each using one or more hardwired and/or wireless connections. For instance, in FIG. 1, the two fluid modules 20A, 20C on the left side L of the bed 10 are operatively connected to each other. Likewise, the two fluid modules 20B, 20D on the right side R are also connected to one another. Thus, as depicted, a single connection can be used to transfer electrical power, other electrical signals or communications and/or the like to and/or from each paring or other grouping of fluid modules 20A-20D. In other embodiments, two or more fluid modules from different sides of the bed or different zones are electrically and/or otherwise coupled to each other. As discussed with reference to FIGS. 3-5, the manner in which the various fluid modules, control units and/or other components of the climate control system can vary.

With continued reference to FIG. 1, the bed's climate control system can additionally include one or more user input devices 62, 64. Such user input devices 62, 64, which in the depicted embodiment are operatively connected to the control module 50, are configured to permit a user to selectively regulate the manner in which the climate control system is operated. As with other electrical components of the climate control system, the user input devices 62, 64 can be connected to the control module 50 and/or any other component using a hardwired and/or wireless (e.g., radio frequency, Bluetooth, etc.) connection.

According to certain embodiments, a user input device 62, 64 comprises at least one controller that is configured to regulate one or more operational parameters of the climate controlled bed assembly 10. A user input device 62, 64 can include one or more buttons (e.g., push buttons), switches, dials, knobs, levers and/or the like. Such controllers can permit a user to select a desired mode of operation, a general heating, cooling and/or ventilation scheme, a temperature setting or range and/or any other operational parameter. For instance, in some arrangements, the input device 62, 64 allows users to select between "heating," "cooling" or "ventilation." In other embodiments, the controllers of the input device can be adjusted to select a particular level of heating, cooling or ventilation (e.g., low, medium, high, etc.) or a preferred temperature for the fluid being delivered toward an occupant positioned along an upper surface of the bed 10.

Alternatively, an input device 62, 64 can be configured to provide various data and other information to the user that may be relevant to the operation of the bed 10. For example, the input device can comprise a display (e.g., LCD screen) that is adapted to provide information to a user, such as, for example, the current mode of operation, a real-time temperature or humidity reading, the date and time and/or the like. In certain embodiments, the input device comprises a touch-screen display that is configured to both provide information to and receive instructions from (e.g., using softkeys) a user. As discussed in greater detail herein, a user input device 62, 64 can be configured to also control one or more other devices, components and/or systems that are generally unrelated or only tangentially or remotely-related to the operation of the climate control system, such as, for example, a digital music player, a television, an alarm, a lamp, other light fixture, lights and/or the like, as desired or required. In some arrangements, the user input devices 62, 64 of a bed assembly 10 can be operatively connected to such other devices, components or systems using one or more hardwired and/or wireless connections.

In some arrangements, a user input device is customized according to users' needs or desires. As discussed herein, for example, the user input device can be configured to allow an occupant to regulate one or more aspects of the bed's climate control system (e.g., setting a target thermal conditioning or temperature setting along a top surface of the bed). Further, a user input device 62, 64 can be adapted to regulate other devices or systems, even if such devices or systems are not directly related to the climate control features of the bed assembly 10. For instance, an input device can control one or more aspects of a digital medial player (e.g., iPod, mp3 player, etc.), a television, a radio, a lamp, a home's lighting system, an alarm clock, a phone, a home's main HVAC system (e.g., central air-conditioning and/or heating system) and/or the like. A user input device can include one or more hardwired and/or wireless connections in order to properly communicate with such other devices or systems. According to some embodiments, the input devices supplied to end users are preconfigured to be used with one or more other devices and/or systems. Alternatively, however, a user may need to at least partially program or otherwise set-up an input device to operatively connect it to one or more ancillary devices or systems (e.g., using specific manufacturers' codes of the devices or systems with which the input device will be operatively connected, using online technical support protocols, etc.).

Moreover, as discussed in greater detail herein, a user input device 62, 64 can include a touchscreen or other display that is configured to provide information about the climate control bed assembly and/or any other device or system that is controlled or otherwise operatively connected to the input device. For example, such a display can indicate the specific operational mode under which the climate control system is operating, a target temperature setpoint or range that the climate control system is programmed to achieve, the temperature, humidity and/or other measurements related to the ambient environment of the room in which the bed is located, the date and time, the status of an alarm or other feature with which the bed's control unit is operatively connected, information regarding a digital media player or television to which the input device is operatively connected (e.g., a song title, television program title and other information, etc.) and/or the like. In addition, a user input device can be further personalized using skins or other decorative features, as desired or required.

A climate control bed assembly can be controlled, at least in part, by one or more other devices or systems, either in lieu of or in addition to a user input device. For example, in certain embodiments, a user can regulate the operation of the bed assembly (e.g., select a mode of operation, select an operating temperature or range, initiate a specific operating scheme or protocol, etc.) and/or control any other devices or systems with which the bed assembly is operatively connected using a desktop device (e.g., a personal computer), a personal digital assistant (PDA), a multimedia device (e.g., iPod, iPad, another multimedia device, etc.), a Smartphone (e.g., iPhone, Blackberry, etc.) or other mobile device and/or the like. As used herein, the term multimedia device or media player is a broad term used in its ordinary sense and includes, without limitation, a mp3 or other music or audio player, an iPod, an iPad, any other audio, video and/or other media player, a Smartphone (e.g., iPhone, Blackberry, etc.), a television, a computer or other device having a processor and/or the like. In other arrangements, the climate control system of a bed assembly can be configured to be in data communication with a wall-mounted device, such as, for example, a thermostat or other controller for a home climate control system (e.g., central air, heater, other HVAC system, etc.). As used herein, the term building's climate control system is a broad term used in its ordinary sense and includes, without limitation, a thermostat or any other controller configured to regulate, at least in part, one or more components of a building's air conditioning, heating, ventilation and/or other climate control system. As such, the term can include, without limitation, any thermostat or other controller configured to regulate a central air conditioning unit, cooler, cooling system, heater and/or any other HVAC device or system of a home or other residential building (e.g., apartment building, condominium, assisted living building, etc.), office or other commercial building, hospital, school or any other structure. Thus, a single controller can selectively modify the operation of a home's or other building's climate control system (e.g., central air-conditioning and heating system, furnace, etc.) and one or more climate controlled bed assemblies. Moreover, as discussed in greater detail herein with reference to FIGS. 16-19B, the home's HVAC system can be placed in fluid communication with one or more fluid passages, conduits or other portions of a bed assembly.

A climate control system for a bed assembly 10 can be additionally configured to continuously or intermittently communicate with one or more networks to receive firmware and/or other updates that help ensure that the system is operating correctly. For example, the control module 50, user input devices 62, 64 and/or any other component of the climate control system can be designed to connect to a network (e.g., interne). In some embodiments, the bed assembly is adapted to be operatively connected to a manufacturer's or supplier's website, server, network and/or the like to receive the necessary updates or patches. In other arrangements, such network connections can facilitate the repair, maintenance or troubleshooting of the climate control bed assembly, without the need for an on-site visit by a technician.

As illustrated in FIGS. 6-15, a user input device can be adapted for use with different climate control systems for beds or other seating assemblies. For instance, a user input device can comprise one or more cable and/or other hardwired connections that are sized, shaped and otherwise adapted to be received by a corresponding port or coupling of a control module or other portion of the climate control system. Likewise, in embodiments where the user input device is wireless (e.g., remote control, other handheld, etc.), the input device can be configured to operate with two or more different climate control systems. This can help create a modular system in which one or more components of a thermally-conditioned bed or other seating assembly are combined without the need for relatively complicated and/or time-consuming re-designs.

According to certain arrangements, each user input device 62, 64 is adapted to regulate one or more fluid modules, climate zones and/or other devices or components of a climate controlled bed assembly 10. For example, with continued reference to the schematic of FIG. 1, a first user input device 62 can regulate the operation of two fluid modules 20A, 20C, and thus, the corresponding climate zones 11A, 11C, situated along the left side L of the bed 10. Likewise, a second user input device 64 can regulate the operation of two other fluid modules 20B, 20D, and thus, the corresponding climate zones 11B, 11D, situated along the right side R of the bed 10. Consequently, each bed occupant can selectively regulate the heating, cooling, ventilation and/or other climate control scheme along his or her side of the bed 10 (e.g., left or right side). Moreover, as discussed herein, a bed can include two or more different fluid modules 20A-20D and/or climate zones 11A-11D within a region that is sized and otherwise configured to receive a single occupant. Accordingly, in certain embodiments, an input device 62, 64 is capable of regulating one fluid module (or climate zone) separately and independently from another fluid module (or climate zone), as desired. Thus, as depicted in FIG. 1, an input device 62, 64 can be advantageously configured to control one, two or more fluid modules or climate zones generally located along one side (e.g., the left side L, right side R, etc.) or any other region of the bed assembly 10.

According to certain arrangements, the various devices, components and features of a climate controlled bed assembly 10 are configured to adjust the type and/or level of heating, cooling, ventilation and/or other climate control effect by modifying the operation of the fluid modules 20A-20D. For example, the rate at which fluids are transferred toward an occupant (e.g., using a blower, fan or other fluid transfer device) can be advantageously controlled. Further, the amount and direction of electrical current delivered to the thermoelectric device can be altered to achieve a desired level of heat transfer to or from the fluid transferred by the fluid transfer device. One or more other aspects of the bed's climate control system can also be modified to achieve a desired operational scheme.

To help achieve a desired thermal conditioning effect in each climate zone 11A-11D, the fluid modules 20A-20D, other components of the climate control system and/or other portions of the bed 10 can comprise one or more sensors. For instance, such sensors can include temperature sensors, humidity sensors, condensation sensors, pressure sensors, occupant-detection sensors and/or the like. Accordingly, the climate control system can advantageously maintain a desired level of thermal conditioning (e.g., a setting, temperature value or range, etc.). The temperature sensors can be positioned within a thermoelectric device (e.g., along the substrate and/or between the pellets of the thermoelectric device), within or on other portions or components of the fluid module, upstream or downstream of a fluid module (e.g., within or near a fluid path to detect the amount of thermal conditioning occurring within the fluid module), along one or more top surfaces of the bed assembly 10 and/or at other location.

According to one embodiment, a thermally-conditioned bed assembly 10 comprises a closed-loop control scheme, under which the function of one or more fluid modules (e.g., blower or other fluid transfer device, thermoelectric device or other heating/cooling device and/or the like) is automatically adjusted to maintain a desired operational setting. For example, the climate control system can be regulated by comparing a desired setting (e.g., a target temperature value or range, a target cooling, heating or ventilation effect, etc.) to data retrieved by one or more sensors (e.g., ambient temperature, conditioned fluid temperature, relative humidity, etc.).

In certain arrangements, a climate control system for a bed or other seating assembly can comprise a closed-loop control scheme with a modified algorithm that is configured to reduce or minimize the level of polarity switching occurring in one or more of the thermoelectric devices of the fluid modules 20A-20D. As a result, the reliability of the overall climate control system can be advantageously improved.

As discussed in greater detail herein, a thermally-conditioned bed 10 or other seating assembly can include one, two or more different climate zones 11A-11D. In some embodiments, as illustrated schematically in FIG. 1, such a bed 10 includes separate climate zones for each occupant. Further, the area or other portion associated with each occupant (e.g., left side L, right side R, etc.) can include two or more distinct climate zones 11A-11D, allowing an occupant to further customize a heating, cooling, ventilation and/or other climate conditioning scheme according to his or her preferences. Thus, as discussed above, a user can configure a bed assembly 10 to provide varying levels of thermal conditioning to different portions of the bed (e.g., top or head area, midsection area, lower or leg area, etc.), as desired or required.

A climate controlled bed or other seating assembly can be operated under a number of different schemes. For example, in a simple configuration, a user selects a desired general setting or mode (e.g., "heating," "cooling," "ventilation," "high," "medium," "low," etc.). In response to a user's selection, the climate control system can maintain a corresponding setting or mode for a particular time period or until the user instruct the system otherwise. In other arrangements, a user chooses a desired setting (e.g., a target temperature value or range, some other desired cooling, heating or ventilation effect, etc.), and the climate control system automatically makes the necessary adjustments to maintain such a value, range or effect. Under such an automated or semi-automated scheme, the climate control system can comprise one or more sensors (e.g., temperature sensors, humidity sensors, etc.) that are adapted to facilitate the system to achieve the desired climate conditioning setting (e.g., using feedback loops). In other embodiments, the various components of a climate controlled bed can be operated according to a predetermined schedule or protocol. Such schedules or protocols can be based on, for example, the time of day, the time when a user typically or actually goes to bed, the projected or actual wake-up time, the ambient temperature within or outside the room where the bed is located and/or any other input or factor. Accordingly, the control module 50 and/or other component of the climate control system can comprise or be operatively connected to a control algorithm that helps execute a particular protocol.

In any of the embodiments disclosed herein, or equivalents thereof, the control system can be operatively connected to one or more input devices 62, 64 that advantageously permit users to selectively modify the operation of an environmentally conditioned bed or other seating assembly. As discussed in greater detail herein, such input devices can allow a user to customize the manner in which the bed or other assembly is controlled, in accordance with the user's desires or preferences.

According to certain embodiments, a climate control system for a bed or other seating assembly can be adapted to provide a desired level of thermal pre-conditioning. Such a pre-conditioning feature can allow a user to program a bed so that it achieves a particular temperature or setting prior to use. For example, an input device can be used to direct the climate control system to cool, heat and/or ventilate the bed prior to the user's anticipated sleep time. Likewise, a user can selectively program a climate control system to regulate the temperature or other environmental-conditioning effect during the anticipated sleep period. In such arrangements, a user can set a different target temperature, thermal conditioning effect, desired comfort level and/or any other setting for a specific time period. Such setpoints can be programmed for various desired or required time intervals (e.g., 10 minutes, 15 minutes, 30 minutes, 1 hour, 2 hours, 3 hours, 4 hours, less than 10 minutes, greater than 4 hours, values in between such ranges, etc.). Accordingly, a user can customize the operation of a climate controlled bed assembly according to his or her specific needs and preferences.

Further, the control system can be configured to change the heating, cooling, ventilation and/or other climate conditioning settings of the bed to help a user wake up and/or fall asleep. For example, the flowrate, temperature and/or other properties of the air delivered to the top surfaces of a bed can be increased or decreased to help awaken an occupant or to urge an occupant to get out of bed.

Moreover, a climate control system for a bed or other seating assembly can be adapted to shut down after the passage of a particular time period and/or in response to one or more other occurrences or factors. In certain arrangements, the operation of one or more fluid modules 20A-20D is altered (e.g., the speed of the fluid transfer device is reduced or increased, the heating and/or cooling effect is reduced or increased, etc.) or completely terminated at a specific time or following a predetermined elapsed time period after which an occupant initially becomes situated on a bed or other seating assembly. Accordingly, in some embodiments, the bed or other seating assembly includes one or more occupant sensors (e.g., pressure sensors) to accurately detect the presence of an occupant positioned thereon.

As discussed herein, a climate-conditioned bed or other seating assembly can include one or more humidity sensors. Such humidity sensors can be positioned along any component of the bed's climate control system (e.g., user input devices, control module, fluid modules, etc.), any other portion of the bed assembly (e.g., mattress or other support member) and/or the like. Regardless of their exact configuration, location and other details, humidity sensors can be operatively connected to the climate control system to provide additional control options to a user.

According to certain arrangements, the relative humidity of the air or other fluids surrounding a bed assembly and/or passing through the fluid modules, passages and/or other portions of a bed assembly can be detected. In other embodiments, a climate controlled bed or other seating assembly includes one or more condensation sensors, either in lieu of or in addition to one or more humidity sensors. Such humidify and/or condensation sensors can help protect against the undesirable and potentially dangerous formation of condensate within one or more portions or components of a bed assembly. For instance, if relatively humid air is sufficiently cooled by a fluid module, condensation may form along one or more components or portions of the assembly's climate control system. If not removed or otherwise handled, such condensation can cause corrosion and/or other moisture-related problems. Further, condensation can negatively affect one or more electrical circuits or other vulnerable components of the climate control system.

Accordingly, in certain arrangements, a climate control system for a bed or other seating assembly is configured to make the necessary operational changes so as to reduce the likelihood of condensate formation. For example, under certain circumstances, the amount of cooling provided by the fluid modules 20A-20D (e.g., the thermoelectric devices or other cooling devices) to the air delivered through the bed assembly can be reduced. Alternatively, the control system can be configured to cycle between heating and cooling modes in order to evaporate at least some of the condensate that may have formed. In some arrangements, information regarding the temperature, relative humidity and other ambient conditions can be advantageously shown on a screen or display to alert the user of a potentially undesirable situation.

According to other embodiments, an environmentally-conditioned bed or other seating assembly is configured to collect and remove condensation that is formed therein. For example, such condensation can be evaporated or other channeled away from the bed or other seating assembly, as desired or required. Additional information regarding the collection and/or removal of condensate from seating assemblies is provided in U.S. patent application Ser. No. 12/364,285, filed on Feb. 2, 2009 and titled CONDENSATION AND HUMIDITY SENSORS FOR THERMOELECTRIC DEVICES, the entirety of which is hereby incorporated by reference herein.

Figure 2B:
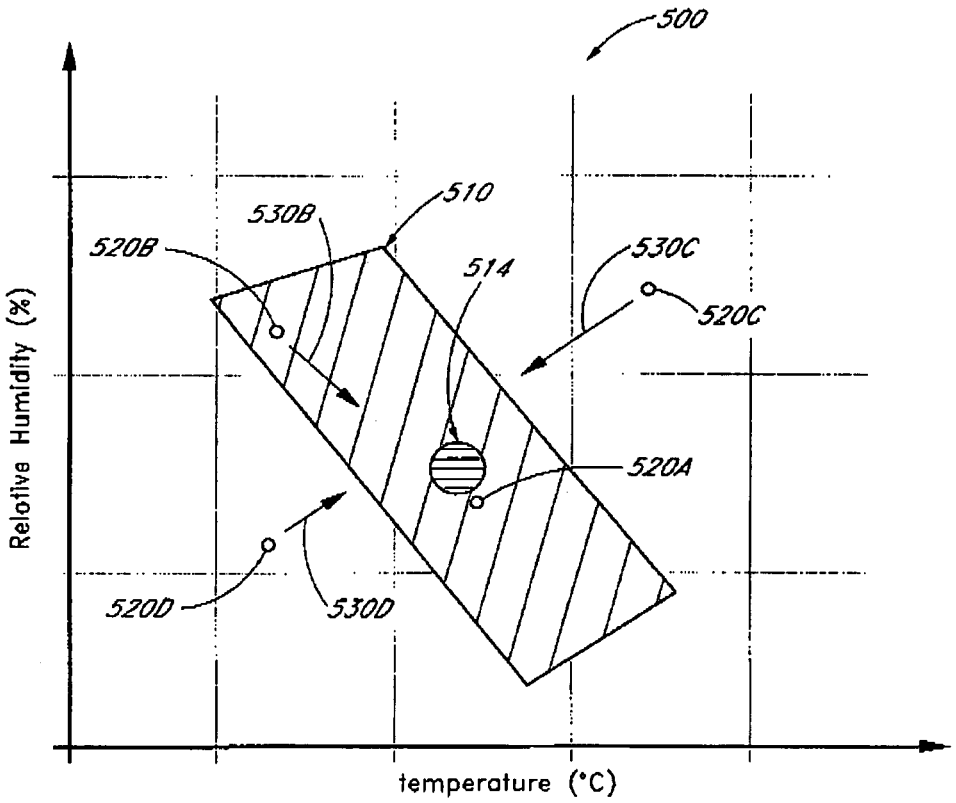
FIG. 2B illustrates a chart showing one embodiment of a comfort zone in relation to temperature and relative humidity.

In addition, the use of relative humidity sensors can permit an environmentally-conditioned bed or other seating assembly to operate within a desired "comfort zone." One embodiment of such a comfort zone (generally represented by cross-hatched area 510) is schematically illustrated in the graph 500 of FIG. 2B. As shown, a desired comfort zone 510 can be based, at least in part, on the temperature and relative humidity of a particular environment (e.g., ambient air, thermally conditioned air, air which has had its humidity level modified and/or other fluid being delivered through a climate controlled bed or other seat assembly, etc.). Thus, if the relative humidity is too low or too high for a particular temperature, or vice versa, the comfort level to an occupant situated within such an environment can be diminished or generally outside a target area.

For example, with reference to a condition generally represented as point 520C on the graph 500 of FIG. 2B, the relative humidity is too high for the specific temperature. Alternatively, one can conclude that the temperature of point 520C is too high for the specific relative humidity. Regardless of how a particular condition is described, in some embodiments, in order to improve the comfort level of an occupant who is present in that environment, a climate control system can be configured to change the surrounding conditions in an effort to achieve the target comfort zone 510 (e.g., in a direction generally represented by arrow 520C). Likewise, a climate control system for a bed or other seating assembly situated in the environmental condition represented by point 520D can be configured to operate so as to change the surrounding conditions in an effort to achieve the target comfort zone 510 (e.g., in a direction generally represented by arrow 520D). In FIG. 2B, environmental conditions generally represented by points 520A and 520B are already within a target comfort zone 510. Thus, in some embodiments, a climate control system can be configured to maintain such surrounding environmental conditions, at least while an occupant is positioned on the corresponding bed or other seating assembly.

In some embodiments, a climate control system for a bed is configured to include additional comfort zones or target operating conditions. For example, as illustrated schematically in FIG. 2B, a second comfort zone 514 can be included as a smaller area within a main comfort zone 510. The second comfort zone 514 can represent a combination of environmental conditions (e.g., temperature, relative humidity, etc.) that are even more preferable than other portions of the main comfort zone 510. Thus, in FIG. 2B, although within the main comfort zone 510, the environmental condition represented by point 520B falls outside the second, more preferable, comfort zone 514. Thus, a climate control system for a bed or other seating assembly situated in the environmental condition represented by point 520B can be configured to operate in at attempt to attain the second comfort zone 514 (e.g., in a direction generally represented by arrow 520B).

In other embodiments, a climate control system can include one, two or more target comfort zones, as desired or required. For example, a climate control system can include separate target zones for summer and winter operation. In such arrangements, therefore, the climate control system can be configured to detect the time of year and/or the desired comfort zone under which a climate controlled bed or other seat assembly is to be operated.

The incorporation of such automated control schemes within a climate control system can generally offer a more sophisticated method of operating a climate-conditioned bed or other seat assembly. Further, such schemes can help simplify the operation of a climate controlled bed and/or lower costs (e.g., manufacturing costs, operating costs, etc.). This can be particularly important where it is required or highly desirable to maintain a threshold comfort level, such as, for example, for patients in hospital beds, other types of medical beds and/or the like. Further, such control schemes can be especially useful for beds and other seating assemblies configured to receive occupants that have limited mobility and/or for beds or other seating assemblies where occupants are typically seated for extended time periods (e.g., conventional beds, hospital beds, convalescent beds, other medical beds, etc.).

According to some embodiments, data or other information obtained by one or more sensors are used to selectively control a climate control system in order to achieve an environmental condition which is located within a desired comfort zone 510, 514 (FIG. 2B). For instance, a climate control system can include one or more temperature sensors and/or relative humidity sensors. As discussed in greater detail herein, such sensors can be situated along various portions of a bed or other seating assembly (e.g., within, on or near a thermoelectric device, fluid module, fluid distribution system, inlet or outlet of a fluid transfer device, fluid inlet, surface of an assembly against which an seated occupant is positioned, etc.) and/or any other location within the same ambient environment as the bed or other seating assembly (e.g., a bedroom, a hospital room, etc.). In other embodiments, one or more additional sensors are provided, such as, for example, an occupant detection sensor (e.g. configured to automatically detect when an occupant is positioned on a bed or other seating assembly), pressure sensor and/or the like.

Regardless of the quantity, type, location and/or other details regarding the sensors included within a particular assembly, the various components of the climate control system can be configured to operate (in one embodiment, preferably automatically) in accordance with a desired control algorithm. According to some embodiments, the control algorithm includes a level of complexity so that it automatically varies the amount of heating, cooling and/or provided at the bed assembly based, at least in part, on the existing environmental conditions (e.g., temperature, relative humidity, etc.) and the target comfort zone.

Accordingly, in some embodiments, a control system for an environmentally-conditioned bed (e.g., ventilated bed, low air loss bed, other consumer or medical bed, etc.) or other seating assembly is configured to receive, as inputs into its control algorithm, data and/or other information regarding the temperature and relative humidity from one or more locations. For example, a climate controlled bed can include fluid distribution systems 18' (FIG. 2A) located along the top of the support member (e.g., mattress) or any other portion. Each fluid distribution system 18' can be in fluid communication with one or more fluid module 20A-20D (e.g., a fluid transfer device, a thermoelectric device and/or the like).

Temperature sensors included in a climate controlled bed assembly (e.g., on, near or within a thermoelectric device, blower and/or other portion of a fluid module, on, near or within one or more layers of the mattress, foundation or other portion of the bed's structure, etc.) can be used to advantageously detect a fire or other over-temperature event or conditions that are likely to result in such events. For example, such sensors could be the same as the sensors that are discussed above and that are used to control the climate control system according to a desired setting. Alternatively, such sensors can be separate and distinct from sensors used in the normal regulation of the bed's climate control system. Fire or over-temperature sensors can be located within or outside of thermoelectric devices, on the blower intake or outlet, within, on or near other portions of a fluid module, within or near the bed's fluid ducts or other openings, within or near the bed's foundation or base and/or at any other location. Such fire or over-temperature sensors can be operatively coupled to an electronic control unit and/or any other component or system of the bed's climate control system.

According to some embodiments, when one or more fire or over-temperature sensors detect a temperature that is above a particular threshold, a signal can be transmitted to the bed assembly's climate control system (e.g., ECU, MCU, etc.). In response to receiving such an "over the limit" signal, the controller can be adapted to shut down power to fluid modules and/or any other systems that are configured to supply air or other fluid to the bed assembly. In some embodiments, the bed includes one or more fluid pumps (e.g., to selectively deliver air or other fluids to an air mattress, an air bladder, etc.), blowers or other fluid transfer devices and/or other devices or portions that require air to be delivered to the bed. In the presence of a fire, spark or other threatening event, air or other fluid being supplied to the bed can further fuel the fire. The bed's control system can be configured to shut down one or more devices or sub-systems (e.g., fluid module, air pump, etc.) or the entire electrical system associated with the bed assembly, as desired or required.

Accordingly, the threat created by such a fire or other over-temperature situation can be advantageously mitigated. Thus, the overall safety of the climate controlled bed (e.g., ventilated bed, low air loss bed, other conventional or consumer bed, medical bed, etc.) assembly can be improved. Such a safety feature can be incorporated into any of the bed embodiments disclosed herein or equivalents thereof.

In any of the embodiments disclosed herein, or equivalents thereof, a control unit (e.g., ECU, MCU, other controller, etc.) can be configured to regulate one or more fluid modules (e.g., blower, thermoelectric device, etc.) and/or other components of a climate controlled bed (e.g., ventilated bed, low air loss bed, consumer bed, hospital or other medical bed) using a control algorithm (e.g., stored within or operatively connected to a control unit), some hardware/software combination, the interne or other network connection and/or the like.

Under some operational scenarios, such as, for example, when two or more fluid modules 20A-20D are working at the same time, the noise level generated by a climate-conditioned bed may create a nuisance or otherwise become bothersome to the bed's occupant(s). Accordingly, in some embodiments, the control module or other portion of the climate control system is programmed to ensure that the fluid modules 20A-20D are activated, deactivated, modulated and/or otherwise operated in a manner that ensures that the overall noise level originating from the bed or other seating assembly remains below a desired or required threshold level. For example, with reference to the bed assembly depicted in FIG. 1, the fluid modules 20A-20D associated with each climate zone 11A-

11D can be cycled (e.g., turned on or off, modulated, etc.) to remain below such a threshold noise level. In some embodiments, the threshold or maximum noise level is determined by safety and health standards, other regulatory requirements, industry standards and/or the like. In other arrangements, an occupant is permitted to set the threshold or maximum noise level, at least to the extent provided by standards and other regulations, according to his or her own preferences. Such a setting can be provided by the user to the climate control system (e.g., control module) using a user input device.

Relatedly, the climate control system of a bed or other seating assembly can be configured to cycle (e.g., turn on or off, modulate, etc.) the various fluid modules 20A-20D according to a particular algorithm or protocol to achieve a desired level of power conservation. Regardless of whether the fluid module cycling is performed for noise reduction, power conservation and/or any other purpose, the individual components of a single fluid module 20A-20D, such as, for example, a blower, fan or other fluid transfer device, a thermoelectric device and/or the like, can be controlled independently of each other. Additional details regarding such operational schemes can be found in U.S. patent application Ser. No. 12/208,254, filed Sep. 10, 2008, published as U.S. Publication No. 2009/0064411 and titled OPERATIONAL CONTROL SCHEMES FOR VENTILATED SEAT OR BED ASSEMBLIES, the entirety of which is hereby incorporated by reference herein.

According to some embodiments, the power source 54 (e.g., AC power supply, battery or other DC power supply, etc.) of the environmentally-conditioned bed or other seat assembly is sized for enhanced, improved or optimal cooling performance. As a result, such a design feature can help to further lower power consumption and allow the climate control system to operate more efficiently, as the amount of wasted electrical energy is reduced or minimized.

Any of the embodiments of a climate conditioned bed or other seating assembly disclosed herein can comprise a "thermal alarm." For example, a climate control system can be configured to make a relatively rapid change in temperature and/or airflow to help awaken one or more of the bed's occupants. Depending on people's personal tendencies and sleep habits, such a thermal alarm can be configured to help awaken a bed occupant as a result of decreasing comfort, raising awareness and/or in any other manner. In some arrangements, the thermal alarm includes raising the temperature along the top surface of the bed assembly (e.g., by delivering heated air through the bed assembly). Such a feature can allow an occupant to wake up more naturally or gradually. Alternatively, depending on a user's preferences, the thermal alarm can include lowering the temperature to gradually or rapidly decrease an occupant's comfort level. A climate-conditioned bed assembly can also include one or more other types of alarms (e.g., a conventional audible alarm, an alarm equipped with a radio, digital media player or the like, etc.), either in addition to or in lieu of a thermal alarm. In some arrangements, such alarm features and/or devices can be operatively connected to the control module of the climate control system to allow a user to regulate their function through an input device 62, 64 or any other controller. A bed assembly can have one or more thermal alarms that are separately controlled. Thus, the bed's occupants can choose whether to set such an alarm, and if so, how it is to be implemented.

Other embodiments of climate controlled bed assemblies 110, 210, 310 are schematically illustrated in FIGS. 3-5. Although these specific alternative arrangements are disclosed herein, a climate control system for a bed or other seating assembly can be modified in any other manner, as desired or required.

Figure 3A:
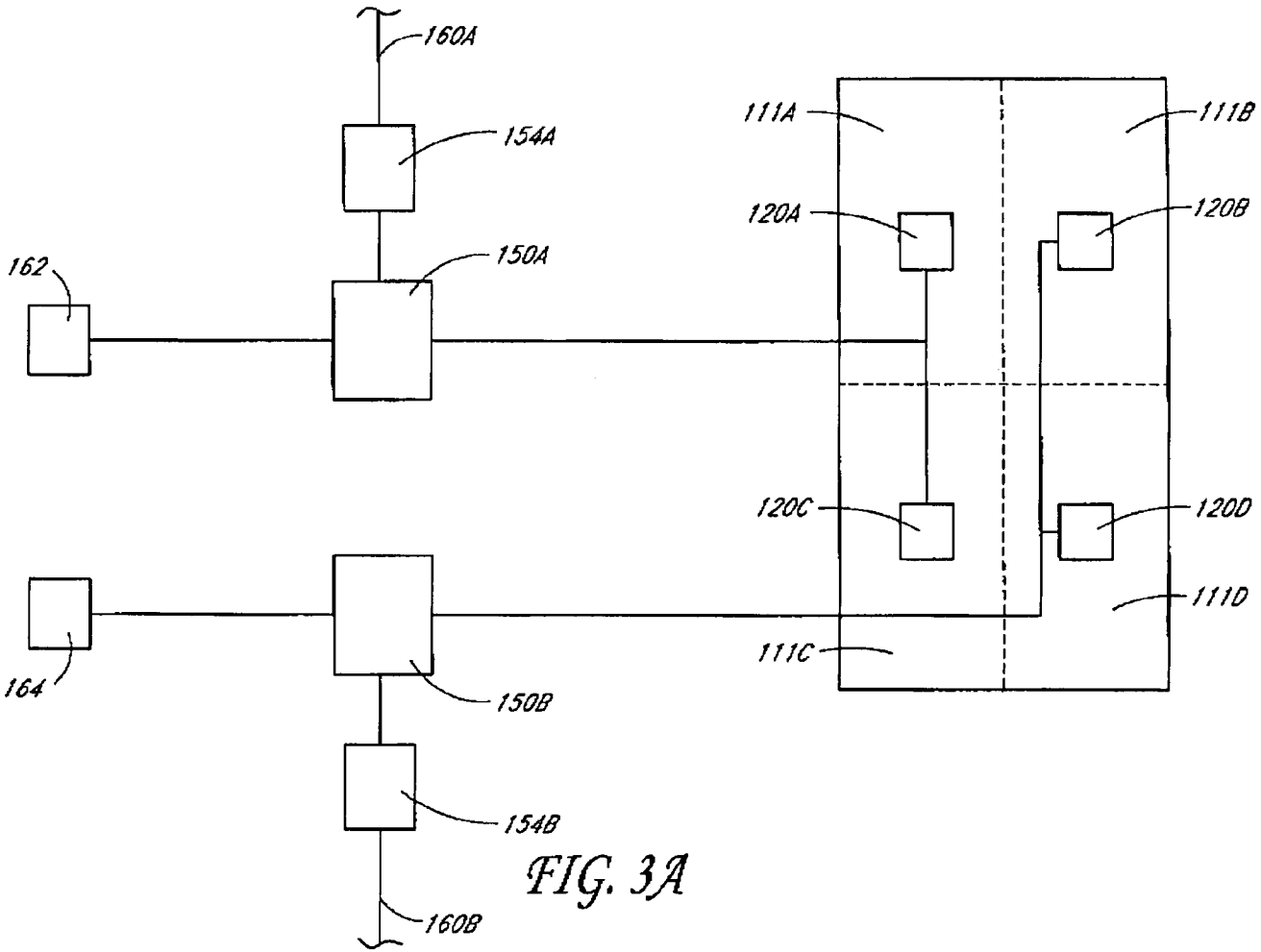
FIG. 3A illustrates a schematic of a climate controlled bed and its various control components according to one embodiment.
Figure 4A:
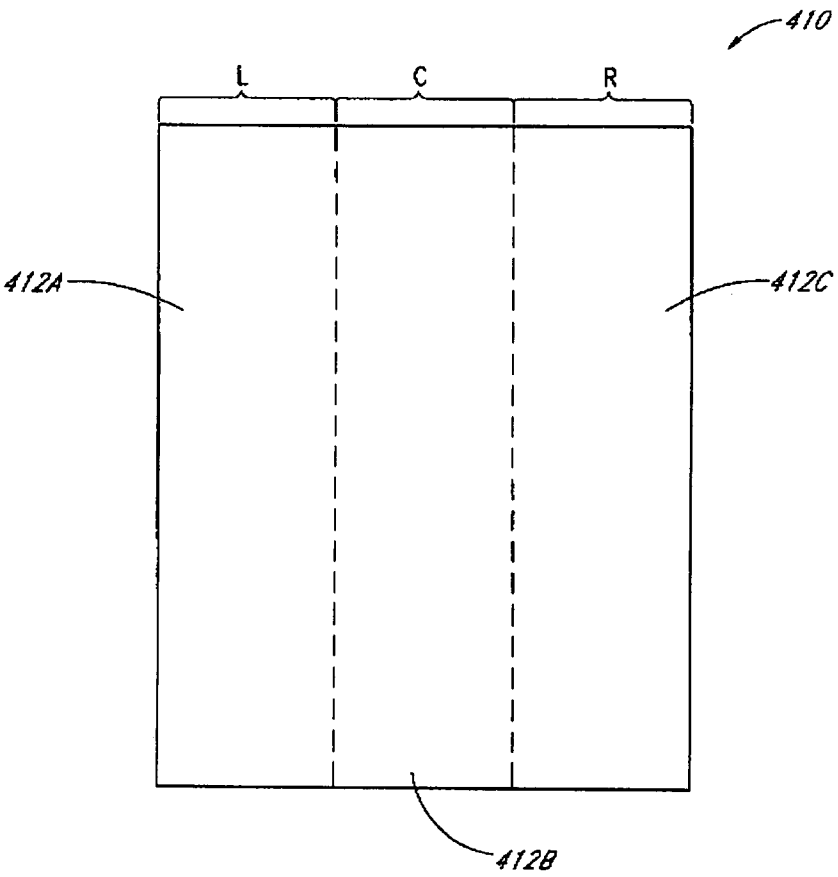
FIG. 4A illustrates a schematic top view of a climate controlled bed having three climate zones according to one embodiment.

The bed 110 of FIG. 3A is similar to the one schematically illustrated in FIG. 1, in that it includes a plurality of climate zones 111A-111D and fluid modules 120A-120D that permit users to personalize the heating, cooling, ventilation and/or other climate control effect along different portions of the bed. Thus, as discussed herein with reference to FIG. 1, a first occupant can selectively provide thermal or environmental conditioning to his or her side of the bed that is generally different than a fellow occupant's desired thermal or environmental conditioning. In addition, each side of the assembly (e.g., the left or right side) can include two or more separate climate zones 111A-111D that allow an occupant to further personalize his or her desired conditioning scheme.

In the embodiment illustrated in FIG. 3A, the fluid modules 120A-120D of the bed 110 are operatively connected to two different control modules 150A, 150B (e.g., ECUs). As shown, the fluid modules 120A, 120C positioned within climate zones 111A, 111C along the left side of the bed 110 are connected to a first control module 150A, whereas the fluid modules 120B, 120D positioned within climate zones 111B, 111D along the right side of the bed are connected to a second control module 150B. In other arrangements, an environmentally-conditioned bed can include more or fewer control modules 150A, 150B and/or other climate control components, as desired or required. In turn, as discussed with reference to FIG. 1, each control module (e.g., ECU) 150A, 150B can comprise or be operatively connected to a power source 154A, 154B (e.g., AC adapter, battery, other power module or source, etc.), a user input device 162, 164 and/or any other device, component or system.

As a result of the configuration illustrated in FIG. 3A, the bed assembly 110 can include separate climate control systems for each occupant. Such dedicated systems can provide more reliable and robust control of the heating, cooling, ventilation and/or other environmental control features that a bed 110 offers. The modules 150A, 150B, power sources 154A, 154B and/or other components of the climate control system can be attached to the bed 110, positioned within one or more interior portions of the bed 110 (e.g., within a box spring or other support structure), placed in a location remote to the bed 110 and/or the like, as desired or required.

Figure 3C:
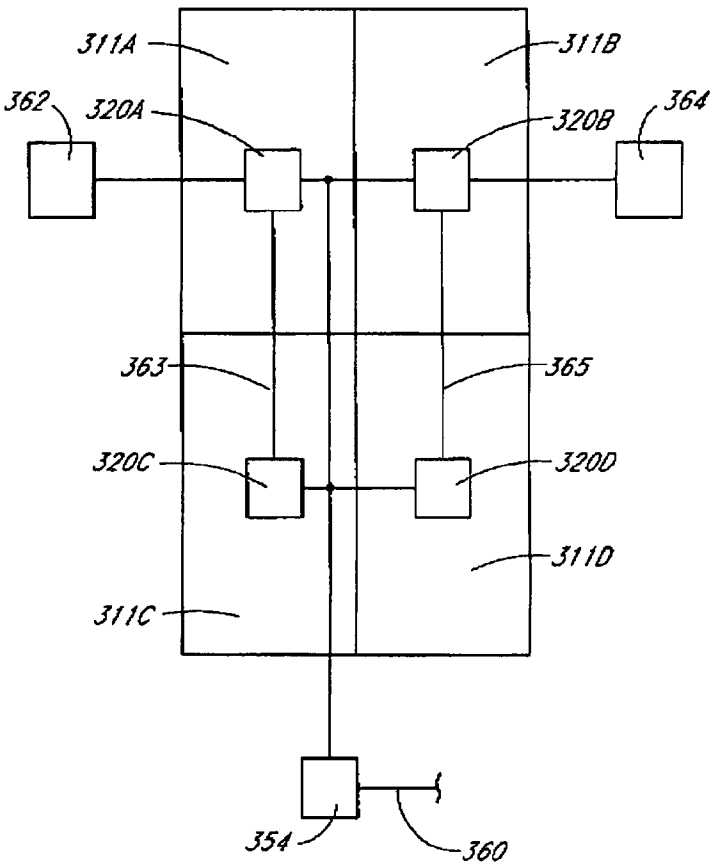
FIG. 3C illustrates a schematic of a climate controlled bed and its various control components according to another embodiment.
Figure 3B:
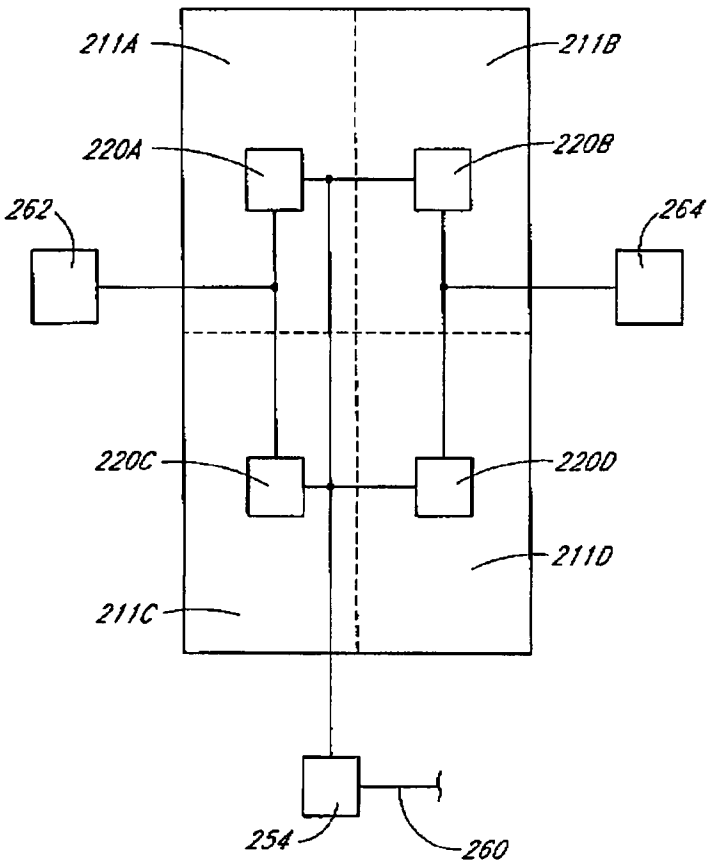
FIG. 3B illustrates a schematic of a climate controlled bed and its various control components according to another embodiment.

FIGS. 3B and 3C schematically illustrate environmentally conditioned beds 210, 310 that comprise modified versions of fluid modules. For example, in certain arrangements, including but not limited to any of the specific embodiments disclosed herein, a bed or other assembly includes one or more integrated fluid modules 220A-220D, 320A-320D within the various climate zones 211A-211D, 311A-311D. Such integrated fluid modules 220A-220D, 320A-320D can comprise a control unit, sensors and/or other control components or features within the same housing or enclosure as the fluid transfer device (e.g., fan, blower, etc.), the thermoelectric device (or other heating or cooling device) and/or the like. Accordingly, the need for separate control modules (e.g., ECUs) can be advantageously eliminated. Additional information regarding integrated fluid or fluid modules is provided in U.S. patent application Ser. No. 11/047,077, filed on Jan. 31, 2005, titled CONTROL SYSTEM FOR FLUID MODULE IN VEHICLE and now issued as U.S. Pat. No. 7,587,901 FLUID MODULE, the entirety of which is hereby incorporated by reference herein.

According to some embodiments, as illustrated in FIGS. 4 and 5, all the integrated fluid modules 220A-220D, 320A-320D for the respective bed 210, 310 are operatively to the same power source 254, 354 (e.g., AC power adapter, battery or other DC connection, etc.). Alternatively, a bed 210, 310 or other seating assembly can include additional power sources 254, 354, as desired or required. In FIG. 3B, the bed assembly 210 comprises a total of two user input devices 262, 264, which as discussed herein, may be used by an occupant to control the operation of the bed's climate control system and/or any other device, component, system or feature that is operatively connected to the bed. In other embodiments, a bed or other seating assembly can include more or fewer input devices 262, 264, as desired or required. In the depicted embodiment, one input device 262 is connected to the two fluid modules 220A, 220C located along the left side of the bed 210, while the other input device 264 is connected to the two fluid modules 220B, 220D located along the right side of the bed. Such a configuration can advantageously permit the bed's left and right sides to be controlled separately, in accordance with the desires and preferences of the occupants situated thereon. The user input devices 262, 264 can be operatively connected to each integrated fluid module 220A-220D using hardwired (e.g., cables, wires, etc.) and/or wireless (e.g., radio frequency, Bluetooth, etc.) connections.

The embodiment illustrated in FIG. 3C is similar to the bed of FIG. 3B. However, each user input device 362, 364 in FIG. 3C is connected to only a single fluid module 320A, 320B. In such arrangements, only some of the fluid modules 320A, 320B comprise an integrated control unit. This can help reduce costs and the overall complexity of the climate control system. The remaining fluid or fluid modules 320C, 320D can be operatively connected to the input devices 362, 364 and incorporated into the overall climate control system using cross-connections 363, 365 between various fluid modules. As with any other electrical or data connections discussed herein, such cross-connections 363, 365 can be hardwired and/or wireless, as desired or required.

As noted herein, a climate controlled bed can include one or more different climate zones configured to provide separate heating, cooling, ventilation and/or other environmental control to one, two or more occupants. For example, in the embodiment illustrated in FIG. 4A, the bed assembly 410 includes left, center and right climate zones 412A, 412B, 412C. As with the other arrangements disclosed herein, the bed 410 can be configured so that the heating, cooling, ventilation and/or other climate control scheme for each zone is controlled independently. Thus, two or more bed occupants can select the type of environmental conditioning associated with their respective side or portion of the bed. A climate controlled bed can include any size (e.g., single, twin, queen, king, custom, etc.), type (e.g., conventional, spring, foam, hospital or other medical bed, etc.) and/or other configuration. The embodiment depicted in FIG. 4A can include a king size bed 410 since it is wide enough to rationalize three separate zones. However, in other arrangements, three or more zones can be incorporated into smaller beds as well, such as, for example, queen or twin beds. In addition, a king size bed can include fewer (e.g., one or two) or more (e.g., four, five, six, etc.) climate zones, as desired or required.

Figure 4B:
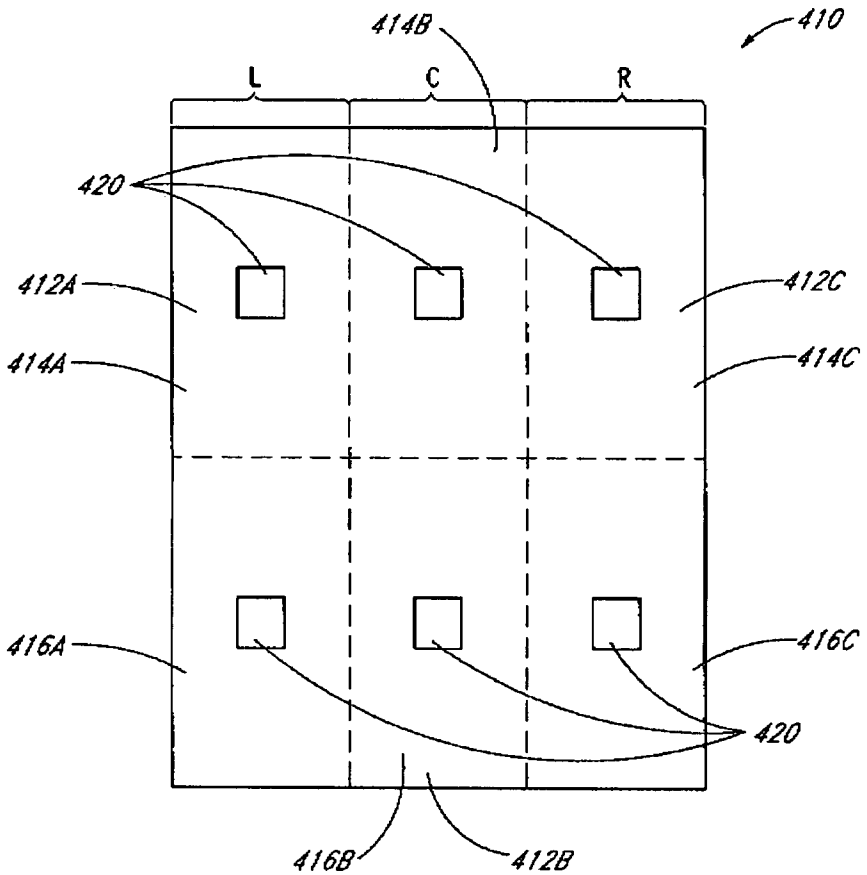
FIG. 4B illustrates a schematic top view of a climate controlled bed having subzones within separate climate zones according to one embodiment.
Figure 4C:
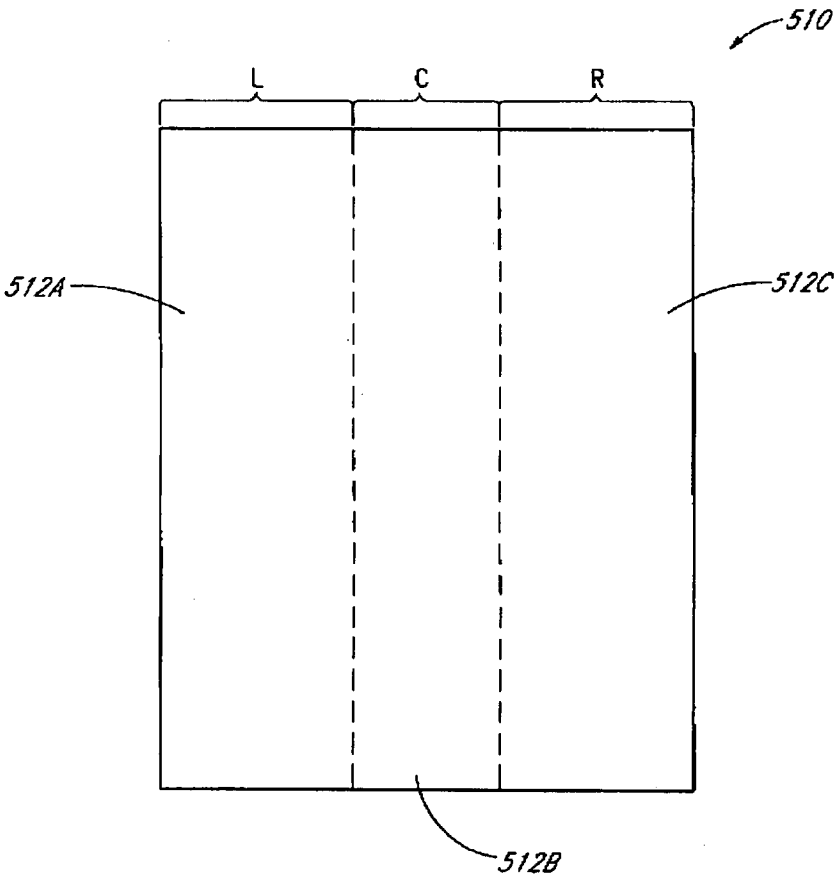
FIG. 4C illustrates a schematic top view of a climate controlled bed having three climate zones according to another embodiment.

As illustrated in FIG. 4B, each major climate zone 412A, 412B, 412C of a bed 410 can be further divided into two or more climate subzones 414A-414C, 416A-416C. As discussed above with reference to FIGS. 1, 2A and 3A-3C, each subzone can include one or more fluid modules 420 that are configured to deliver ambient or environmentally-modified (e.g., heated, cooled, etc.) air to the corresponding subzone. These fluid modules can be operatively connected to each other and/or a control unit, as desired or required.

Each of the climate zones in the bed assemblies schematically illustrated in FIGS. 4A and 4B, have a similar or substantially similar size and shape. However, in other arrangements, the size, shape, location and/or other details of a bed's climate zones and/or subzones can vary. For example, in the embodiment depicted in FIG. 4C, the bed 510 includes left and right climate zones 512A, 512C that are larger (e.g., wider) than the central zone 512B. Such a configuration can be based on the anticipated or likely location of the bed's occupants. By way of example, if the bed typically receives two occupants, the central climate zone 512B can define an intermediate region where one, both or neither occupant may be positioned. Thus, such a central or middle zone 512B can be customized adjusted accordingly.

In other embodiments, however, a bed having two, three or more climate zones can be used by only a single occupant. Thus, such a single occupant can choose to operate the bed's different zones with a common climate control scheme. Consequently, in the beds depicted in FIGS. 4A-4C, the left, central and right zones can be configured to heat, cool, ventilate and/or otherwise condition the air passing therethrough similarly or substantially similarly. A similar operational scheme can be selectively implemental by a single occupant of a bed having more or fewer zones, such as, for example, the beds illustrated in 1, 2A and 3A-3C. In other arrangements, a single occupant can configured the climate control bed to have two or more regions with varying climate control schemes according to his or her preferences.

Figure 5A:
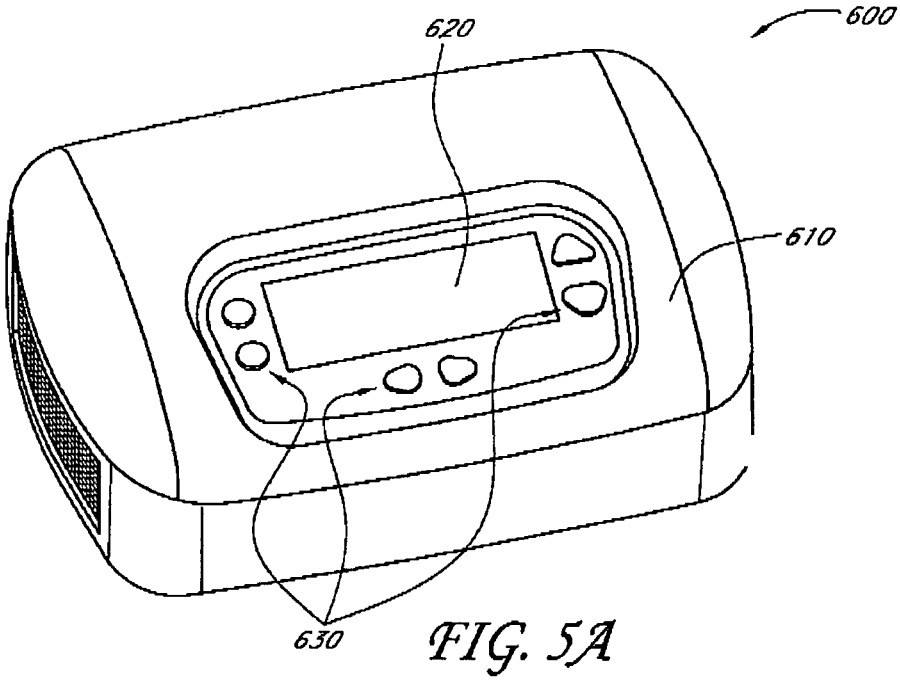
FIGS. 5A and 5B illustrate front and rear perspective views of a control unit configured for use with a climate control bed according to one embodiment.
Figure 5B:
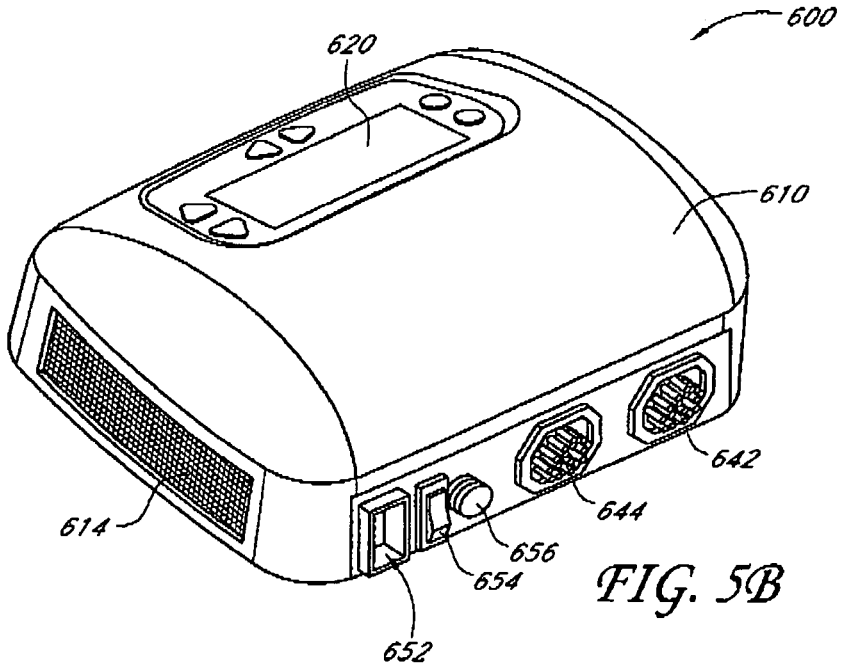

One embodiment of a control unit 600 (e.g., an ECU or master control unit (MCU), etc.) for a climate controlled bed assembly, such as any of those disclosed herein, is illustrated in FIGS. 5A and 5B. The control unit 600 can include an outer housing 610 that encompasses various internal components (not shown). As illustrated in FIGS. 5A and 5B, the control unit 600 can comprise one or more screens or other displays 620 that are configured to provide information to a user. A display 620 can provide the status of the climate control bed, such as, for example, whether the climate control system is operating, the mode of operation, timer information, temperature and/or humidity information (e.g., for the ambient air, climate-conditioned air, etc.) and/or the like. The housing 610 can include one or more fans and/or vents 614 (or other openings) to help dissipate unwanted heat that is generated within the control unit 600. Other ways of regulating the temperature of the control unit can also be used.

With continued reference to FIGS. 5A and 5B, the control unit 600 can include one or more buttons 630, knobs, switches and/or other controllers. Such buttons 630 and/or other controllers can advantageously permit a user to adjust the controller's settings, enter data and/or provide any other instructions and other information. In some embodiments, the display 620 comprises a touchscreen that is configured to also function as a user-input device (e.g., with the help of soft-keys). The control unit 600 can include a master On/Off button or switch 654, a fuse 644 and/or any other feature or component.

According to some embodiments, the control unit 600 includes one or more ports, outlets, adapters or other couplings configured for hardwired connections. As noted herein, the control unit can be configured to wirelessly communicate with one or more components of the bed assembly (e.g., remote controllers, fluid modules, a home's air conditioner unit, heater or other HVAC system, etc.), either in addition to or in lieu of hardwired connections. The control unit embodiment illustrated in FIGS. 5A and 5B includes an AC power port 652 that is configured to receive a power cable. As shown, the control unit 600 can also include ports 642, 644 that are adapted to receive a cord or other connection to a fluid module, another control unit and/or any other component of a climate controlled bed assembly.

Figure 5C:
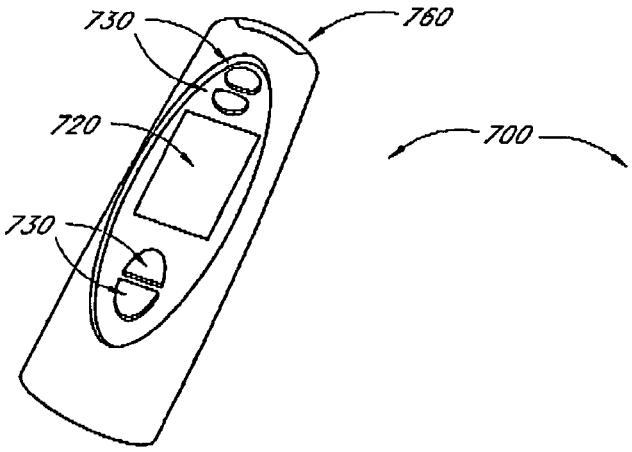
FIGS. 5C and 5D illustrate front and rear perspective views of a remote controller or user input device configured for use with a climate controlled bed according to one embodiment.
Figure 5D:
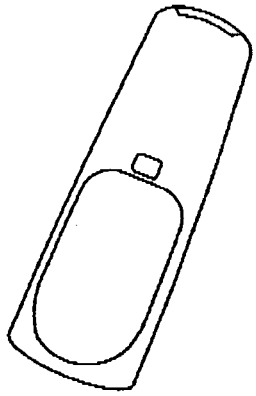

FIGS. 5C and 5D illustrate one embodiment of a remote control 700 or user input device configured to communicate with a control unit or other component of a bed assembly. As shown, the remote control device 700 can include one or more displays 720 (e.g., LCD, LED, plasma, OLED, etc.) configured to provide information to a user. In some embodiments, a display 720 can include a touchscreen (e.g., having soft-keys) or some other panel that is configured to both provide and receive information, instructions and/or the like. The remote control device 700 can additionally include one or more buttons 730, knobs, keyboard or keypad, levers, switches and/or any other controllers that can enable to user to enter data, instructions and/or other information. Such inputs can be used to control the operation of a bed assembly's climate control system (e.g., to regulate or adjust the level of heating, cooling, ventilation and/or other environmental control scheme being provided to one or more portions of the bed, to set a timer associated with the climate control operation of the bed, to set the bed's thermal alai in, to schedule a preconditioning cycle, etc.), to operate a media or other device that is operatively coupled to the bed, to schedule an audible or other type of alarm and/or the like.

According to several embodiments, a remote control device can be configured to communicate with a bed's ECU or other control unit, one or more fluid modules, other components or systems of the bed, a home's climate control system, a media player or other device that is in data communication with the bed assembly and/or the like. As noted herein, the remote control device can be adapted to connect to control unit using one or more hardwired and/or wireless connections. In some arrangements, a bed assembly's climate control system can be configured to be operated using a single remote control device 700. For example, the remote control device 700 depicted in FIGS. 5C and 5D can be adapted to control most or all climate control zones and/or subzones included in a bed. Alternatively, a climate control bed can comprise two or more remote controllers. Thus, each occupant or user can be provided with his or her own control device with which to control the operation of the bed assembly.

Figure 5E:
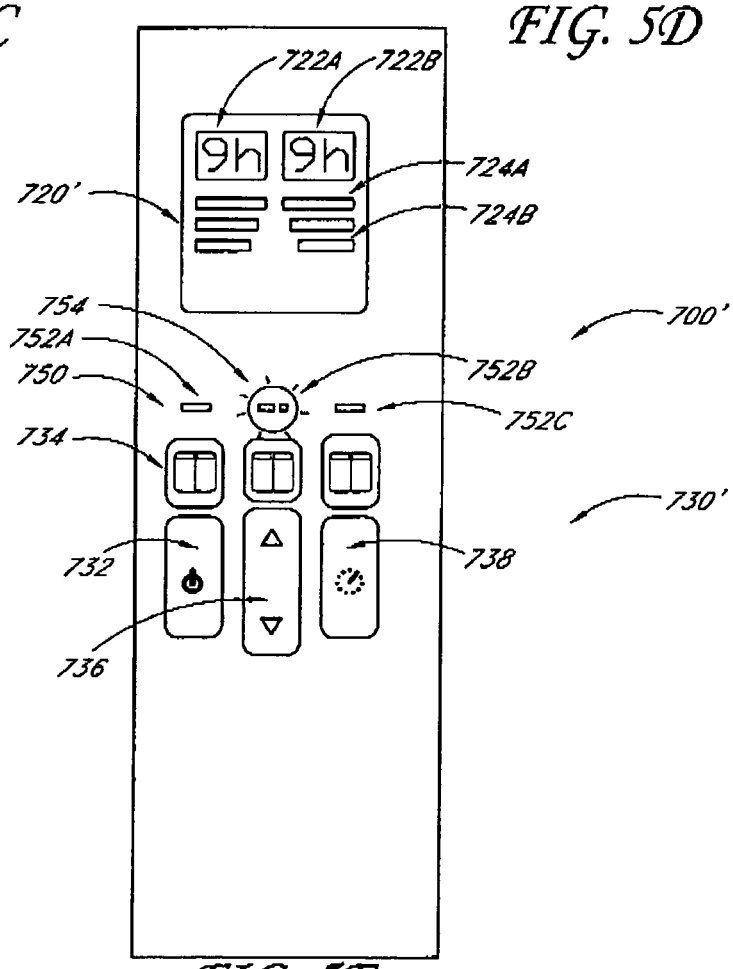
FIG. 5E illustrates another embodiment of a remote controller or user input device configured for use with a climate controlled bed.

Another embodiment of a remote control device 700' is illustrated in FIG. 5E. As discussed above with reference to FIGS. 5C and 5D, the remote control device 700' can comprise a display 720', indicator lights 750, one or more buttons 730' or other controllers and/or the like. As shown, the buttons 730' of the remote control device 700' can be used to control one or more aspects of a bed's climate control system. For example, buttons 734 allow a user to select which climate control zone or subzone to adjust (e.g., left side, right side, both left and right sides simultaneously, etc.). In some arrangements, an indicator light 752B (e.g., LED) corresponding to the user's selection will be activated (e.g., generally indicated by a symbol 754 in FIG. 5E).

With continued reference to FIG. 5E, the remote control device 700' can comprise adjustment buttons 736 that allow a user to make any desired modifications to a particular aspect of the bed's climate control scheme (e.g., increase or decrease temperature, set a timer or a thermal alarm, etc.) and/or operate another device or system that is operatively coupled to the assembly (e.g., media player, home climate control system, lights, etc.). In addition, the remote control device 700' can include one or more additional buttons or other controllers, as desired or required. For instance, in FIG. 5E, the device 700' includes an On/Off button 732 and a timer button 738. In other embodiments, however, a remote control device can include more or fewer buttons and/or other controllers.

In other embodiments, the ECU, other control unit or module and/or any other component, system and/or subsystem of the bed (or any other device or system that is configured to be operated, at least in part, by the bed's control system, e.g., media player, home climate control system, etc.) can be configured to be controlled by one or more other devices, such as, for example, a Smartphone (e.g., iPhone, Blackberry, etc.), a media device (e.g., iPod, iPad, mp3 player, other music and/or video players, etc.), a mobile phone, a personal computer, the internet and/or the like. Accordingly, in some embodiments, one or more downloadable software applications can be developed to allow users to communicate with a bed's control system using such devices.

According to some embodiments, a remote control device for a bed assembly can include one or more buttons or other controllers that enable a user to quickly and easily set a pre-conditioning mode. For example, in one arrangement, the remote control device includes buttons for general pre-conditioning, high heat or low heat pre-conditioning, high cool or low cool pre-conditioning and/or the like. In other embodiments, a remote control device includes other buttons that facilitate the control of the bed assembly, as desired or required.

Figure 6A:
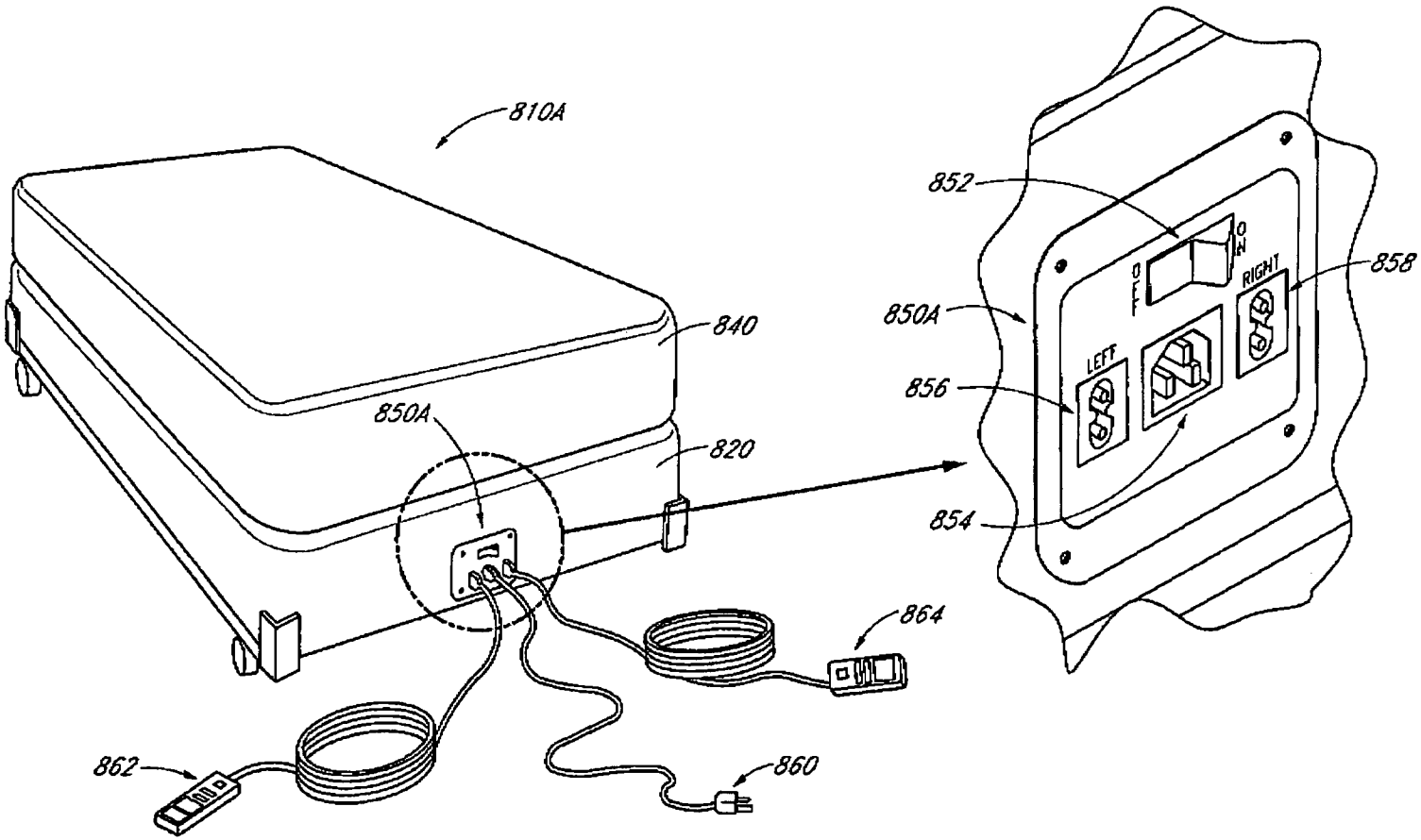
FIG. 6A illustrates a perspective view of a climate controlled bed having a control panel along an exterior of the lower portion according to one embodiment.

FIG. 6A illustrates one embodiment of a climate controlled bed 810A comprising one or more of the components or features disclosed herein. As shown, the bed 810A includes an upper portion 840 generally positioned on top of a lower portion 820. The lower portion 820 can comprise a control panel 850A along one of its outer surfaces. In some embodiments, the panel 850A is a part of or operatively connected to a control module, a power source and/or other component of the bed's climate control system. Thus, the control panel 850A can provide a convenient location for connecting the various devices, components, systems and/or the like to the bed assembly 810A. For example, in the arrangement illustrated in FIG. 6A, the panel 850A includes an ON/OFF switch 852, a power port 854 (e.g., in electrical communication with an AC port adapter configured to receive a power cord 860) and one or more ports 856, 858 for connecting user input devices 862, 864 or other controllers.

Figure 6B:
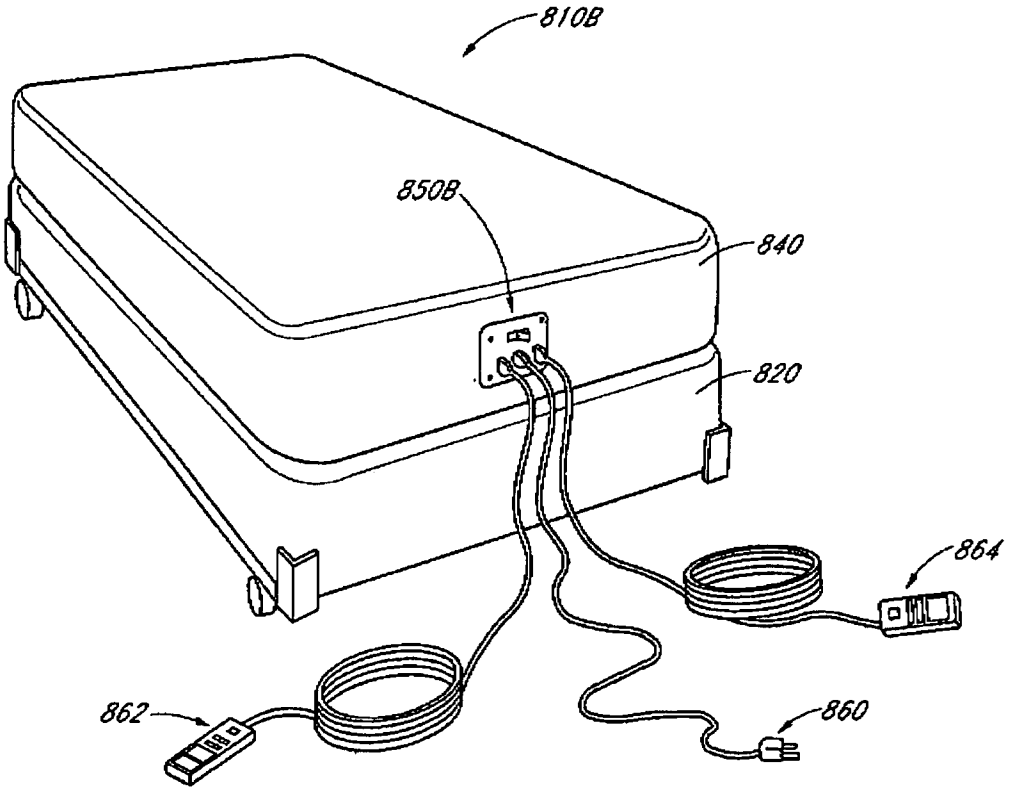
FIG. 6B illustrates a perspective view of a climate controlled bed having a control panel along an exterior of the upper portion according to one embodiment.

As illustrated in FIG. 6B, a control panel 850B and/or one or more other control components or features can be included in the upper portion 840 (e.g., mattress) of a bed 810B, either in lieu of or in addition to a panel and/or other components provided within the lower portion 820. In other embodiments, a control panel can be separate from both the upper portion and lower portion of a bed. For example, such a separate control panel can be positioned underneath or adjacent to the climate controlled bed or in any other location, while being configured to be operatively connected to the upper and/or lower portions of a bed.

Figure 6C:
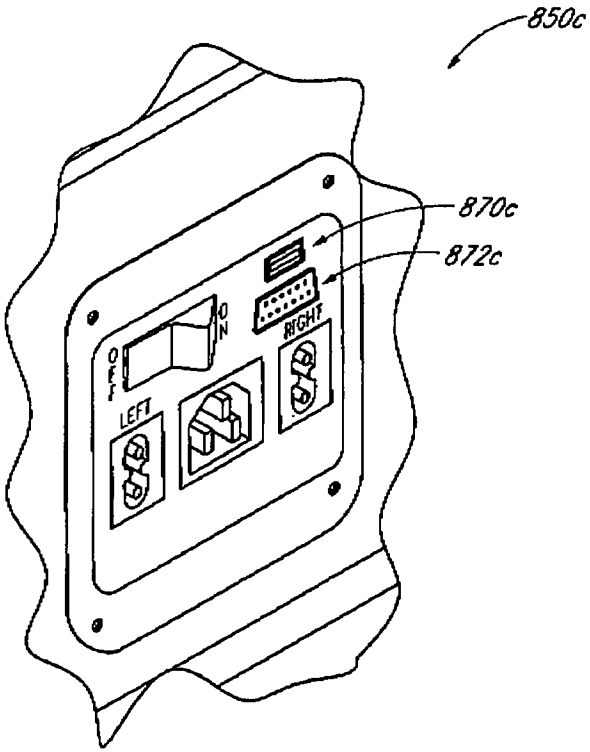
FIG. 6C illustrates a perspective view of a control panel for a climate controlled bed according to one embodiment.

In some of the embodiments disclosed herein, or equivalents thereof, a climate controlled bed includes one or more standard or non-standard connection ports. For example, as illustrated in FIG. 6C, a control panel 850C can include a Universal Serial Bus (USB) 870C, a serial port 872C and/or any other type of port or connection. In other arrangements, any other type of ports can be included, such as, for example, a parallel port, a mini-USB and/or the like, as desired or required. Regardless of the type of port or other connection point or system used, such features can advantageously permit a user to place the climate control system of a bed or other seating assembly in data communication with another device. In some embodiments, a USB or another type of port permits a user to operatively connect a processor, control unit and/or other component of the climate control system with a computer, a handheld device, a smart phone, diagnostic equipment, a network and/or other device or system. Accordingly, the climate control system can be configured to selectively receive and/or provide updates (e.g., patches), maintenance upgrades, troubleshooting queries or reports and/or the like. For instance, as a result of such connections, the control panel, and thus the climate control system, can receive periodic updates made available through the internet (e.g., a manufacturer's website), a computer, a handheld device, a thumb drive, any other system or device and/or the like.

In other arrangements, a bed's climate control system is configured to communicate with an external device or system (e.g., computer, internet, other network, etc.) using one or more wireless connections (e.g., radio frequency, Wi-Fi, Bluetooth, etc.), either in addition to or in lieu of any port or hardwired connections.

The control panel 850 and its various features can be operatively connected to the fluid modules, controllers or other control units and/or any other electrical components of the climate controlled bed 810. Thus, a user can control the operation of the bed 810 using a user input device 862, 864 and/or any switches, knobs and/or other selectors positioned on the control panel 850 or any other portion of the bed 810. As shown, the power cord 860, the input devices 862, 864 and/or other devices can be removably attached to corresponding slots or other connection sites on the control panel 850. This can permit a user to disconnect some or all of the components from the panel 850 when the climate control features of the bed are not desired or when the bed is being serviced, repaired, moved, repositioned or otherwise out of service. In any of the embodiments disclosed herein, a control panel can include one or more other ports, jacks, couplings and/or other electrical or data connections, as desired or required. For instance, the control panel 850 can include one or more audio and/or video input ports for connecting a digital media player (e.g., iPod, iPad, mp3 player, iPhone, Blackberry or other smart phones, television, other monitor or display, etc.). In other embodiments, the control panel 850 comprises ports or other coupling devices for connecting the climate control system to other devices or systems (e.g., other media or entertainment devices, an alarm clock, a home HVAC thermostat and/or the like).

As discussed in greater detail above, for any of the embodiments disclosed herein, or equivalents thereof, the operation of the bed assembly can be controlled using one or more hardwired and/or wireless user input devices (e.g., remote controls or other handheld devices). In some arrangements, for example, the control devices can be configured to communicate with a main control module (e.g., ECU) or processor, one or more fluid modules, timers, sensors (e.g., temperature sensors, humidity sensors, etc.) and/or any other components using infrared, radio frequency (RF) and/or any other wireless methods or technologies.

Figure 7:
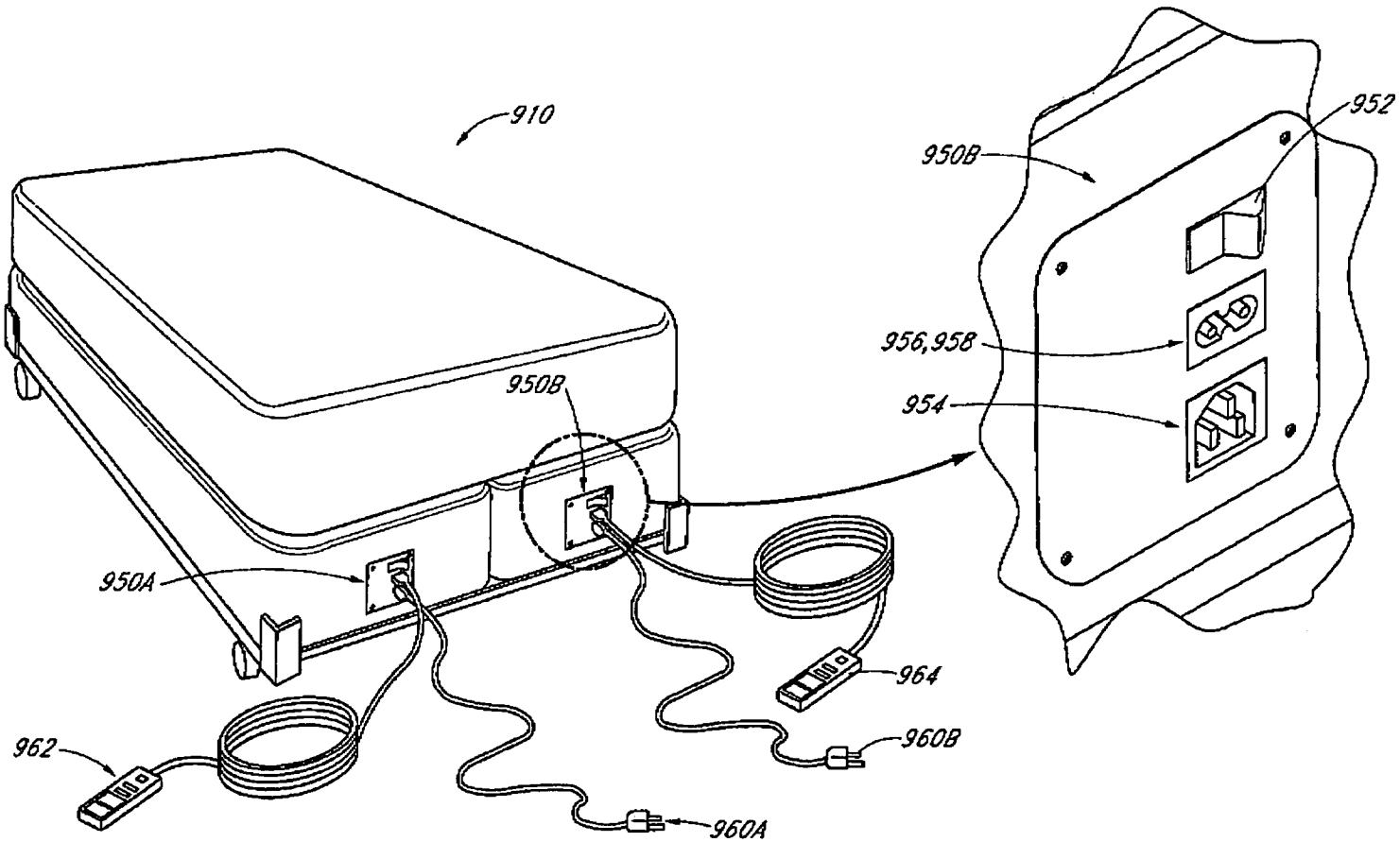
FIG. 7 illustrates a perspective view of a climate controlled bed having control panels along the exterior of its lower portions according to one embodiment.

FIG. 7 illustrates another embodiment of a climate controlled bed assembly 910 that comprises two separate lower portions. Each lower portion can include one or more fluid modules (not shown), controllers and/or other components of the climate control system. Accordingly, the bed 910 can include one, two or more different climate zones, which can be independently controlled by the bed's occupant(s). The upper portion (e.g., mattress or other support member) of the bed 910 can be configured to rest on top of both lower portions. The upper portion can include one or more fluid distribution members, fluid passages or conduits, comfort layers and/or any other layer or component. In some arrangements, the lower and upper portions of the bed 910 are preferably configured to permit ambient and/or climate conditioned air from the fluid modules to be conveyed toward the top of the bed 910 through one or more passageways, fluid distribution members, comfort layers and/or the like.

With continued reference to FIG. 7, each lower portion can comprise its own control panel 950A, 950B. In some embodiments, the control panels 950A, 950B can include an ON/OFF switch 952, slots or other connection sites 954, 956, 958 for removably connecting power cords 960A, 960B, user input devices 962, 964 and/or any other component, device or system.

Figure 8:
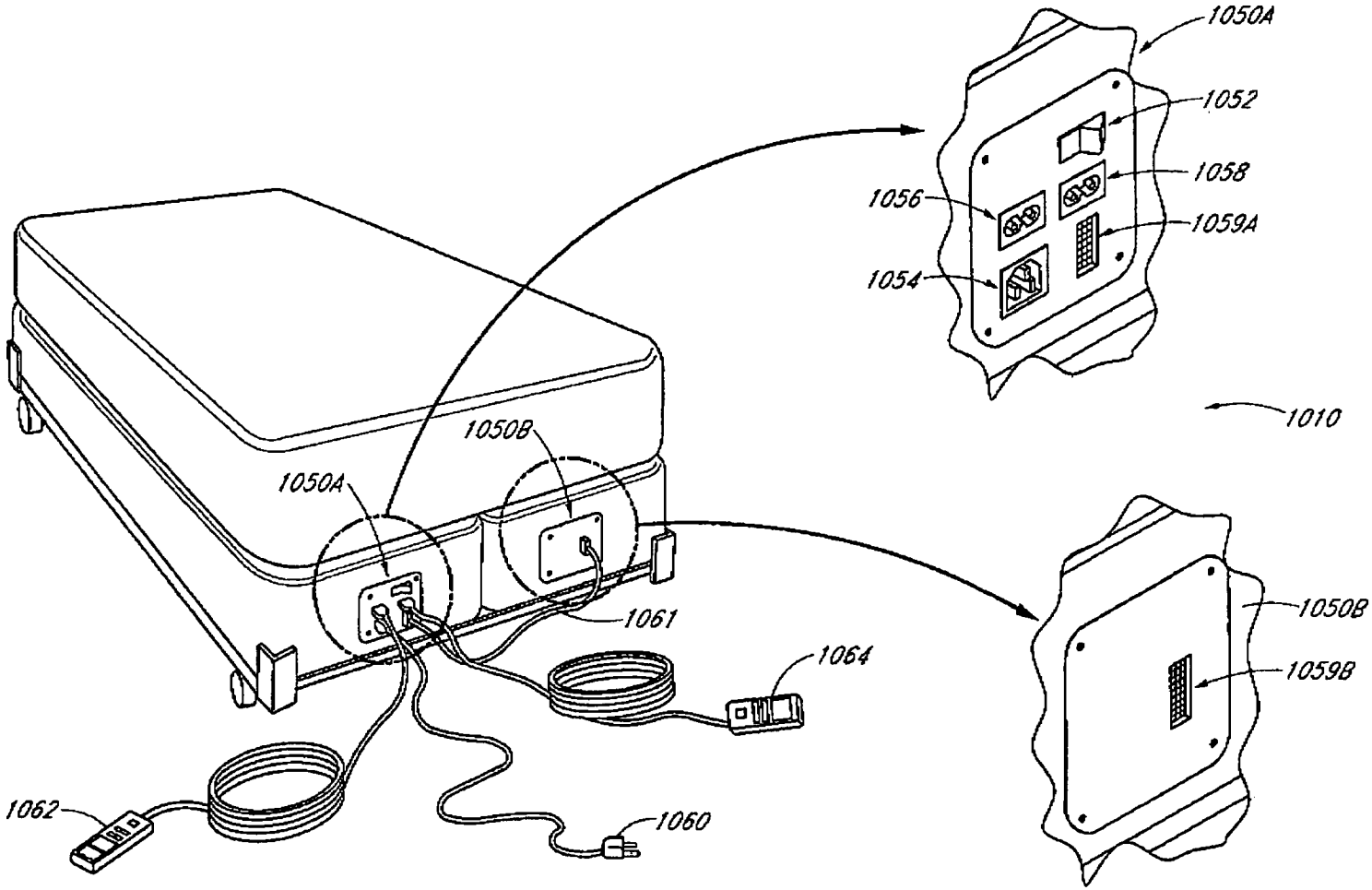
FIG. 8 illustrates a perspective view of a climate controlled bed having control panels along the exterior of its lower portions according to another embodiment.

Another embodiment of a climate control bed 1010 is illustrated in FIG. 8. As with the arrangement of FIG. 7, the depicted bed 1010 includes two separate lower portions and a single upper portion. Each of the lower portions comprises a control panel 1050A, 1050B generally positioned along a side surface. In some embodiments, the panels 1050A, 1050B are different from each other. For example, one of the panels 1050A can include an ON/OFF switch 1052, slots or other connection sites 1054, 1056, 1058 for removably docking one or more power cords 1060, user input devices 1062, 1064 and/or the like. In addition, the control panel 1050A can include a port 1059A or other connection site configured to receive a cable 1061 or other connector that is in power and/or data communication with a corresponding port 1059B on the control panel 1050B of the second lower portion. Accordingly, any fluid modules, controllers and/or any other components positioned within or associated with the second lower portion can be advantageously controlled using a control module (e.g., ECU) or other controller which is part of or is operatively connected to the panel 1050A positioned on the first lower portion. Such a configuration can facilitate the cross-connection of the two control modules, such as those illustrated schematically in FIG. 3C. Accordingly, the overall design of the bed 1010 and its climate control system can be simplified by requiring fewer features or components.

Figure 9:
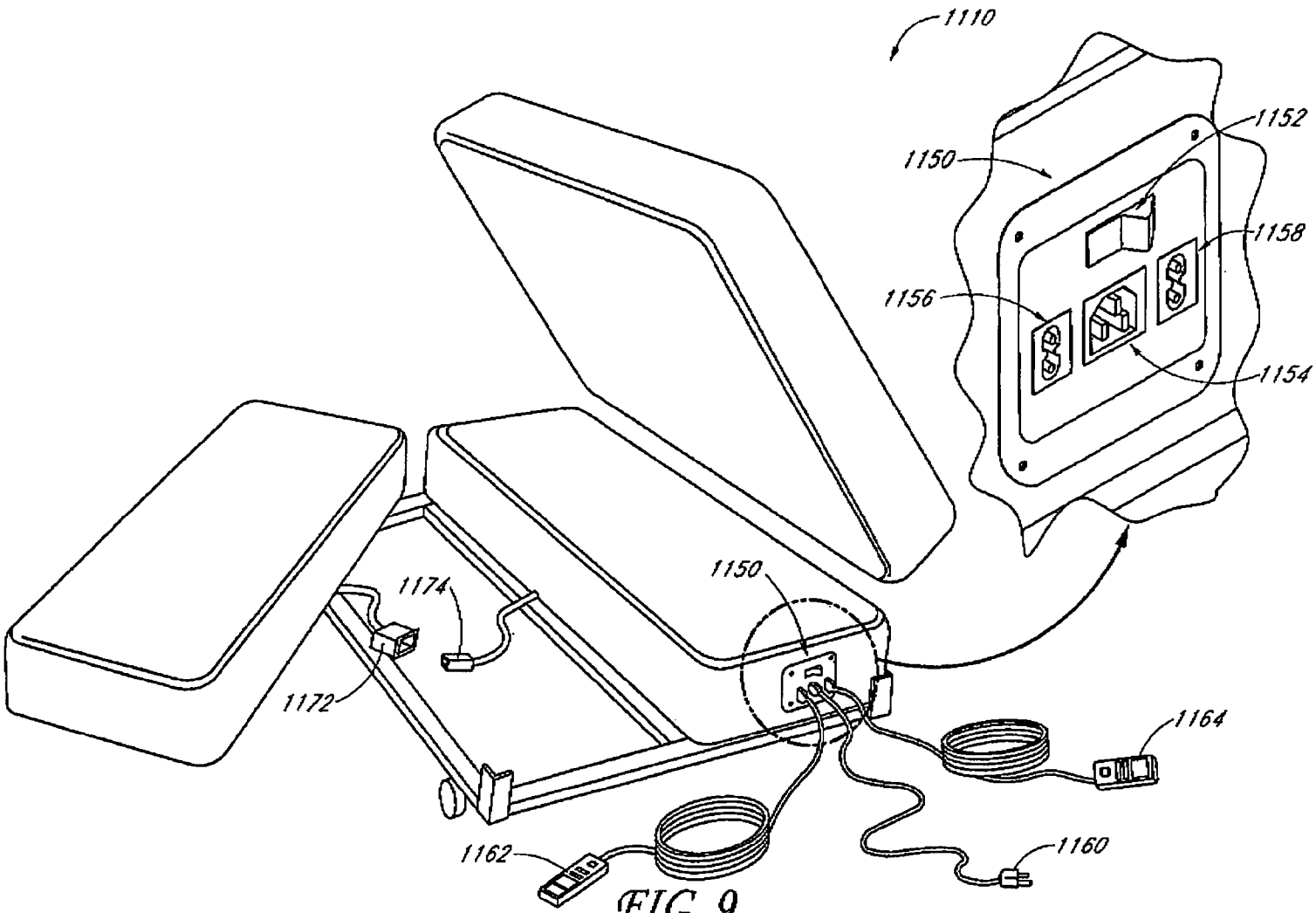
FIG. 9 illustrates a perspective view of a climate controlled bed having a control panel along the exterior of one of its lower portions according to one embodiment.

FIG. 9 illustrates another embodiment of a climate controlled bed assembly 1110 having two separate lower portions and a single upper portion. For simplicity, the various components and other features of the climate control system (e.g., inlets, fittings or passageways within the upper portion and the lower portions, etc.) are not shown. In FIG. 9 only one of the lower portions comprises a control panel 1150. Thus, as shown, the various control modules and other electrical components of the lower portions' climate control systems can be operatively connected using one or more interconnecting cables 1172, 1174. In the depicted arrangement, the interconnecting cables 1172, 1174 are configured to connect to each other along the interior adjacent surfaces of the lower portions, such that the cables 1172, 1174 remain hidden when the bed 1110 has been assembled. In other arrangements, however, the interconnecting cables 1172, 1174 or other devices can be positioned at any location of the lower portions and/or another area of the bed 1110.

Figure 10:
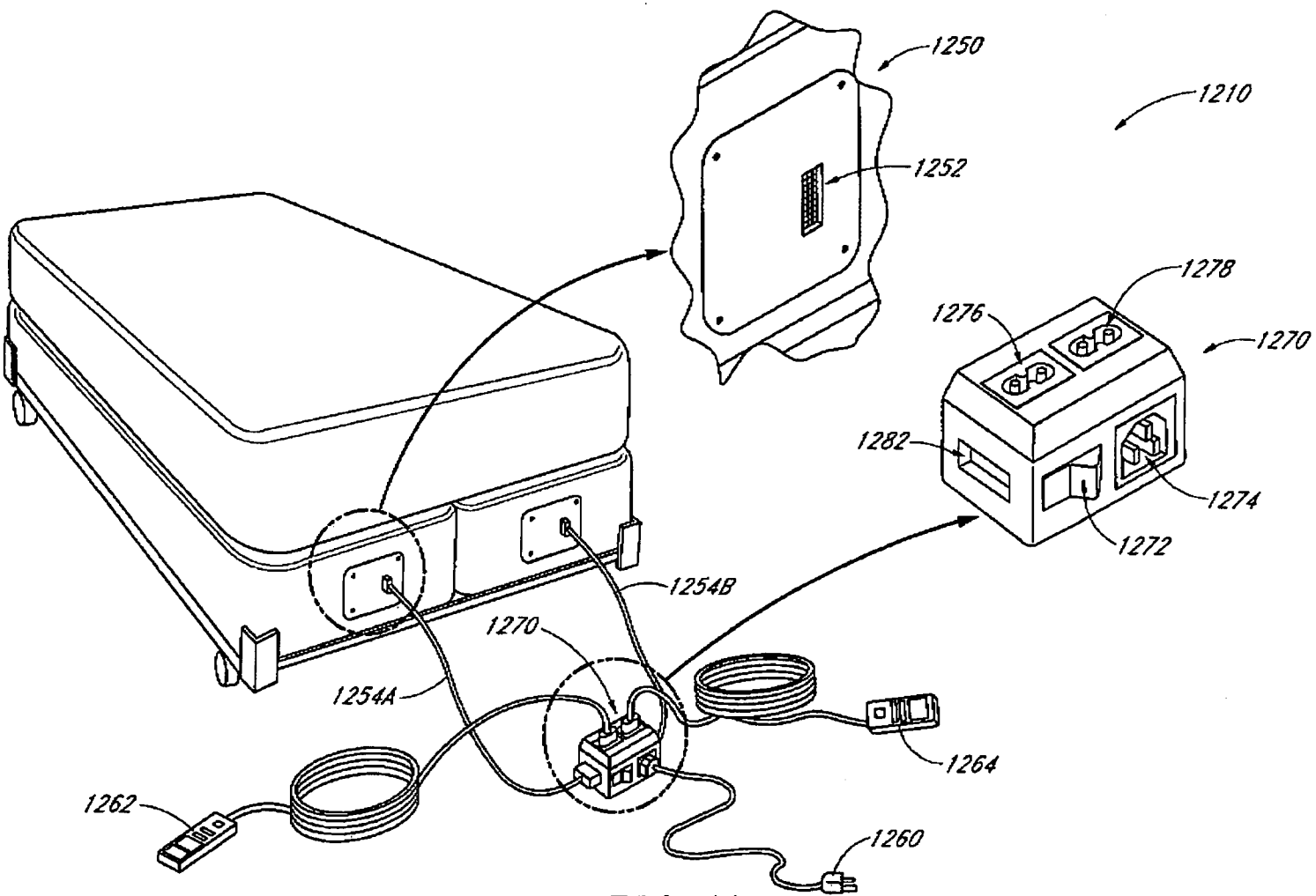
FIG. 10 illustrates a perspective view of a climate controlled bed having an external control module operatively connected to control panels positioned along the exterior of its lower portions according to one embodiment.

Another arrangement of a climate controlled bed assembly 1210 is illustrated in FIG. 10. As shown, each of the lower portions includes a control panel 1250A, 1250B which may comprise a portion of or may be operatively connected to a control module (e.g., ECU) and/or any other component of the bed's climate control system. In some embodiments, each control panel 1250A, 1250B comprises a single port 1252 or other connection site configured to receive a cable. However, a control panel can include one or more additional ports or other connection sites, as desired or required. Interconnecting cables 1254A, 1254B that are connected to ports 1252 of the control panels 1250A, 1250B can be fed into an external control module 1270.

With continued reference to FIG. 10, the external control module 1270 can include ports 1282 that are adapted to receive the interconnecting cables 1254A, 1254B. In addition, the external control module 1270 can include one or more switches or other control devices (e.g., an ON/OFF switch 1272), other ports or connection sites (e.g., power cord ports 1274, user input device ports 1276, 1278, etc.) and/or the like. In addition, the external control module 1270 can include a power supply or can be operatively connected to a power supply that selectively supplies electrical power to the various electrical components (e.g., fluid modules, control units, etc.) of the bed assembly 1210. In addition, the external control module 1270 can provide a single device through which such components may be operatively controlled. In some embodiments, the external control module 1270 can be configured to be placed underneath the bed assembly 1210 or at another discrete location when the bed 1210 is in use.

FIGS. 11A through 15 illustrate various embodiments of enclosures configured to receive a control module, control panel, power supply and/or any other component or portion of a climate control system for a bed assembly. The depicted enclosures are generally positioned along the lower portions of the respective bed assemblies. However, such enclosures can be positioned within or near another part of the bed.

Figure 11B:
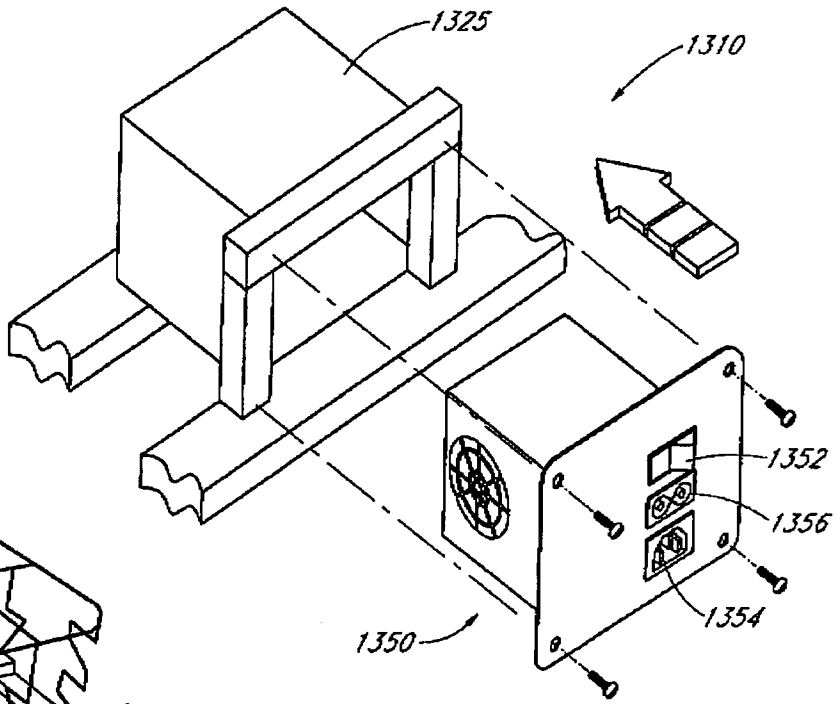
FIGS. 11A and 11B illustrate perspective views of one embodiment of an enclosure positioned within a lower portion of a climate controlled bed assembly and configured to receive a control panel.
Figure 11A:
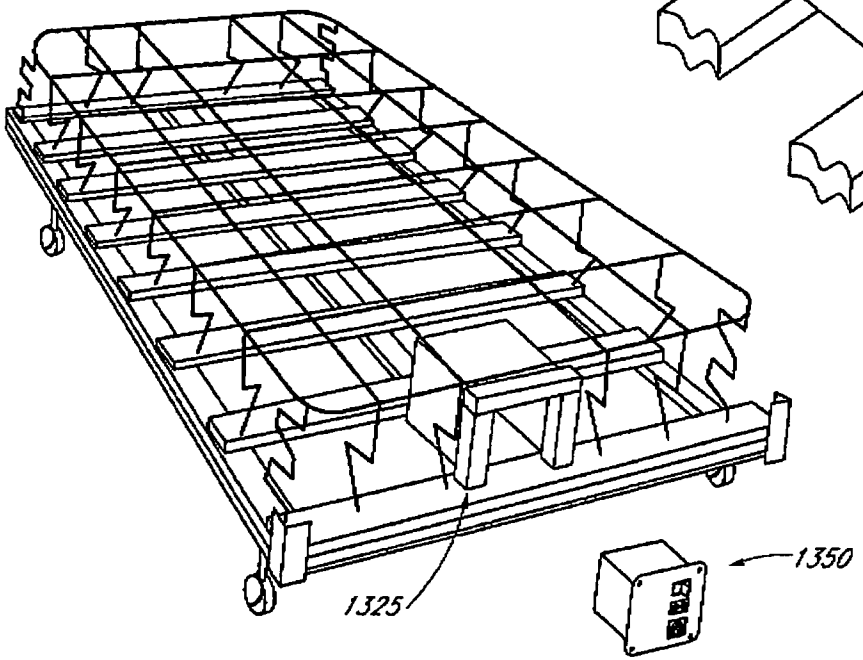

With reference to FIGS. 11A-11C, the bed 1310 comprises an enclosure 1325 that generally abuts an exterior surface (e.g., rear, front, side, etc.) of the lower portion 1320 when secured therein. As shown, the various structural and other components of the enclosure 1325 can be sized, shaped and otherwise configured to receive a control panel 1350, a control module and/or any other portion of the climate control system. The enclosure 1325 can be secured to one or more regions of the lower portion 1320 (e.g., a frame member, the frame structure, etc.). In addition, the control panel 1350 can be attached to the enclosure using one or more screws, other fasteners and/or the like.

Figures 12A, 12B, 12C:
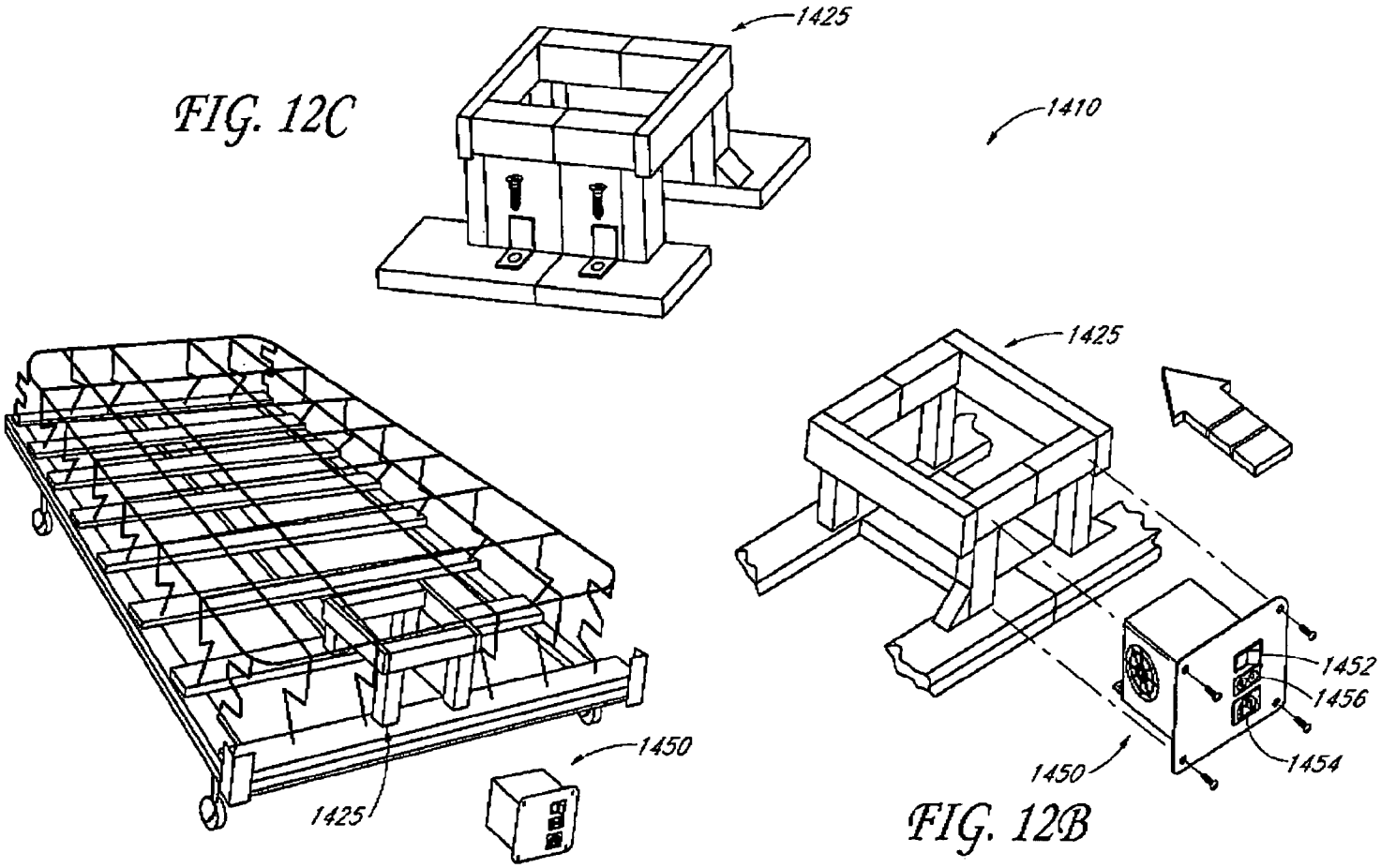
FIGS. 12A-12C illustrate perspective views of another embodiment of an enclosure positioned within a lower portion of a climate controlled bed assembly and configured to receive a control panel.

As illustrated in FIGS. 12A-12C, an enclosure 1425 can include more or fewer structural or non-structural members. In addition, the enclosure 1425 can comprise different types of fasteners (e.g., screws, tabs, etc.) and/or other members, as desired or required. In some embodiments, the enclosure includes rigid, semi-rigid and/or non-rigid (e.g., flexible) members that comprise wood, metal (e.g., steel), composites, thermoplastics, other synthetic materials, fabrics and/or the like.

Figure 13B:
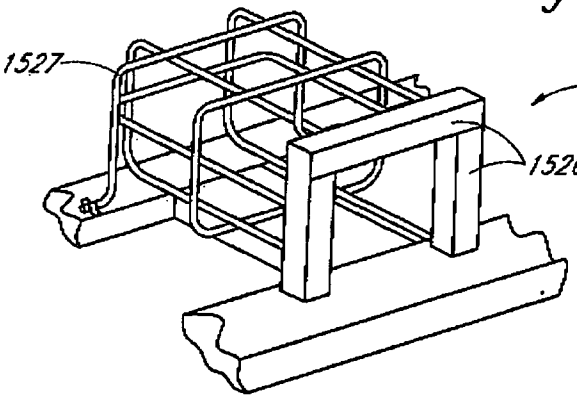
FIGS. 13A-13C illustrate perspective views of yet another embodiment of an enclosure positioned within a lower portion of a climate controlled bed assembly and configured to receive a control panel.
Figure 13C:
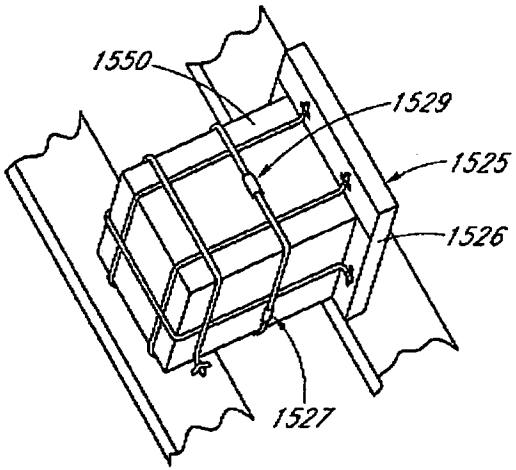
Figure 13A:
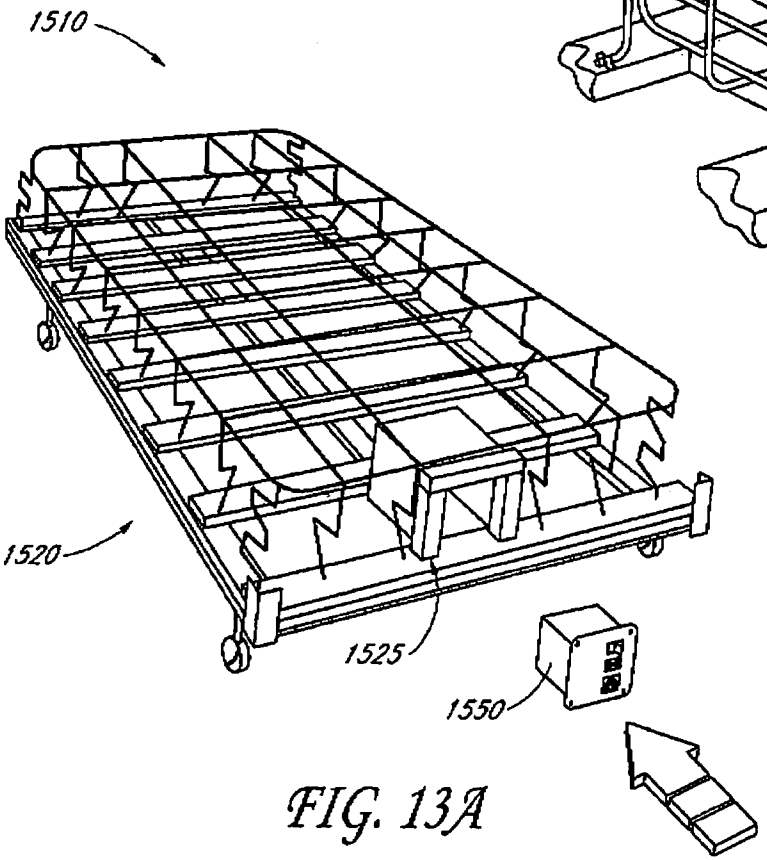
Figure 14B:
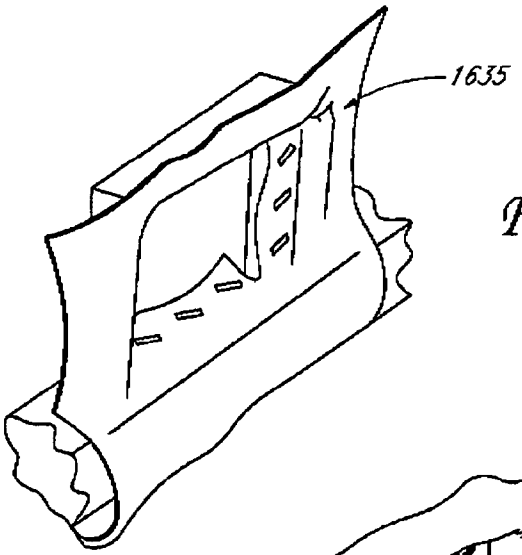
FIGS. 14A-14D illustrate perspective views of an enclosure configured to receive a control panel according to one embodiment.
Figure 14D:
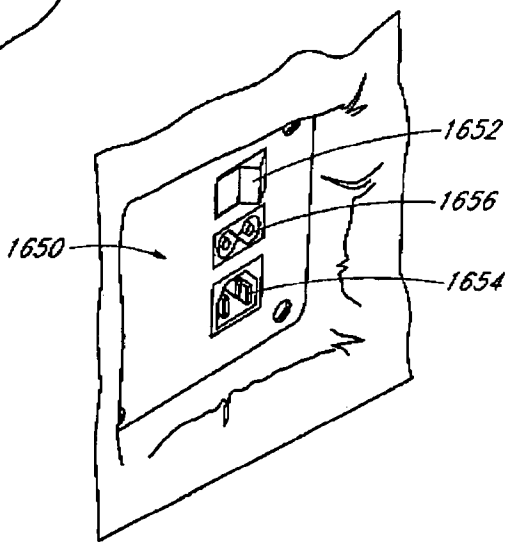
Figure 14A:
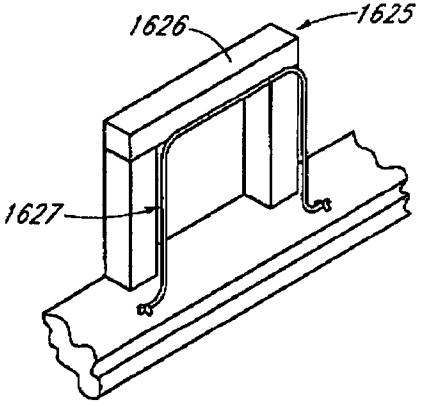
Figure 14C:
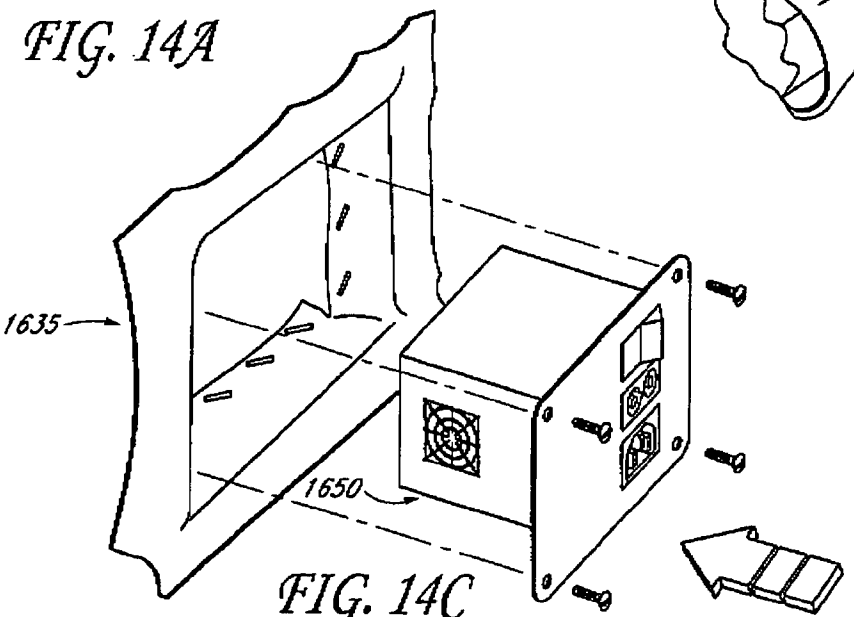
Figure 15:
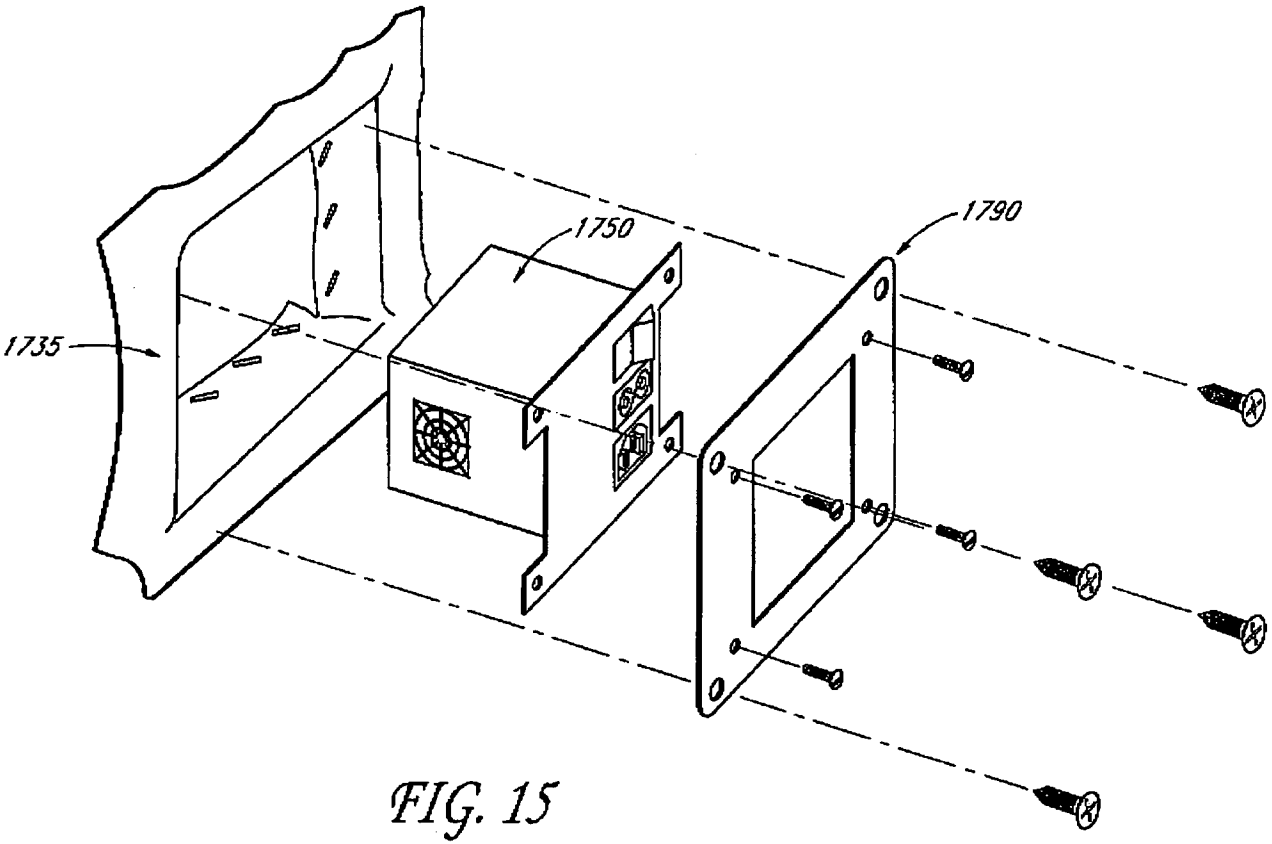
FIG. 15 illustrates a perspective view of an enclosure configured to receive a control panel according to another embodiment.

In the embodiment depicted in FIGS. 13A-13C, the enclosure 1525 includes a frame 1526 generally positioned along an exterior of the lower portion 1520 of the bed assembly 1510. The frame 1526 can be attached to the lower portion 1520 using one or more connection methods or devices. As shown, the enclosure 1525 can further include a cage 1527 or the like. With reference to FIG. 13C, the cage 1527 can be attached to both the frame 1526 and one or more areas of the lower portion 1520 of the bed 1510. Once positioned within an interior of the enclosure 1525, the control panel 1550 or other portion of the control module can be attached to the frame 1526 and/or the cage 1527 of the enclosure 1525 using one or more tabs 1529, other fasteners, welds and/or any other connection device or method.

In some embodiments, as illustrated in FIGS. 14A-14D, a control panel 1625 or other portion of the control module can be secured to a lower portion 1620 or other portion of a bed using a simpler design. For example, the enclosure 1625 depicted in FIG. 14A includes a smaller frame 1626 and a reinforcing structure 1627 adjacent to the frame 1626. Thus, an enclosure may not extend very far, if at all, into an interior of a lower portion 1620 or other portion of a climate controlled bed assembly. In the illustrated arrangement, a fabric 1635 or one or more other protective films or layers can be positioned between the enclosure 1625 and the exterior of the lower portion 1620. Thus, such a fabric 1635 can hide the enclosure 1625 and serve as an interface between the enclosure 1625 and the control panel 1650 that is secure thereto.

One or more additional members or devices can be used to secure a control panel or other portion of a control module within an enclosure or other area of the bed assembly. For example, with reference to FIG. 15, a faceplate 1790 can be positioned along the outside of the control panel 1750. In some embodiments, such a faceplate 1790 or other member can help secure the control panel 1750 or other portion of the control module to the corresponding enclosure. In any of the embodiments of the climate controlled bed assemblies disclosed herein, the control panels can be configured to be selectively removable from the corresponding enclosure or other area of the bed. This can facilitate the manufacture, assembly, transport, maintenance, repair and/or any other activities associated with providing and operating a climate controlled bed.

In addition, in embodiments that include control panels with switches, user input devices or other control devices, ports and/or the like, such as, for example, those illustrated and discussed herein, users can conveniently configure a climate controlled bed assembly for use in just a few steps. For example, before the climate control features of such a bed assembly can be activated, a user may need to connect a power cable, a user input device (e.g., remote control device), an interconnecting cable and/or any other device to one or more control panels (e.g., along a lower portion of the bed). In some embodiments, the user may also need to select a desired setting or mode of operation using an ON/OFF switch and/or any other control device. As discussed, in any of the embodiments illustrated in FIGS. 6-15, a control panel may be a part of a control module or may by operatively connected to it.

Figure 16:
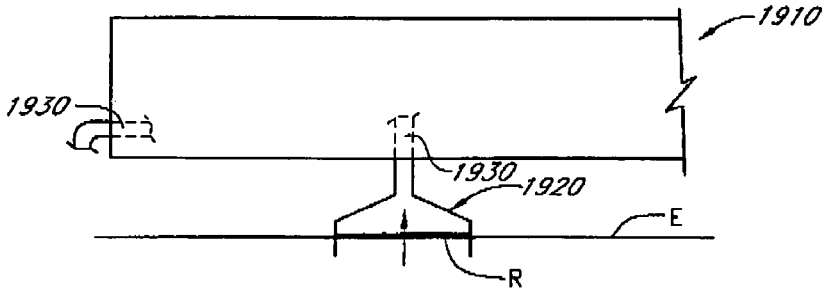
FIG. 16 schematically illustrates a side view of a climate controlled bed assembly in fluid communication with a home HVAC system according to one embodiment.
Figure 17:
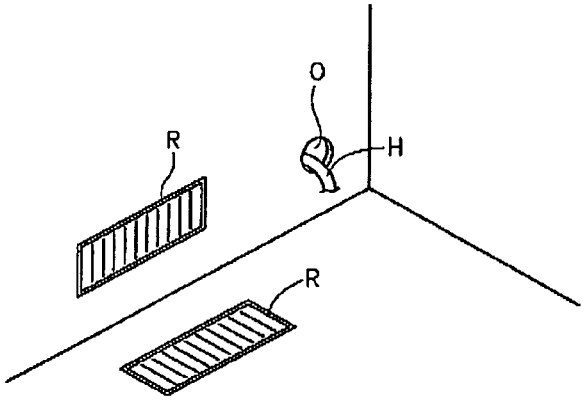
FIG. 17 illustrates a perspective view of registers or other outlets to a home HVAC system according to one embodiment.

As illustrated in FIGS. 16-19B, a climate-conditioned bed assembly can be placed in fluid communication with the HVAC system of a home or other facility (e.g., hotel, hospital, school, airplane, etc.). With reference to FIGS. 16 and 17, one or more passageways 1930 or other inlets of a bed assembly 1910 can be placed in fluid communication with a register R or other outlet of a main HVAC system (e.g., central air) or other climate control system, using an interconnecting duct 1920 or other conduit. Such an interconnecting duct 1920 can be configured to secure to (or replace) a standard register R, a non-standard register, other outlet and/or the like. In other embodiments, the interconnecting duct 1920 is flexible or substantially flexible to facilitate the connection to the register R and/or to accommodate movement of the bed 1910 relative to the floor or walls.

With continued reference to FIG. 16, an interconnecting duct 1920 can be connected to a passageway 1930 (or other internal or external conduit) along the bottom, side and/or any other portion of the bed assembly 1910. Such a duct 1920 can be connected to passageways 1930 of the bed assembly that are in fluid communication with one or more of climate zones, as desired or required. As shown in FIG. 17, a register R or other outlet of the HVAC system can be positioned along the floor, wall or any other area of a room. Alternatively, a bed assembly can be placed in fluid communication with a hose H or other conduit that receives conditioned air from a main HVAC system or other climate control system. In the arrangement illustrated in FIG. 17, such a hose H can be routed through an opening 0 of the wall. However, in other embodiments, the hose H or other conduit can be accessed through an opening positioned along the floor, ceiling or any other location. In some arrangements, a home or other facility can be built or retrofitted with such HVAC connections and other components (e.g., hoses, other conduits, openings, etc.) in mind.

Figure 18:
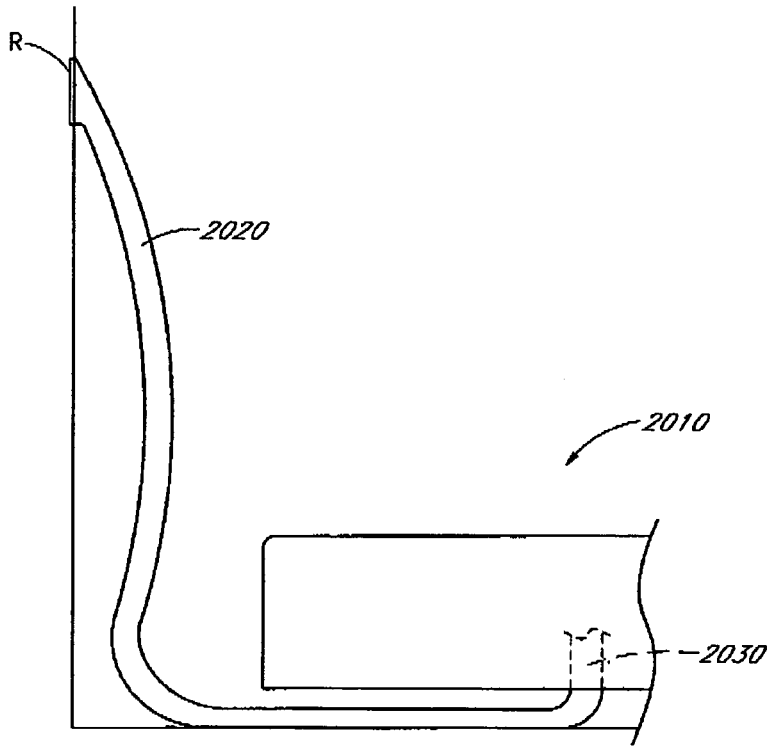
FIG. 18 schematically illustrates a side view of a climate controlled bed assembly in fluid communication with a home HVAC system according to another embodiment.

FIG. 18 illustrates another embodiment of a climate controlled bed assembly 2010 which is in fluid communication with a home's or other facility's HVAC system using an interconnecting duct 2020. As shown, the interconnecting duct 2020 can be connected to a register R that is positioned along an adjacent wall. In some embodiments, the interconnecting duct 2020 can comprise a tube or other conduit that can be easily flexed or otherwise manipulated to complete the necessary connections between the register R and the passageways 2030 of the bed 2010. For example, the interconnecting duct 2020 can comprise plastic, rubber and/or any other flexible materials. In other embodiments, the interconnecting duct 2020 comprises bellows, corrugations and/or other features that provide it with the desired flexible properties.

Figure 19A:
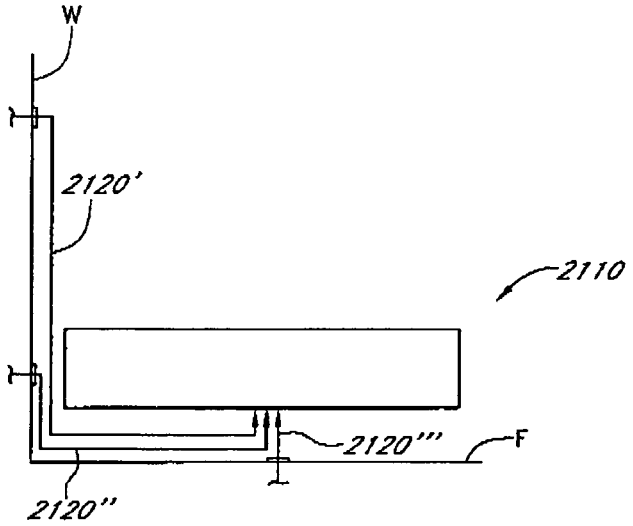
FIG. 19A schematically illustrates a climate controlled bed assembly in fluid communication with a home HVAC system according to one embodiment.

Placing one or more climate zones of a bed assembly in fluid communication with a HVAC system or other climate control system can offer certain advantages, regardless of the manner in which such a connection is accomplished. For example, under such systems, the need for separate fluid modules as part of the bed assembly can be eliminated. Thus, heated, cooled, dehumidified and/or otherwise conditioned air can be delivered directly to the bed assembly. Consequently, a less complicated and more cost-effective bed assembly can be advantageously provided. Further, the need for electrical components can be eliminated. One embodiment of such a bed assembly 2110 is schematically illustrated in FIG. 19A. As shown, one or more interconnecting ducts 2120', 2120", 2120' can be used to place the bed 2110 in fluid communication with a main HVAC system. As discussed, the ducts can be secured to registers, outlets, hoses and/or other conduits positioned along a wall W and/or the floor F of a particular room.

Figure 19B:
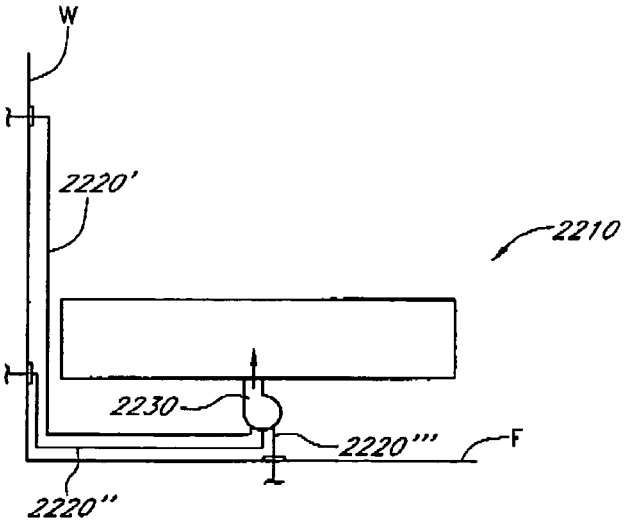
FIG. 19B schematically illustrates a climate controlled bed assembly in fluid communication with a home HVAC system according to another embodiment.

In other embodiments, conditioned air can be provided from a home's or other facility's HVAC system into the inlet of one or more fluid modules of the bed assembly. This can result in a more energy efficient and cost effective system, as the amount of thermal conditioning (e.g., heating, cooling, etc.) required by the fluid modules or other components of the bed assembly may be reduced. FIG. 19B schematically illustrates one embodiment of such a climate controlled bed assembly 2210. As shown, one or more interconnecting ducts 2220', 2220", 2220"' can be used to direct air from a main HVAC system to one or more fluid modules. In some embodiments, as discussed in greater detail herein, the fluid modules are positioned within a lower portion of a bed assembly. Thus, the interconnecting ducts can deliver conditioned air into the interior of such a lower portion. In other arrangements, however, conditioned air is delivered directly into the inlet of one or more fluid modules.

Figure 20A:
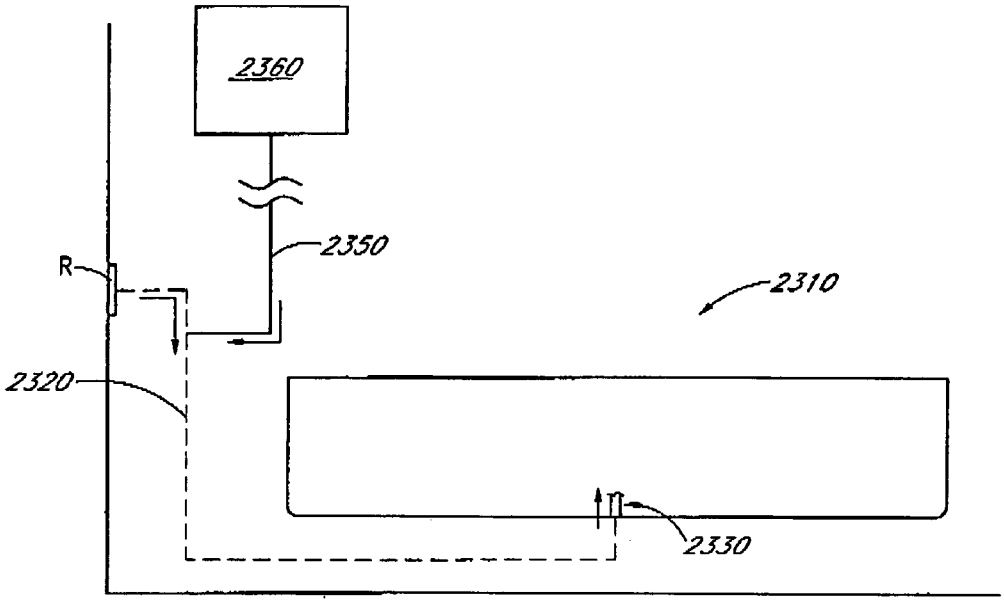
FIG. 20A schematically illustrates a climate controlled bed assembly in fluid communication with a home HVAC system and a separate fluid source according to one embodiment.

As schematically illustrated in FIG. 20A, an interconnecting duct 2320 can be configured to receive one or more additional fluid sources 2360. Consequently, the air being transferred from a register R or other outlet of a central HVAC system can be selectively combined with an external source 2360 of fluids and/or other substances, as desired or required. This additional fluid and/or other substance being delivered to the bed 2310 can provide certain benefits. For example, in some embodiments, one or more medications are selectively combined with HVAC air and delivered to a fluid distribution system of the bed 2310 (e.g., inlet, internal passageways 2330, etc.). Any type of pharmaceuticals (e.g., prescription, over-the-counter), homeopathic materials, other therapeutic substances and/or other medicaments can be delivered to the bed 2310, including, but not limited to, asthma medications, anti-fungal or anti-bacterial medications, high-oxygen content air, sleep medication and/or the like. In embodiments where the bed includes a medical bed, wheelchair or other seating assembly located within a hospital or other medical facility, physicians, nurses or other medical professionals can oversee the administration of one or more medications and other substances for therapeutic, pain-relief or any other purpose.

In other embodiments, the bed is adapted to receive other types of fluids or substances from the fluid source 2360, either in addition to or in lieu of HVAC air and/or medicaments. For example, insect repellent (e.g., citronella, Deet, etc.) can be provided to a bed situated in an environment in which bugs present health risks or a general nuisance. In certain arrangements, fragrances and/or other cosmetic substances are delivered to the bed to help create a desired sleeping or comfort environment. Any other liquid, gas, fluid and/or substance can be selectively provided to a climate control bed, as desired or required.

With continued reference to FIG. 20A, delivery conduit 2350 can be used to place the fluid source 2360 in fluid communication with the interconnecting duct 2320. In the illustrated embodiment, the fluid source 2360 and the delivery conduit 2350 are positioned at a location exterior to the bed assembly 2310. Alternatively, the fluid source 2360 and/or the delivery conduit 2350 can be positioned at least partially within one or more portions of the bed 2310 or other seating assembly. For example, the fluid source 2360 and/or the accompanying delivery conduit 2350 can be positioned within or on a side of the bed 2310 (e.g., mattress or other upper portion, box spring or other lower portion, etc.). Thus, the fluid source 2360 and/or the accompanying delivery conduit 2350 can be configured to not tap or otherwise connect into a HVAC interconnecting duct. In some embodiments, such as the one illustrated in FIG. 20C, a fluid source 2360' is configured to be placed within a dedicated compartment 2362', so that it is generally hidden from view. Additional details regarding such an arrangement are provided below.

According to some arrangements, a fluid transfer device (e.g., pump) is used to transfer a desired volume of a fluid from the fluid source 2360 to the conduit 2350 and/or other hydraulic components (e.g., interconnecting duct 2320, fluid distribution system of a bed or other seating assembly, etc.). Alternatively, the fluids and/or other materials contained within a fluid source 2360 can be delivered to the bed or other seating assembly using one or more other devices or methods, such as, for example, an ejector (or other Bernoulli-type device), gravity or the like.

Figure 20B:
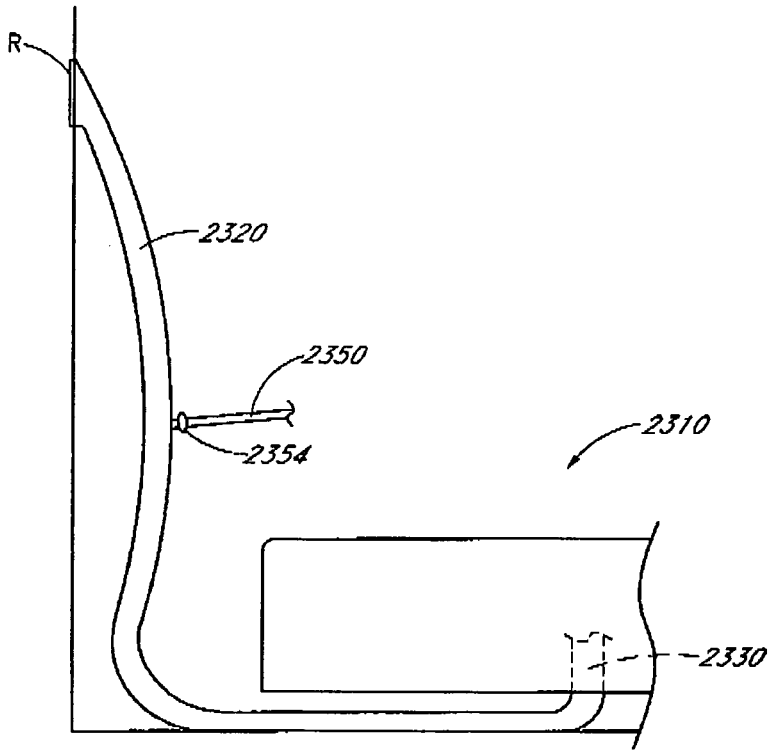
FIG. 20B schematically illustrates a climate controlled bed assembly in fluid communication with a home HVAC system and a separate fluid source according to another embodiment.

As discussed herein and illustrated in the arrangement of FIG. 20B, a delivery conduit 2350 can be used to place a fluid source in fluid communication with an interconnecting duct 2320. In depicted embodiment, the interconnecting duct 2320 is configured to convey air from a register R or other outlet of a main HVAC system to an inlet passageway 2330 of a climate controlled seating assembly 2310 (e.g., a bed, a seat, a wheelchair, etc.). In some arrangements, a coupling 2354 (e.g., quick-connect, other type of coupling, etc.) is located at or near the connection point between the delivery conduit 2350 and the interconnecting duct 2320. Such a coupling or other device can facilitate the manner in which the delivery conduit 2350 is connected to or detached from the interconnecting duct 2320. Thus, in some embodiments, the delivery conduit 2350 can be placed in fluid communication with the fluid distribution system of a bed or other seating assembly (e.g., via an interconnecting duct 2320) only when the addition of a medicament or medicant and/or any other substance of a fluid source 2360 are desired or required. Further, the system can include one or more check valves, other flow-control or flow-regulating devices and/or other hydraulic components to ensure that fluids are not inadvertently routed in undesirable directions through the various conduits and other components of the system.

Figure 20C:
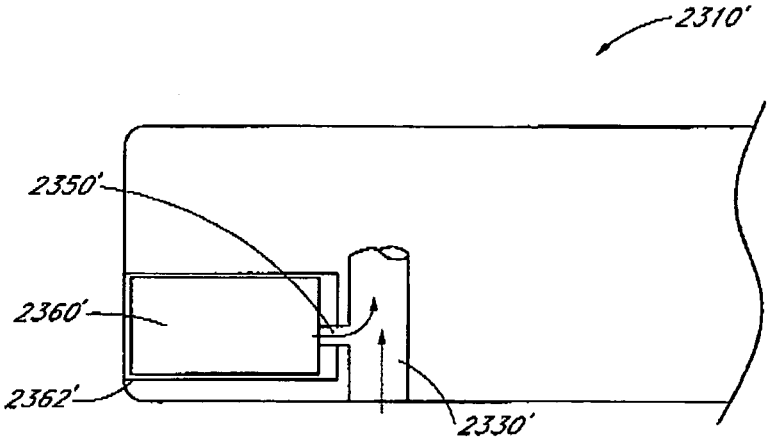
FIG. 20C schematically illustrates a climate controlled bed assembly in fluid communication with a separate fluid source according to one embodiment.

FIG. 20C schematically illustrates one embodiment of a fluid source 2360' contained within an internal compartment 2362', cavity or other interior portion of a bed 2310' or other seating assembly. As shown, the fluid source 2360' can be placed in fluid communication with a fluid distribution system 2330' (e.g., channel, conduit, passageway, etc.) of the bed using a delivery conduit 2350'. As discussed herein with reference to other embodiments, the medications, other fluids and/or any other substance contained within the fluid source 2360' can be selectively transferred to the fluid distribution system 2330' of the bed assembly using a fluid transfer device (e.g., a pump), an ejector or other Bernoulli-type mechanism, gravity and/or any other device or method. Further, the bed assembly 2310' can comprise one or more valves and/or other flow-regulating devices or features to help ensure that fluids and other materials are delivered to the distribution system 2330' of the bed in accordance with a desired or required manner.

Figure 21:
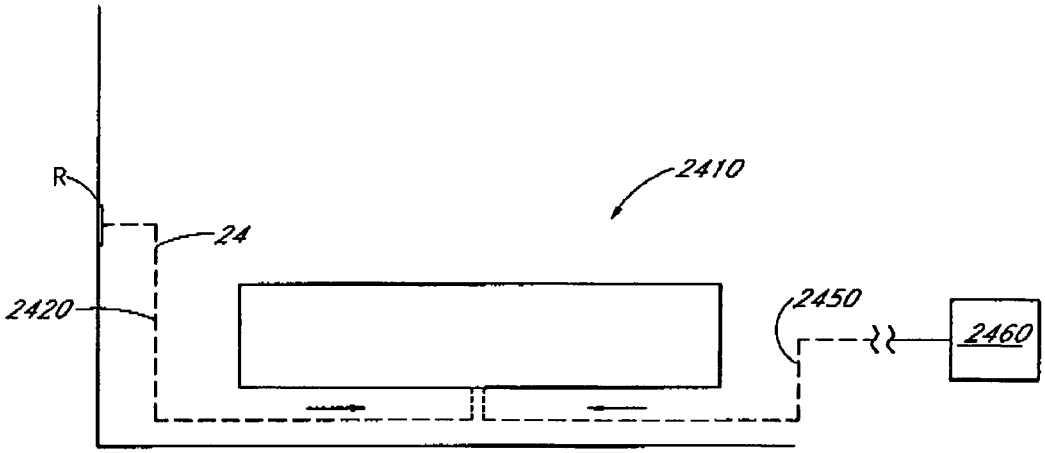
FIG. 21 schematically illustrates a climate controlled bed assembly in fluid communication with a home HVAC system and a separate fluid source according to another embodiment.

As discussed above, a separate fluid source does not need to be connected to a HVAC system configured to provide environmentally-conditioned air (e.g., heated or cooled air, ambient air, humidity-modified air, etc.) to a seating assembly. For example, as illustrated in FIG. 21, a bed assembly 2410 can include separate conduits 2420, 2450 that are configured to place a register R or other outlet of a HVAC system and a separate fluid source 2460 in fluid communication with the assembly. Further, in any of the embodiments disclosed herein, a bed or other climate controlled seating assembly can be configured to receive medications and/or other materials from a separate fluid source 2460 without being adapted to receive air from a HVAC system.

In any of the various embodiments disclosed herein, or variations thereof, a fluid source can include a container (e.g., a tank, reservoir, bottle, vial, ampoule, gel-pack, etc.) that is otherwise configured to be used with a climate controlled seating assembly. For example, such a container can be sized and shaped to fit within the internal compartment 2362' of the assembly illustrated in FIG. 20C. Further, such containers can be adapted to be quickly and easily installed, removed and/or replaced by users, thereby permitting users to change the medication, insect repellent, fragrance and/or any other substance being delivered to and through the seating assembly (e.g., bed).

In some arrangements, information regarding the temperature, flowrate, humidity level and/or other characteristics or properties of conditioned air being conveyed in a HVAC system can be detected and transmitted (e.g., using hardwired or wireless connections) to a control module (e.g., ECU) of the bed's climate control system. Accordingly, the bed's climate control system can adjust one or more devices or settings to achieve a desired cooling and/or heating effect one or more bed occupants. The interconnecting ducts can include one or more valves (e.g. modulating valves, bleed valves, bypass valves, etc.) or other devices to selectively limit the volume of air being delivered to the bed assembly. For example, the entire stream of pre-conditioned air may need to be diverted away from the climate controlled bed assembly in order to achieve a desired cooling or heating condition along the top surface of the bed. Any of the embodiments of a climate controlled bed assembly disclosed herein, or equivalents thereof, can be placed in fluid communication with a main HVAC system.

According to certain embodiments, the various control modules of the bed's climate control system are configured to receive information (e.g., temperature, flowrate, humidity, etc.) regarding the air being delivered from a main HVAC system to one or more climate zones of the bed assembly. As a result, the climate module can use this information to achieve the desired cooling, heating and/or ventilation effect for each climate zone, either with or without the assistance from the various fluid modules. In some arrangements, the air being delivered to the bed's climate control system can be regulated (e.g., by dampers, valves, bleed-offs, modulators, etc.) in order to achieve the desired thermal conditioning along one or more portions of the bed assembly.

In some arrangements, data or information related to the temperature and/or humidity of the room in which the bed assembly is transmitted to the bed's climate control system. In one embodiment, such data can be provided to the user via a user input device and/or any other component or device. In alternative arrangements, information regarding a bed's climate zone(s), the operation of the fluid modules and/or any other operational aspect of the bed can be transmitted and/or displayed by a controller (e.g., thermostat) of the home's main HVAC system. Accordingly, one or more environmentally conditioned bed assemblies can be advantageously controlled using a home's thermostat or other controller. Similarly, one or more user input devices can be used to adjust or otherwise control the operation of the home's main HVAC system.

According to some embodiments, a climate control bed or other seating assembly can constitute merely one component of a larger zonal cooling system. As discussed herein, a bed can be placed in fluid and/or data communication with one or more HVAC systems (e.g., central heating and cooling unit, furnace, other thermal conditioning device, etc.) or other thermal conditioning devices or systems of a home or other facility (e.g., hospital, clinic, convalescent home or other medical facility, a hotel, etc.). As a result, the climate control system of the bed or other seating assembly located within a particular room or area can be operatively connected to the control system of one or more other climate control systems (e.g., main HVAC system). Thus, such configurations can be used to operate the climate controlled bed (or other seating assembly, e.g., medical bed, wheelchair, sofa, other chair, etc.) and a building's other climate control system in a manner that helps achieve one or more objectives. For example, under an energy efficiency mode, when a climate controlled bed is in operation, the level of cooling, heating or ventilation occurring within the corresponding room or area of a building can be advantageously reduced or eliminated. In such an embodiment, the bed or other seating assembly can be viewed as a smaller climate control zone within a larger climate control zone (e.g., the room).

Alternatively, when the bed is not being used, the home's or other facility's HVAC control system can be configured to operate in a manner that achieves a desired comfort level (e.g., temperature, humidity, etc.) within the entire room or area in which the seating assembly is positioned.

In other arrangements, a room (or other defined or undefined area) is operated so as to achieve a first conditioning effect (e.g., cooling, heating, ventilation, etc.) within the entire room and a second conditioning effect specific only to a bed or other seating assembly positioned within that room. Thus, depending on the control algorithm being used, a main HVAC system may or may not be operating at the same time as a climate control system for a bed (or other seating assembly). In certain embodiments, however, regardless of the exact operational scheme being utilized, the climate control system of a seating assembly is operatively connected to and working in cooperation with the control system of a home's or other facility's HVAC system (e.g., central air, furnace, etc.).

Figure 22:
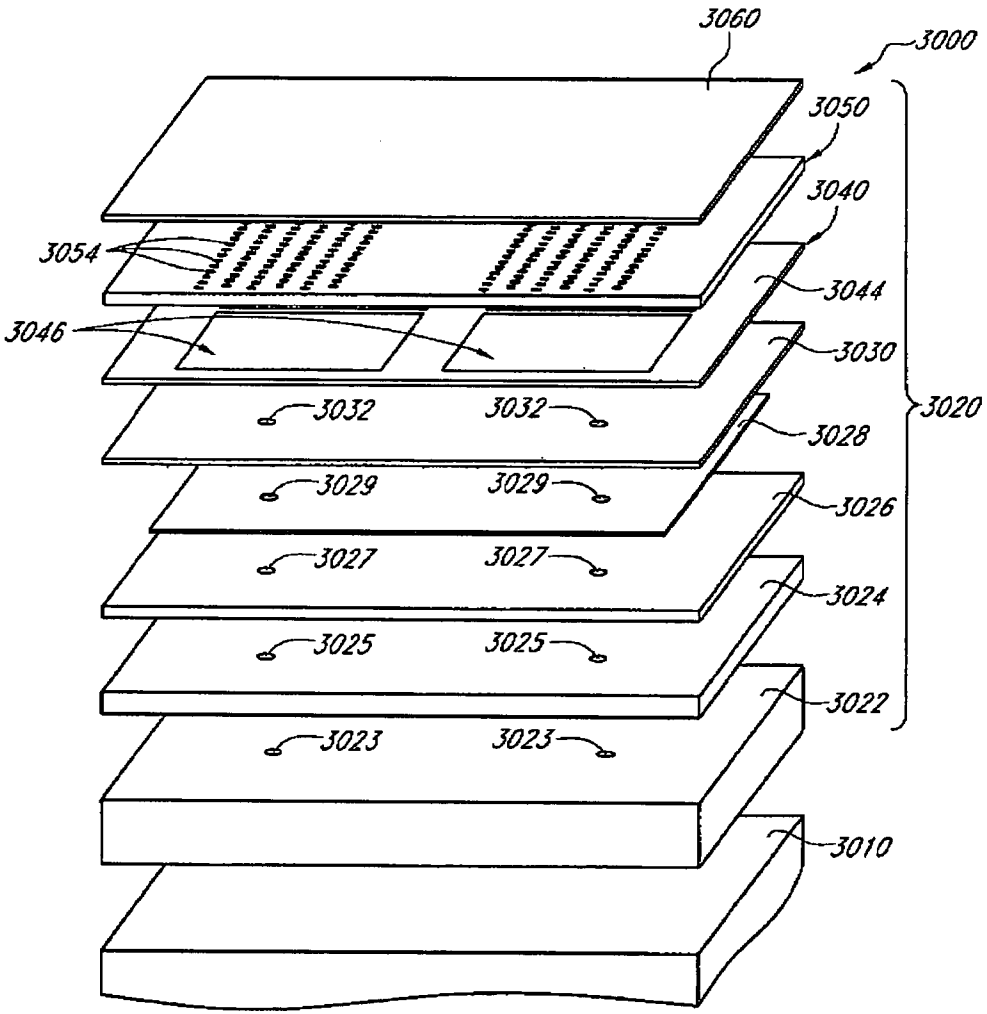
FIG. 22 illustrates an exploded perspective view of a climate controlled bed assembly according to one embodiment.

FIG. 22 illustrates one embodiment of a climate controlled bed assembly 3000. As shown, the bed assembly 3000 can include a foundation 3010 or other lower portion that is configured to receive an upper portion 3020 (e.g., a mattress comprising one or more fluid passages). In some arrangements, the foundation 3010 comprises a generally open interior space into which one or more fluid modules (e.g., blowers or other fluid transfer device, thermoelectric devices, etc.) can be at least partially housed. In FIG. 22, the various layers and/or components that comprise the upper portion 3020 are depicted in exploded view. In order to form the upper portion 3020 or occupant support member of the climate controlled bed 3000, such layers and/or components are coupled to each other using one or more attachment substances, devices or methods, such as, for example, glue or other adhesives, stitching, hot melting, enclosures, fasteners and/or the like.

With continued reference to FIG. 22, the plurality of vertically-stacked layers and/or components can be selected to provide the upper portion 3020 with the desired climate control capabilities and the desired level of comfort (e.g., firmness). As shown in FIG. 22, in some embodiments, the upper portion 3020 comprises a core layer 3022 that generally forms the bottom of the upper portion 3020 and that is configured to be positioned immediately adjacent the foundation or other base 3010. The core 3022, as well as adjacent layers 3024, 3026, can include one or more other types of foam or other materials. The use of different foams or other materials can permit a bed 3000 to be manufactured with certain target properties (e.g., rigidity, flexibility, comfort, resiliency, etc.). For example, the core and/or adjacent layers 3022, 3024 of the upper portion 3000 can comprise open-cell foam, closed-cell foam, high performance foam, memory foam, other types of foam, filler materials, other natural or synthetic materials and/or the like. In other embodiments, the lower layers of a mattress or upper portion 3020 comprise air chambers, spring coils and/or any other types of components or features, as desired or required.

With specific reference to the embodiment of FIG. 22, the lower core layer 3022 is approximately 7 inches tall and comprises relatively rigid foam (e.g., to provide adequate support to the upper portion 3020). As shown, above the lower core layer 3022 are a transition layer 3024 and a comfort layer 3026. In some embodiments, the height (or thickness) of the transition and comfort layers 3024, 3026 is approximately 2 inches and 1 inch, respectively. In one arrangement, the comfort layer 3026 is generally softer and more compressible than the lower core layer 3022. Further, the softness, rigidity and other physical characteristics of the transition layer 3024 can be generally between those of the adjacent lower core and comfort layers 3022, 3026. In other embodiments, however, the dimension, shape, materials and/or other characteristics or properties of one or more portions of the mattress (e.g., upper portion) and/or other portions of the bed can vary, as desired or required.

In several embodiments, one or more additional layers can be placed between the lower foam layers 3022, 3024, 3026 and a fluid distribution layer 3040 that is configured to receive ambient and/or environmental conditioned (e.g., cooled, heated, etc.) air from one or more fluid modules. For example, in FIG. 22, the upper portion 3020 comprises a relatively thin thermoplastic layer 3028 above the comfort layer 3026. In one embodiment, this relatively thin layer comprises polyethylene (e.g., cross-linked polyethylene) and has an approximate height of 0.063 inches. As depicted in the exploded view of FIG. 22, one or more carrier layers 3030 can be positioned between the relatively thin layer 3028 and the fluid distribution layer 3040. Such a carrier layer 3030, which, in the illustrated embodiment, has a height of approximately 0.625 inches, can be air impermeable or substantially air impermeable, and thus, can help prevent or reduce the likelihood of air or other fluid from undesirably escaping the upper portion 3020 through the bottom and/or sides of the adjacent fluid distribution member 3040.

With continued reference to FIG. 22, the fluid distribution member 3040 can include a frame (e.g., window pane) design in which the peripheral portions of the layer include a generally air impermeable barrier 3044, while one or more interior recessed portions comprise generally air permeable spacer materials 3046 (e.g., spacer fabric, open cell foam, a member having an open lattice structure, a spacer or other material placed within a bag or other enclosure, other materials configured to generally distribute fluid, etc.). As shown, the barrier 3044 can extend into interior portions of the fluid distribution layer 3040 to separate the fluid permeable portions of the layer into two or more climate control zones. According to one arrangement, the height or thickness of the fluid distribution member 3040 is approximately 0.375 inches. However, the height, thickness and/or other dimensions of the fluid distribution member can vary, as desired or required.

Accordingly, air can be delivered to the spacer materials 3046 from one or more fluid module situated below the upper portion 3020. For example, holes or other openings 3023, 3025, 3027, 3029, 3032 in each of the layers positioned below the fluid distribution layer 3040 can be advantageously aligned to create a fluid passage from the bottom of the upper portion 3020 into each of the air permeable regions (e.g., spacer fabric or other spacer materials) of the fluid distribution layer 3040. In some embodiments, one or more of the holes or other openings 3023, 3025, 3027, 3029, 3032 include a coating, layer and/or the like to help reduce the likelihood of air exiting the sides of the bed assembly 3000. In other embodiments, an insert (e.g., plastic sleeve) or other similar device can be positioned with the fluid passage created by the layers of the upper portion 3020. Such an insert can include bellows or similar feature to accommodate any vertical compression forces' to which the bed may be subjected.

The upper portion 3020 can include one or more additional layers above the fluid distribution layer 3040, such as, for example, a viscoelastic layer 3050. The viscoelastic layer 3050 illustrated in FIG. 22 in about 1 inch thick and comprises a plurality of openings 3054 generally above the air permeable regions 3046 of the fluid distribution layer 3040. In some embodiments, the diameter or other cross-sectional size of the openings in the viscoelastic layer is approximately 0.25 inches. Such a viscoelastic layer 3050 can help enhance the feel and comfort level of the upper portion 3020. Finally, a covering 3060 or similar member can be included as the top layer of the upper member 3020. For example, in some embodiments, such a top layer 3060 comprises a quilt cover. In addition, such a top layer 3060 can be part of an enclosure that is configured to releasably (e.g., using a zipper) maintain the various layers and/or members of the upper portion 3020 together.

In other embodiments, an upper portion of a climate controlled bed assembly includes more or fewer layers and/or members. In addition, the thickness, height, materials of construction, orientation and/or other characteristics of the layers and/or members can be reconfigured, as desired or required.

Additional details regarding climate controlled bed assemblies are provided in U.S. patent application Ser. No. 11/872,657, filed on Oct. 15, 2007 and published as U.S. Publication No. 2008/0148481; U.S. patent application Ser. No. 12/505,355, filed on Jul. 17, 2009 and published as U.S. Publication No. 2010/0011502; and U.S. patent application Ser. No. 12/208,254, filed on Sep. 10, 2008 and published as U.S. Publication No. 2009/0064411, all of which are hereby incorporated by reference herein.

Figure 23:
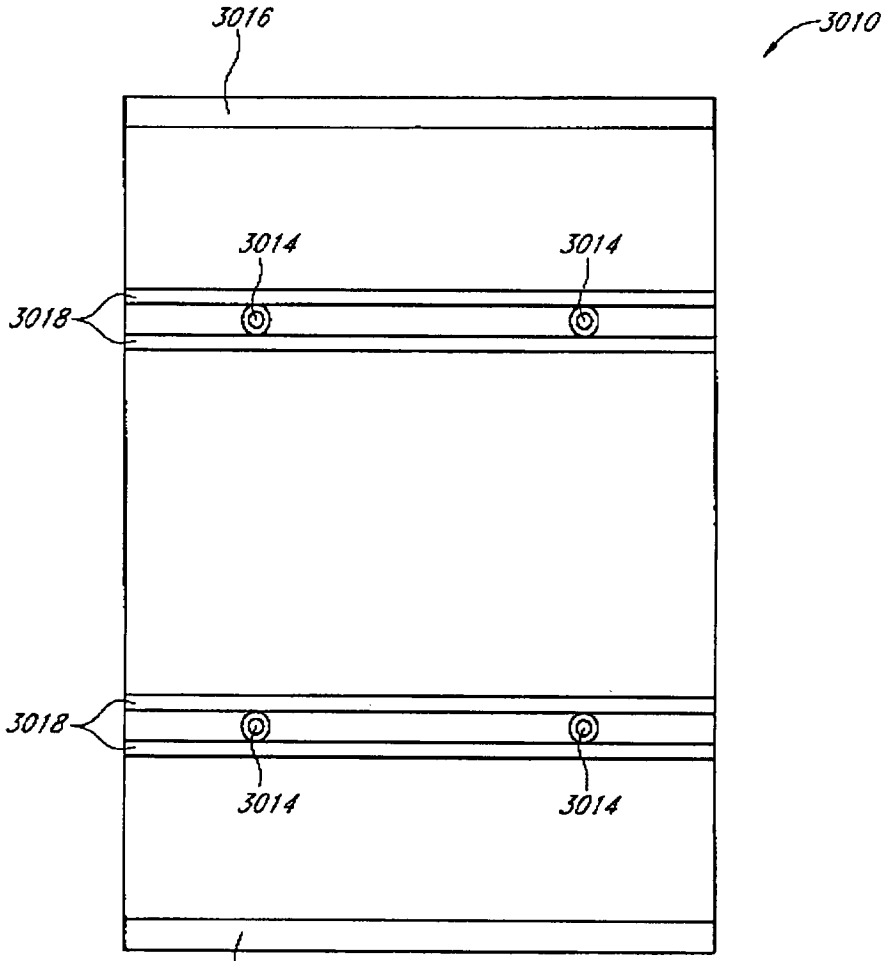
FIG. 23 illustrates one embodiment of a foundation configured for use with the climate controlled bed assembly of FIG. 22.

FIG. 23 illustrates one embodiment of a foundation 3010 (e.g., box spring, base member, etc.) configured to support an upper portion (e.g., mattress) of a climate controlled bed assembly. As shown, the foundation 3010 can include one or more openings 3014 through which air can be passed upwardly to the upper portion from the fluid modules. In some embodiments, these openings 3014 have a diameter of approximately 2 inches and are spaced to align with the corresponding fluid passages of the upper portion when the upper portion is properly positioned on the foundation 3010. Further, the foundation can include one or more framing members 3016, 3018 (slats, struts, frame members, etc.) that provide the necessary structural support to the foundation 3010. In addition, such framing members 3018 can provide attachment surfaces for fluid modules, control modules and/or any other components of the bed assembly.

Figure 24:
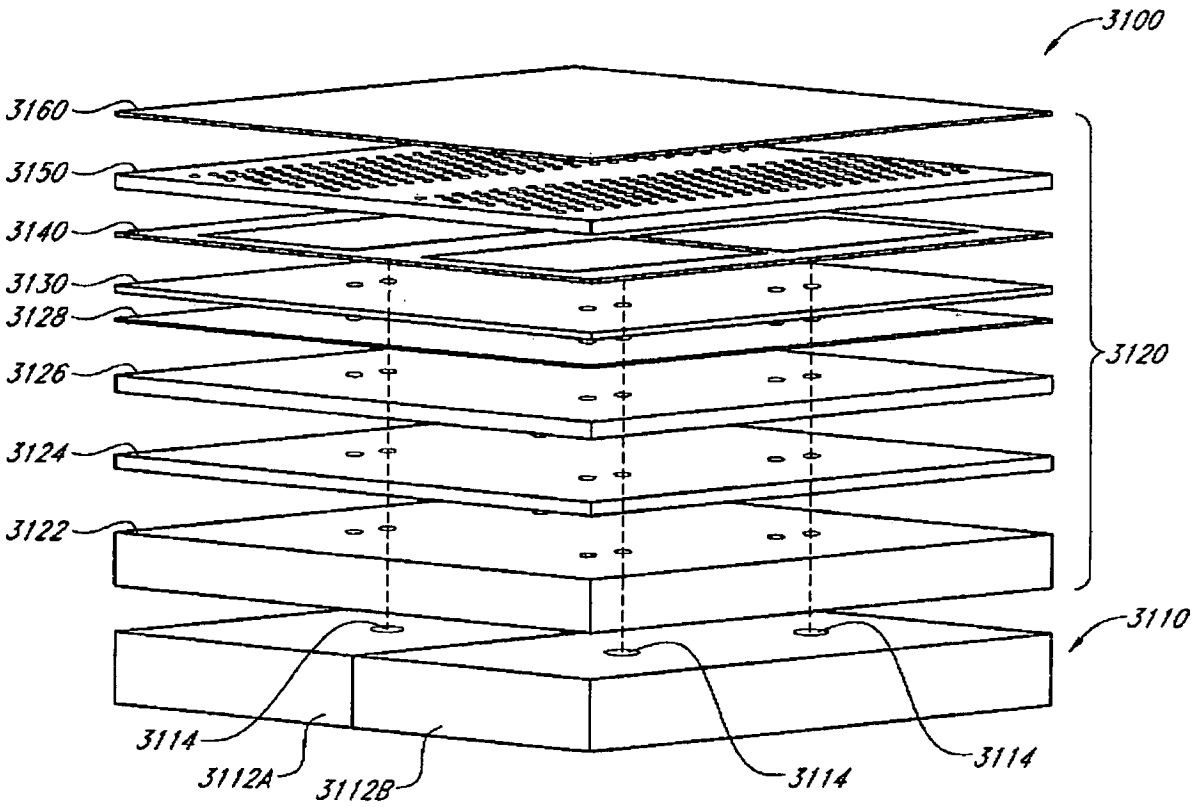
FIG. 24 illustrates an exploded perspective view of a climate controlled bed assembly according to another embodiment.

An exploded view of another embodiment of an upper portion configured for use in a climate controlled bed is illustrated in FIG. 24. The bed assembly 3100 is similar to the arrangement depicted in FIG. 22. For example, the bed 3100 includes a plurality of layers that provide the bed with a desired level of comfort, support and/or other characteristics, while still maintaining its ability to delivery ambient or environmentally conditioned fluids toward one or more occupants. However, as shown, the bed's foundation 3110 comprises a split design, in that it includes two different box springs 3112A, 3112B positioned immediately adjacent to each other. In some embodiments, such a foundation design is used for king size beds or other larger bed assemblies.

Top views of each layer and/or member of the upper portion 3120 are illustrated in FIGS. 25A-25H. In some embodiments, as shown in FIGS. 25A-25E, each lower layers (e.g., foam or other core layer, carrier layer, etc.) 3122, 3124, 3126, 3128, 3130 comprises two different sets of holes or other openings 3123, 3123', 3125, 3125', 3127, 3127', 3129, 3129', 3132, 3132' through which fluids are configured to pass. As discussed in greater detail below, such a configuration permits an upper portion 3100 to be rotated (e.g., as part of regular maintenance) relative to the foundation 3110, even when the fluid passages are not completely symmetrical about the surface of the upper portion. Thus, for example, the openings 3123 along the bottom of the upper portion are configured to align with the openings 3114 of the foundation when in a first orientation. However, when the upper portion 3120 is rotated or otherwise turned relative to the foundation 3110, the other set of openings 3123' along the bottom of the upper portion will be configured to align with the corresponding openings 3114 of the foundation. As a result, air or other fluids generated by fluid modules can be advantageously delivered through fluid passages of the upper portion 3120 regardless of the rotation of the upper portion relative to the foundation. This can further enhance the comfort level of a climate controlled bed assembly, extend its useful life and/or provide other benefits.

Figure 25A:
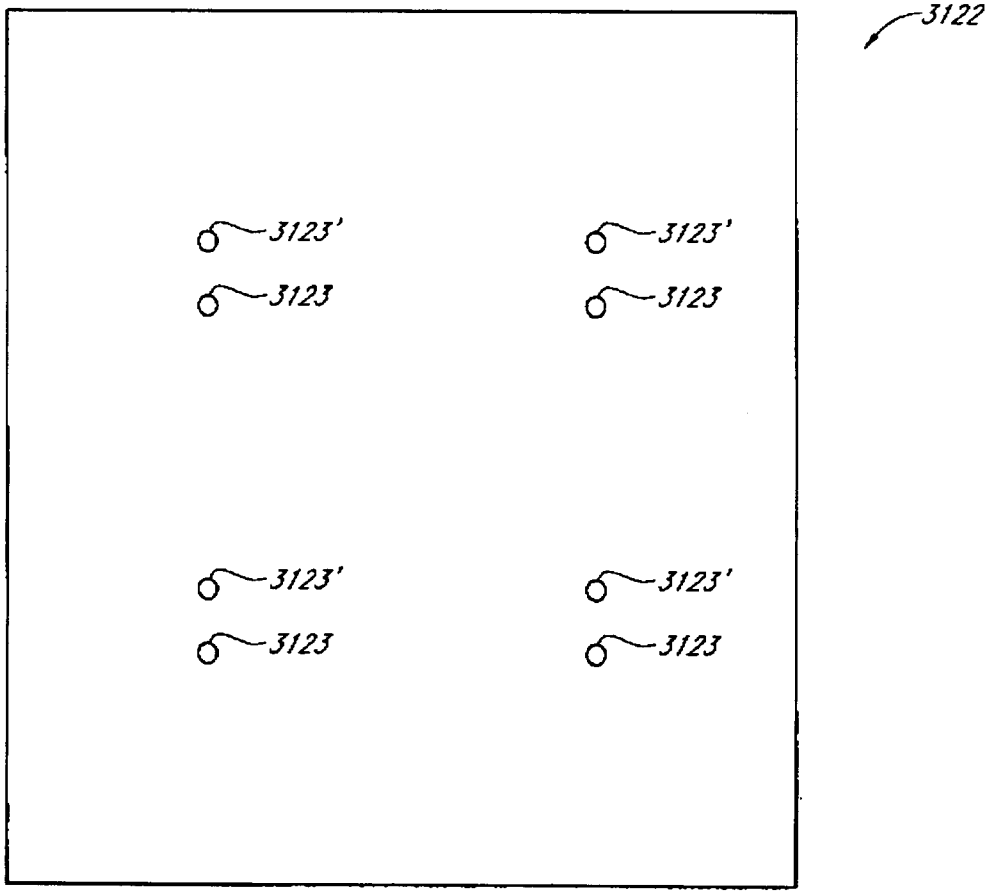
FIGS. 25A-25J illustrate the various layers or components that comprise the climate controlled bed assembly of FIG. 24.
Figure 25B:
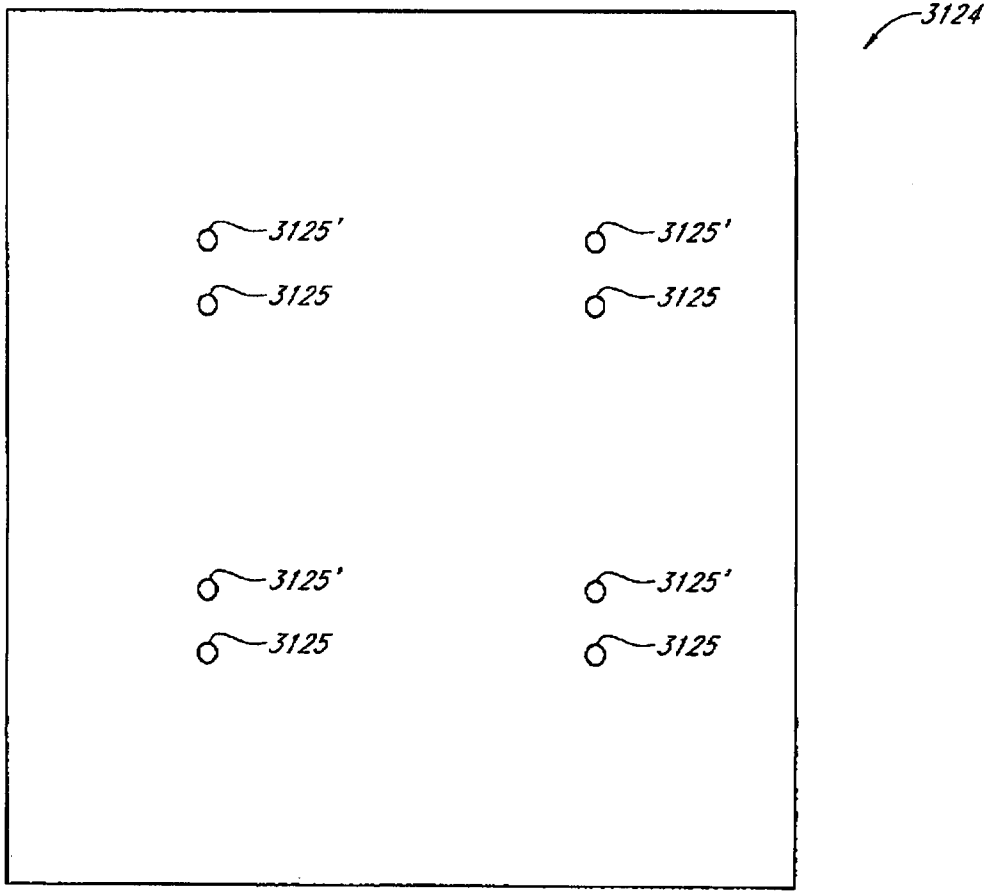
Figure 25C:
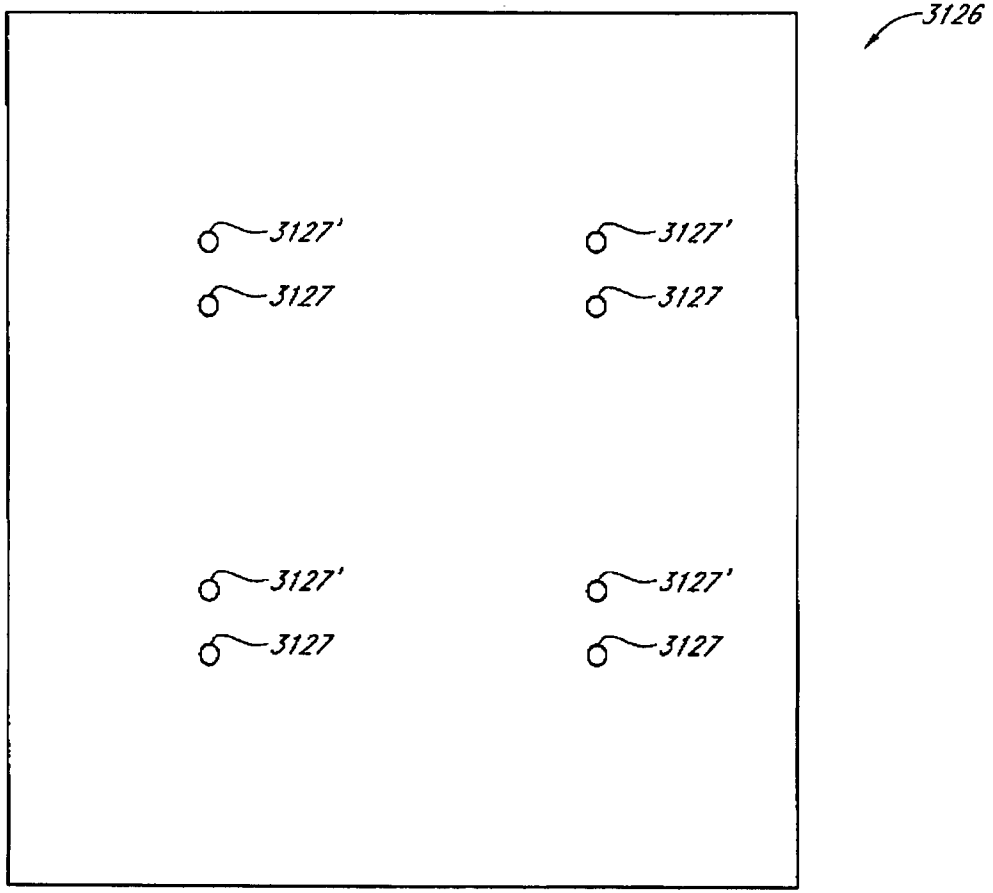
Figure 25D:
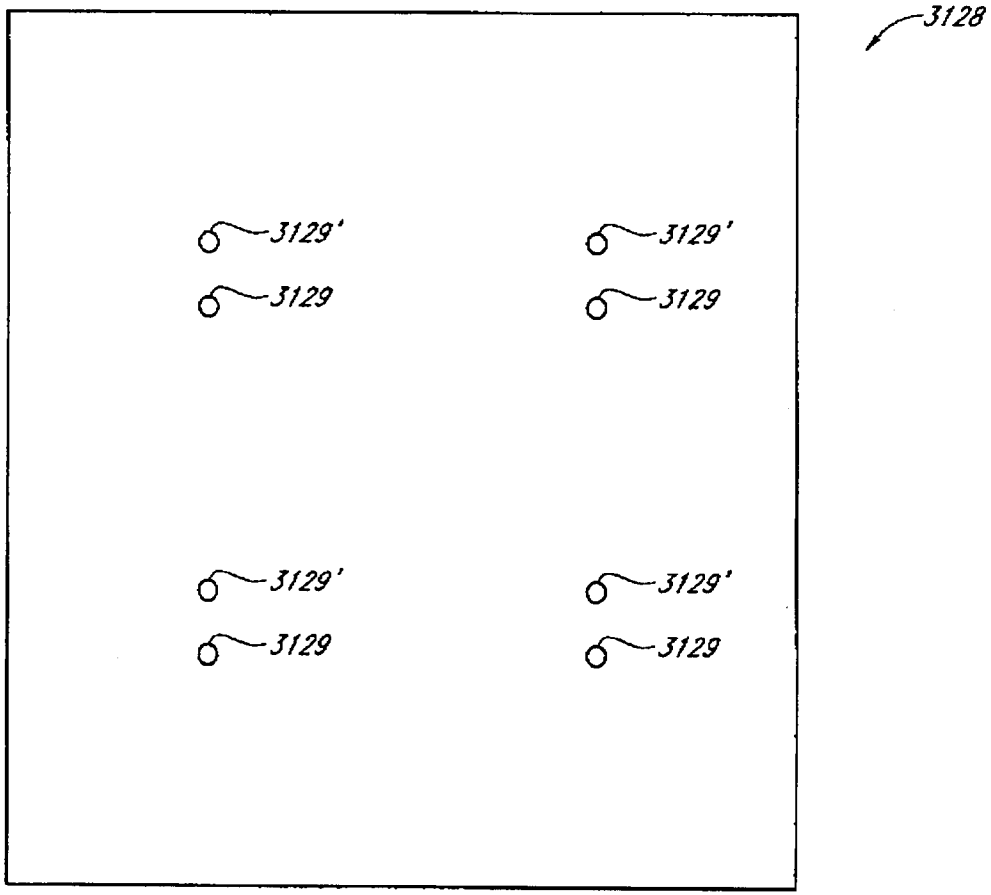
Figure 25E:
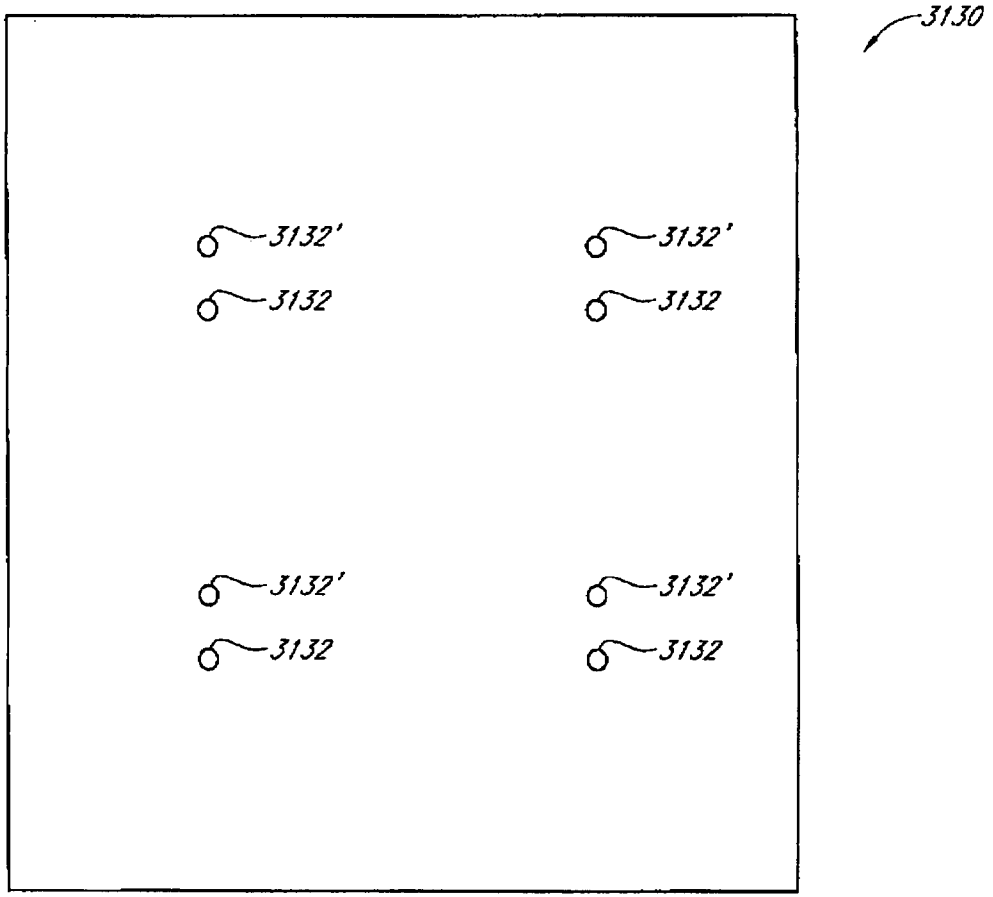
Figure 25F:
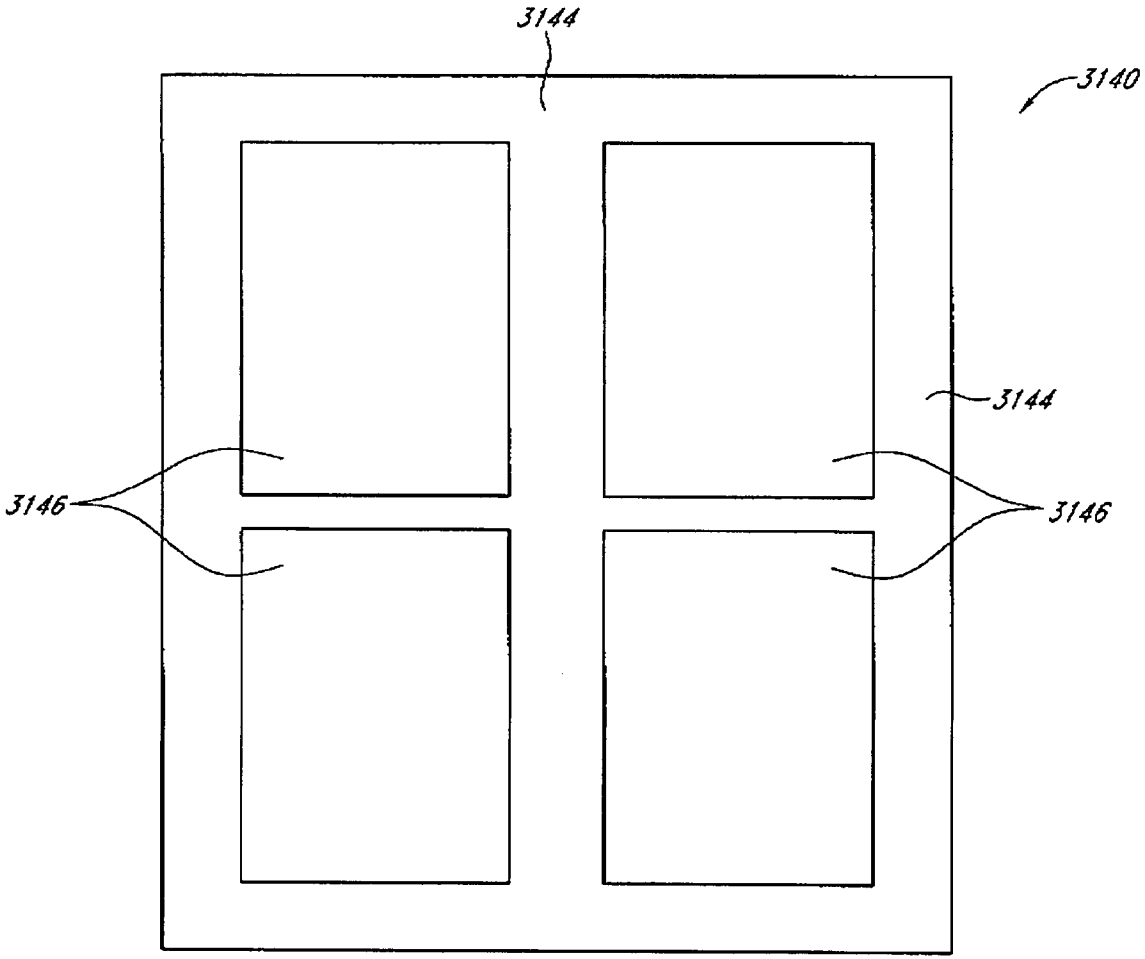
Figure 25G:
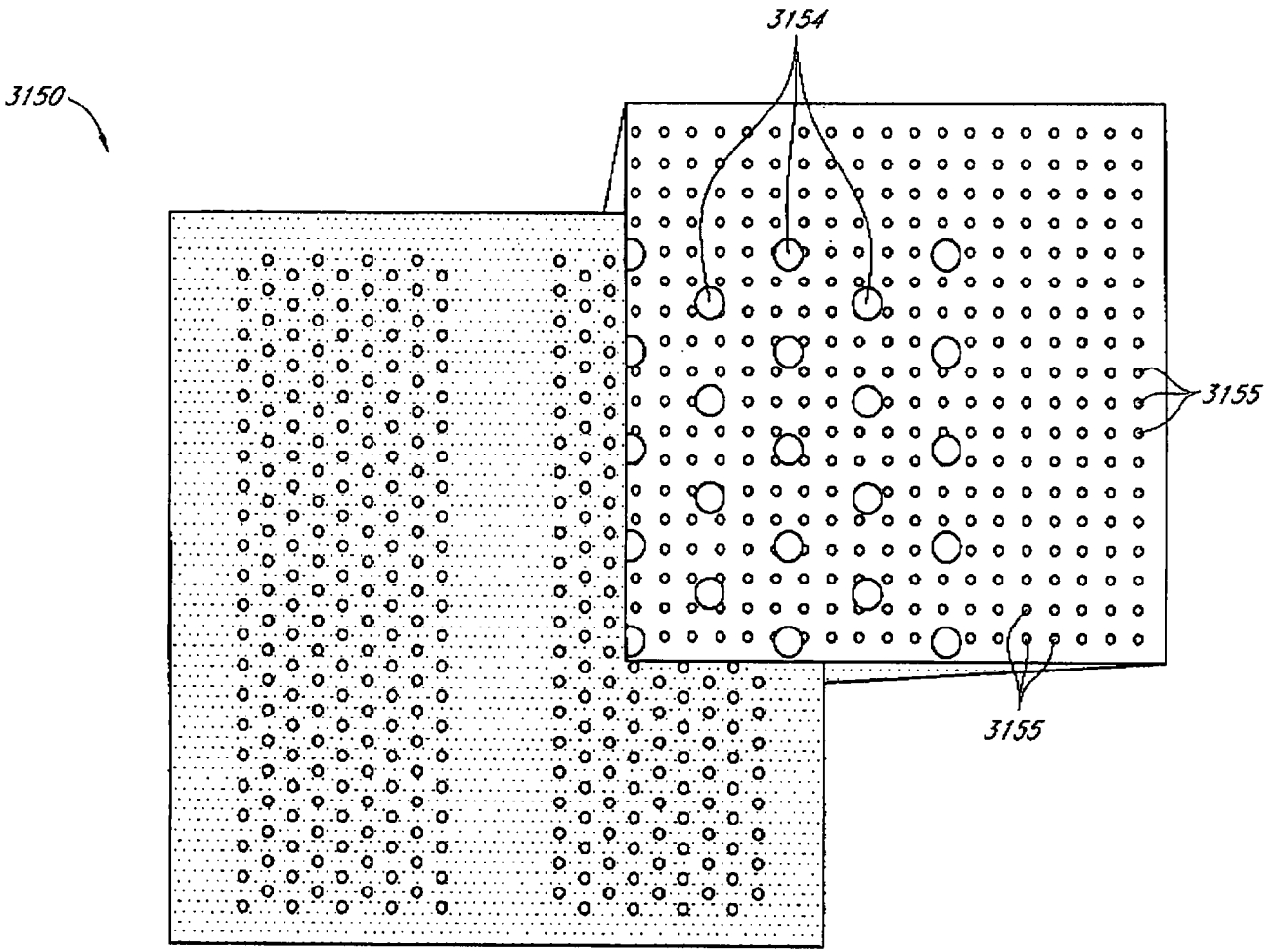
Figure 25H:
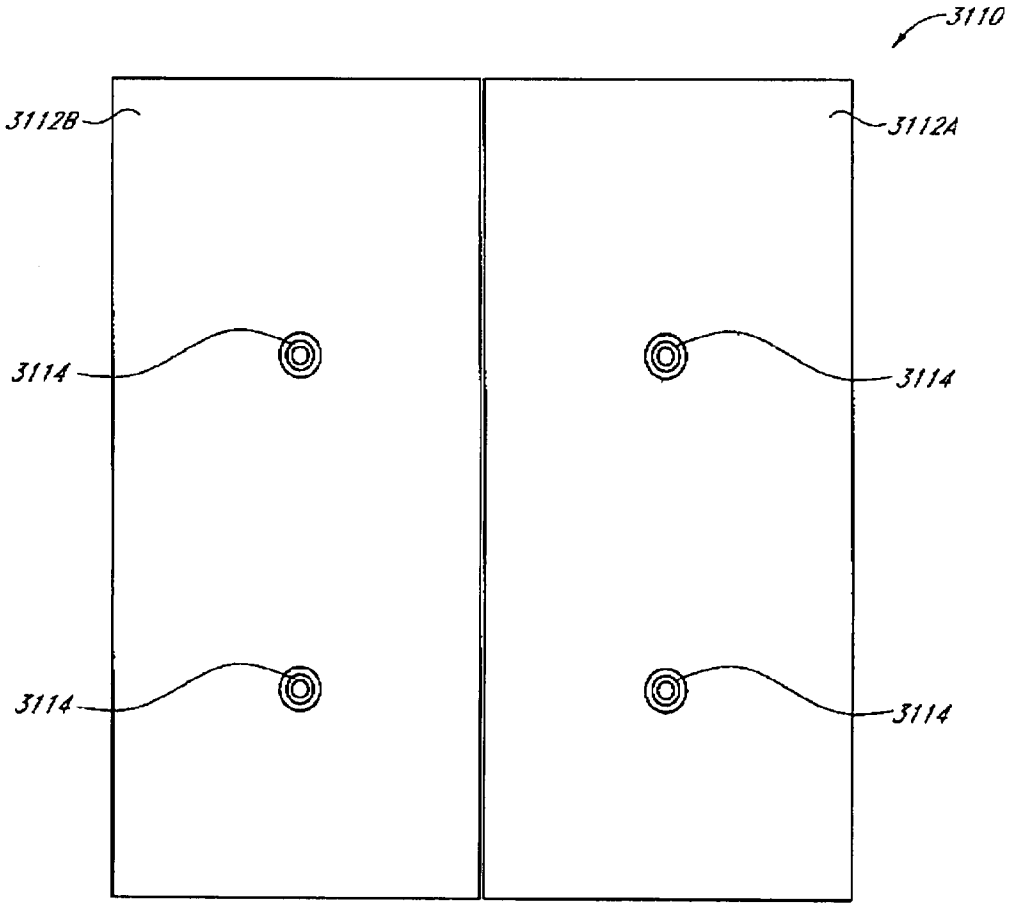

As illustrated in FIG. 25G, the viscoelastic layer 3150 can include a plurality of first perforations 3155 or openings. In addition, the viscoelastic layer 3150 can include a plurality of second, larger holes or openings 3154 through which air can pass. As shown in FIG. 25G, the larger openings 3154 can be included along portions of the layer 3150 that correspond to the air permeable areas of the adjacent fluid distribution layer or member. Thus, fluid passing through the fluid distribution member can be advantageously directed through the viscoelastic layer (and any other adjacent or intermediate layers) toward one or more occupants of the bed assembly. These larger, second openings 3154 can additionally help with the more even distribution of fluids being delivered toward the top of the bed assembly. As noted herein, the use of such viscoelastic layers or similar members can help enhance the comfort and feel of the bed, while still maintaining its climate control features and capabilities. In some embodiments, the thickness or height of the viscoelastic layer 3150 is approximately 1 inch. Any of the embodiments of a climate control bed disclosed herein, or equivalents thereof, can advantageously include one or more viscoelastic layers, as desired or required. The first, smaller openings 3155 in the viscoelastic layer 3150 can be adapted to assist in the breathability of the layer. For example, such openings 3155 can help air move through (e.g., in one or both directions) of the viscoelastic layer, as desired or required during the operation of the bed assembly. In other embodiments, the size, shape, orientation relative to other layers or portions of the bed and/or other characteristics of the viscoelastic layer or any other layer can vary, as desired or required.

Figure 25I:
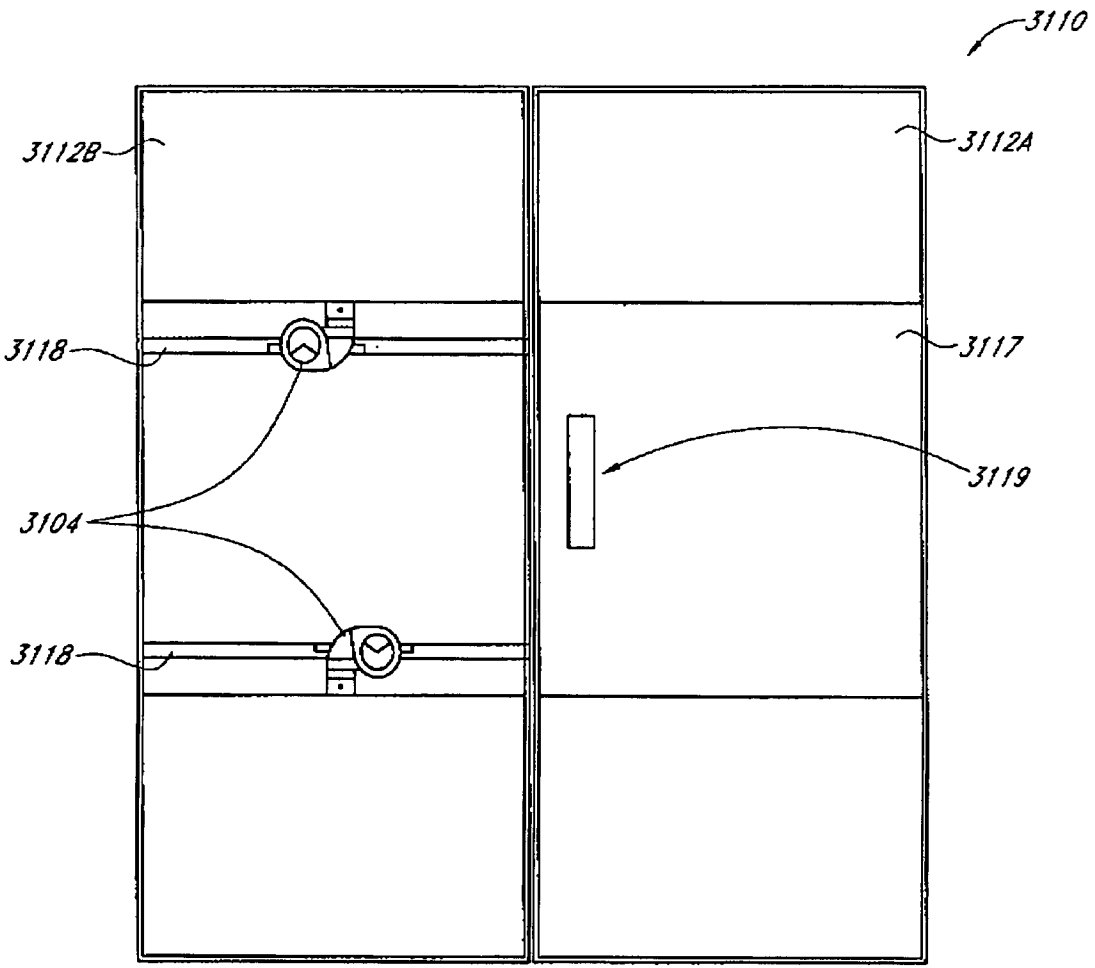

According to some embodiments, the foundation 3110 can include one or more layers, members and/or other devices that are configured to reduce the noise level of an adjacent fluid module 3104. For example, as illustrated in FIG. 25I, the open, lower end and/or any other portion of the foundation can comprise one or more foam layers 3117. Such foam 3117 can help absorb the noise generated by one or more fluid modules located within the foundation, thereby reducing the overall noise output of a climate controlled bed assembly. With continued reference to FIG. 25I, one or more inlet windows, slots or other openings 3119 can be included within the foam layers or members to permit air to enter the interior of the foundation 3110.

Figure 25J:
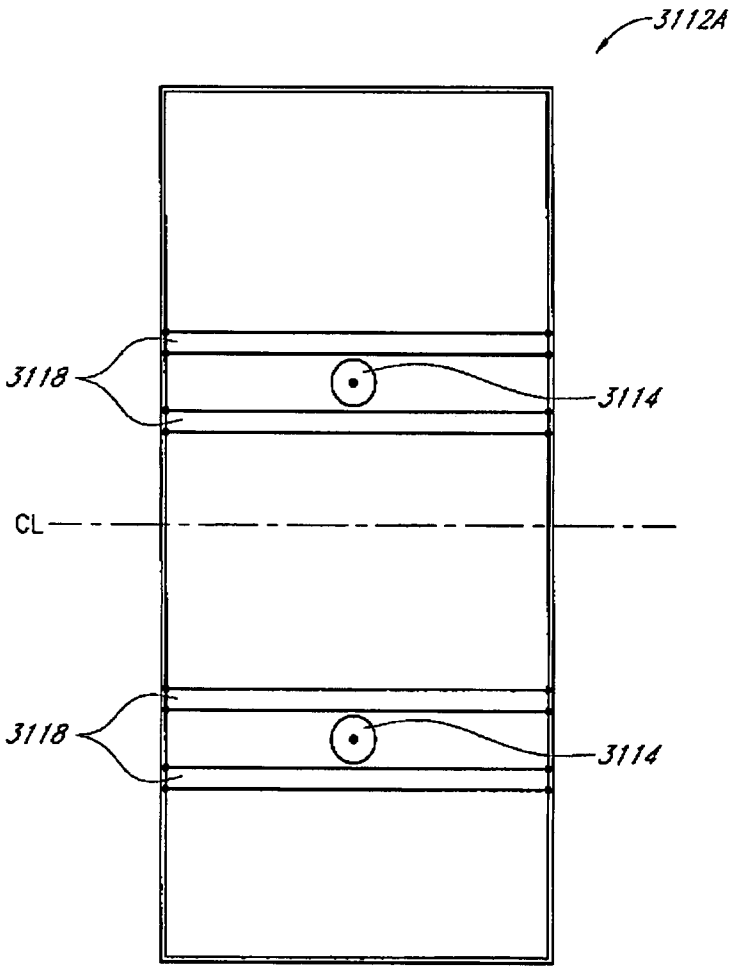

FIG. 25J illustrates a bottom view of one of two halves 3112A of a foundation for a climate controlled bed assembly. As noted above and depicted in FIG. 25J, the openings 3114 of the foundation member 3112A may not be symmetrically disposed around a centerline CL of the bed. Further, the foundation member 3112A can include one or more members (e.g., wooden or plastic cross members, struts, slats, etc.) that provide structural support for the foundation and one or more surfaces on which to secure components of the bed's climate control system (e.g., fluid modules, control units, etc.).

Figure 26:
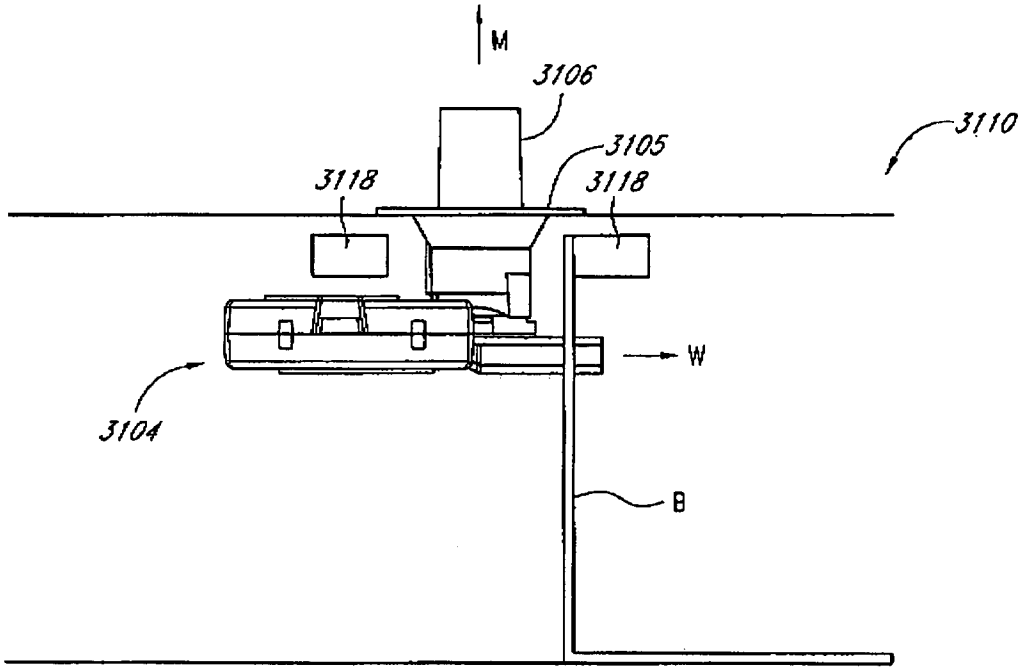
FIGS. 26 and 27 illustrate side views of a fluid module secured to a climate controlled bed assembly according to one embodiment.
Figure 27:
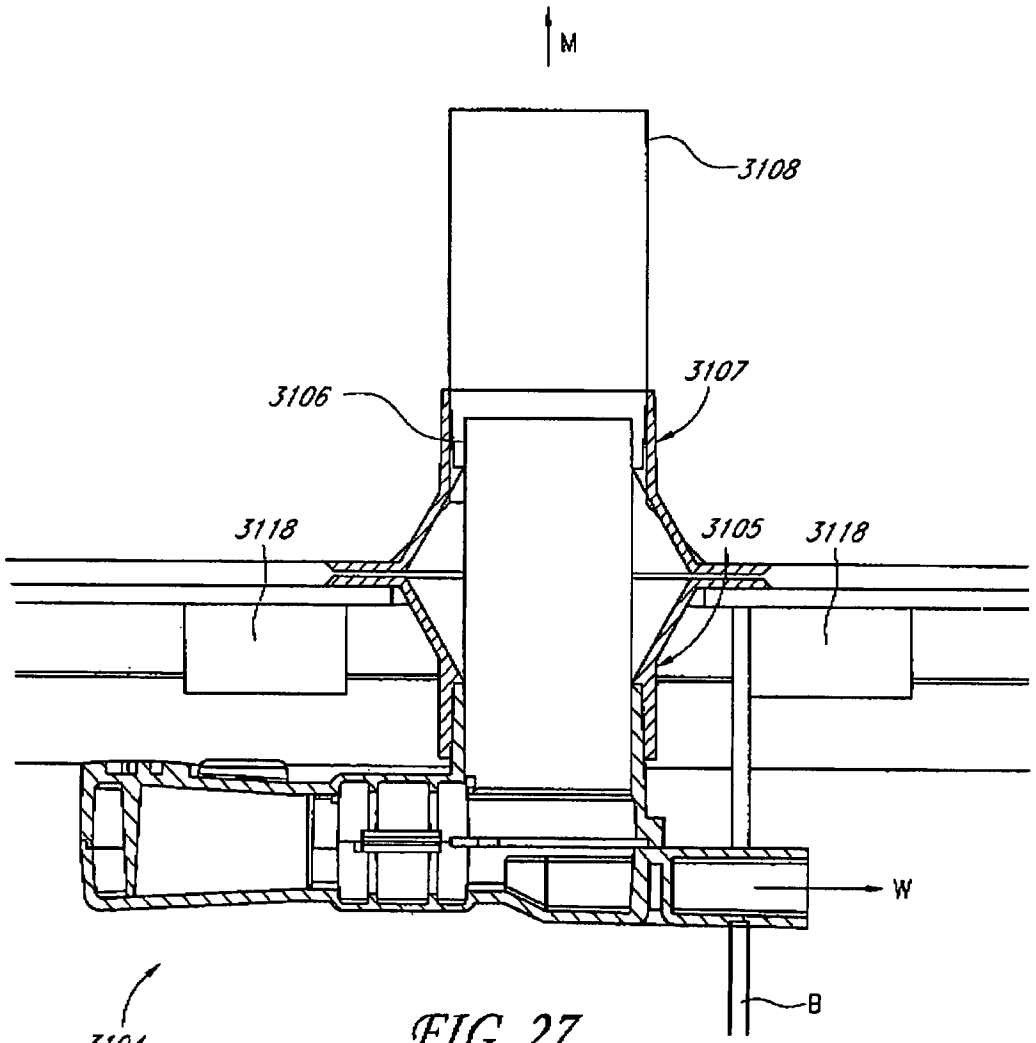

FIGS. 26 and 27 illustrate embodiments of a fluid module 3104 located within a bed assembly's foundation 3110. As shown, the fluid module 3104 can be positioned along the top of the foundation and can be secured to one or more surfaces (e.g., structural member 3118, strut, other members, etc.). Further, the fluid module 3104 can include a discharge fitting 3105 having a flange that extends along an upper surface of the foundation. With reference to FIG. 27, the upper portion can include a corresponding fitting 3107 that is configured to generally mate with the fitting 3105 of the foundation. According to some embodiments, the fluid module 3104 is configured to selectively deliver ambient or environmentally-conditioned air through its main discharge (e.g., in a direction generally represented by arrow M in FIGS. 26 and 27) through one or more passages of the upper portion (e.g., mattress) and toward one or more occupants. In some embodiments, an insert 3106 is positioned within the adjacent fittings 3105, 3107. Such an insert 3106 can help align and secure the fittings to each other 3105, 3107. Further, the insert 3106 can help align the foundation and upper portion and/or can help prevent air from inadvertently leaking at the interface between the foundation and the upper portion (e.g., along the sides of the bed, through the mattress or upper portion, etc.).

With continued reference to FIGS. 26 and 27, the interior space of the foundation 3110 can be divided into two or more cavities with the use of baffles B, separators and/or the like. As a result, the waste air stream (e.g., generally represented in these figures by arrow W) being discharged by one or more fluid modules 3104 can be delivered to an area within the foundation's interior space that is isolated or substantially isolated from the space having the fluid modules 3104. This can help ensure that the fluid modules are maintained in an environment having a more consistent temperature range. As a result, the performance of the fluid modules can be advantageously improved and/or the life of the fluid modules can be extended.

Eventually, the waste air stream can be discharged through one or more vents or other outlets of the foundation. However, in any of the embodiments disclosed herein, or equivalents thereof, the waste air stream of a fluid module can be used to provide a benefit to another device or system of the bed assembly. For example, when warm air is being directed toward the top of the bed, a fluid module comprising a thermoelectric device may produce a waste stream that is generally cooled. In several arrangements, such a cooled waste stream from one or more fluid modules is delivered to a control unit, power supply and/or any other component or device of the bed assembly. The resulting cooling and/or other thermal conditioning effect can be improve the operation of such devices, prolong their useful life, protect them against potentially harmful over-temperature conditions, generally prolong their useful life and/or the like. Heated and/or cooled waste air can be directed to any portion of the bed assembly for one or more other benefits (e.g., spot heating or cooling of certain portions of an occupant's anatomy, such as, for example, head, feet, etc.)

Figure 28:
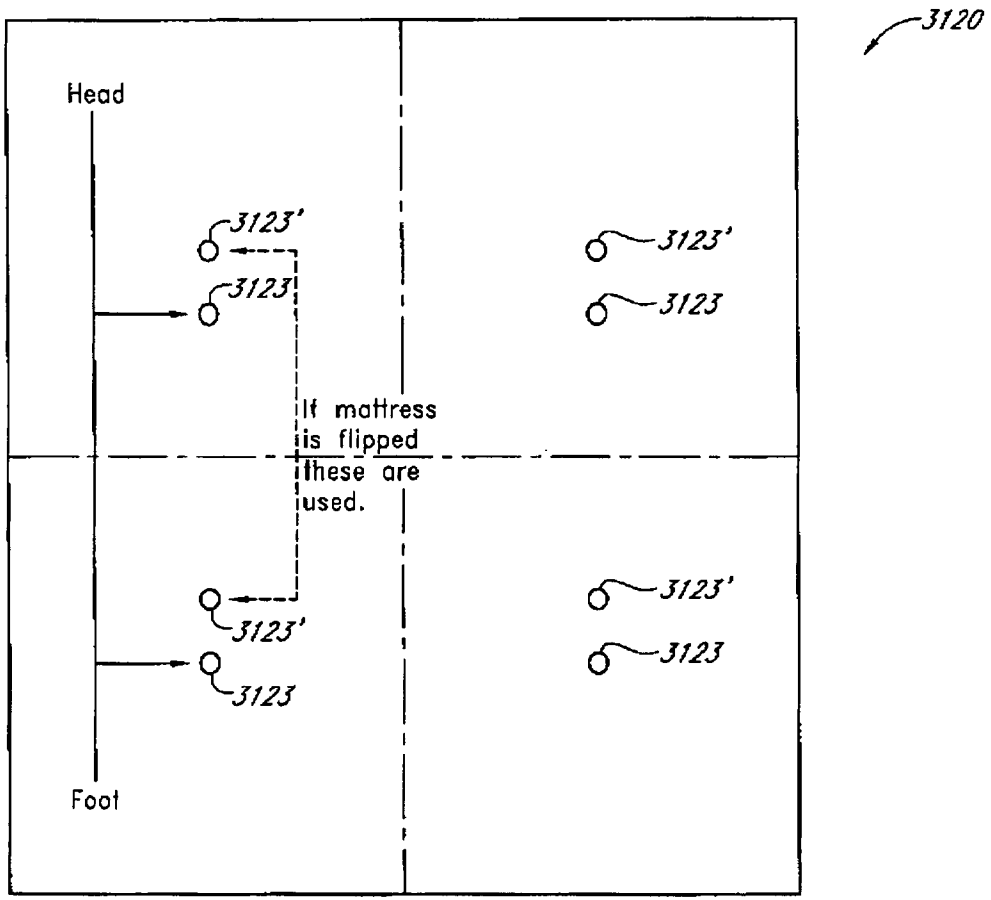
FIG. 28 illustrates a top view of a foundation for a climate controlled bed assembly according to one embodiment.

As discussed above, a mattress or other upper portion of a climate controlled bed assembly can be adapted to generally align with corresponding openings of a foundation or other base member even after the upper portion has been rotated or flipped relative to the foundation. A bottom surface of one embodiment of such an upper portion 3120 is illustrated in FIG. 28. As shown, the upper portion 3120 can include two or more sets of openings 3123, 3123' that are strategically spaced and otherwise configured so that at least one set of openings 3123 generally aligns with corresponding openings of the foundation when the upper portion is in a first position. Further, a second set of openings 3123' is configured to align with the foundation's openings when the upper portion is flipped or rotated (e.g., by 180 degrees) to a second position. Thus, even though the openings 3123, 3123' within a mattress or other upper portion 3120 may be generally non-symmetrical about one or more axes of the bed, the upper portion can be periodically rotated (e.g., for proper maintenance, improved comfort, etc.). In some embodiments, such an offset exists because the openings within the upper portion are located, spaced and otherwise configured to target specific portions of an occupant's body (e.g., shoulders, hips, etc.).

A climate controlled bed or other seating assembly can include one or more sensors (e.g., temperature sensors, moisture sensors, humidity sensors, etc.). As discussed in greater detail herein, such sensors can be used to operate the climate control system of the assembly within a desired range or zone. However, the use of such sensors on, within or near a bed or other seating assembly can provide additional benefits and advantages. For example, one or more temperature sensors can be positioned along an upper portion of a bed, medical bed, wheelchair or other seating assembly (e.g., at or near the location where an occupant is expected to be positioned). Such sensors can help detect the body temperature of an occupant. In some embodiments, such measurements can be transmitted to an alarm, display, other output, control unit, processor and/or other device or component, so as to alert the occupant and/or interested third parties of the occupant's body temperature.

Such arrangements can be particularly beneficial in hospitals or other medical facilities where it is important to closely monitor patients' vital signs (e.g., to notify the proper personnel of a patient's fever, hypothermia, etc.). Further, such a configuration can be used in a home or other setting to monitor the body temperature of infants, toddlers, young children, the elderly, the infirmed and/or the like. In other embodiments, a bed or other seating assembly is configured to use the body temperature measurements to make corresponding changes to the assembly's climate control system (e.g., increase or decrease the heating, cooling or ventilation effect), as desired or required by a particular control scheme.

In other arrangements, a seating assembly (e.g., bed, medical bed, wheelchair, etc.) includes one or more moisture sensors. Such sensors can be positioned along the top of the seating assembly, along an interior of the top portion (e.g., mattress) and/or at any other location. Regardless of their exact quantity, type, location and other details, such moisture sensors can be configured to detect the presence of water, sweat, urine, other bodily fluids and/or any other liquid or fluid. As discussed herein with reference to body temperature sensors, moisture sensors can also be operatively connected to one or more alarms, monitors, control units, other processors and/or the like. Accordingly, the occupant and/or interested third parties can be promptly informed about the presence of moisture at or near one or more sensors. Such embodiments can be particularly helpful in monitoring people (e.g., children, elderly, infirmed, etc.) who are prone to wetting their beds or other seating assemblies (e.g., wheelchair, chair, etc.). Further, such arrangements can be desired where it is desired to detect the presence of sweat or other fluids that may be discharged by an occupant.

The embodiments of the fluid modules and/or the climate controlled beds or other seating assemblies described and/or illustrated herein can comprise a thermoelectric device for temperature conditioning (e.g., selectively healing and/or cooling) the fluid flowing through the device. A thermoelectric device can include a Peltier thermoelectric module, which is well known in the art. Such devices typically include a main heat exchanger for transferring or removing thermal energy from the fluid flowing through the device and to the distribution systems. Typically, such devices also include a secondary (or waste) heat exchanger that extends from the thermoelectric device generally opposite the main heat exchanger. A single fluid transfer device can be used to direct fluid over, through or in the vicinity of the main and/or waste heat exchangers for temperature conditioning purposes. In alternative embodiments, two or more fluid transfer devices can be used to move air or other fluid relative to the heat exchangers. For example, one fluid transfer device can be configured to convey air past the main heat exchanger while a second fluid transfer device can be configured to convey air past the waste heat exchanger.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof In addition, while the number of variations of the inventions have been shown and described in detail, other modifications, which are within the scope of this inventions, will be readily apparent to those of skill in the art based upon this disclosure. It is also contemplated that various combinations or subcombinations of the specific features and aspects of the embodiments may be made and still fall within the scope of the inventions. Accordingly, it should be understood that various features and aspects of the disclosed embodiments can be combined with, or substituted for, one another in order to perform varying modes of the disclosed inventions. Thus, it is intended that the scope of the present inventions herein disclosed should not be limited by the particular disclosed embodiments described above, but should be determined only by a fair reading of the claims.

What is claimed is:

1. A climate-conditioned bed comprising:

an upper portion having a first climate zone;

at least one fluid module associated with the first climate zone;

wherein the at least one fluid module comprises a fluid transfer device for selectively moving a fluid and a thermal conditioning device configured to selectively heat or cool a fluid;

at least one passageway positioned at least partially through an interior of the upper portion and placing the at least one fluid module in fluid communication with at least one fluid distribution member located on or near a top of the upper portion;

wherein fluid entering the at least one fluid distribution member is delivered above the upper portion along an area defined by the first climate zone;

at least one control module configured to regulate the operation of the at least one fluid module;

wherein the at least one fluid module is operatively connected to the at least one control module;

at least one input device configured to allow an occupant to select a desired climate controlled setting or mode associated with the first climate zone;

wherein the at least one input device is in data communication with the at least one control module, said at least one input device being configured to receive instructions from an occupant regarding the desired climate controlled setting or mode;

at least a first temperature sensor configured to detect a first temperature associated with a level of thermal conditioning occurring to fluid delivered to the first climate zone of the climate-conditioned bed; and at least one humidity sensor configured to detect a relative humidity of fluid passing through the at least one fluid module;

wherein, for a particular desired climate controlled setting or mode, the at least one control module is configured to adjust at least one operational parameter of the at least one fluid module based, at least in part, on the first temperature detected by the at least one first temperature sensor, the relative humidity detected by the at least one humidity sensor and a target comfort zone;

wherein the target comfort zone is based on the temperature and relative humidity of fluid thermally conditioned by the at least one fluid module and delivered to the at least one fluid distribution member; and wherein the at least one control module is further configured to adjust at least one operational parameter of the at least one fluid module to reduce the likelihood of condensate formation.

2. The climate-conditioned bed of claim 1, further comprising at least a second climate zone and at least one second fluid module associated with said second climate zone;

wherein the bed further comprises at least a second temperature sensor configured to detect a second temperature associated with a level of thermal conditioning occurring to fluid delivered to the second climate zone; and wherein the at least one control module is configured to adjust at least one operational parameter of the second fluid module based, at least in part, on: (i) the climate controlled setting or mode selected by an occupant using the at least one input device, and (ii) the second temperature detected by the second temperature sensor.

3. The climate-conditioned bed of claim 2, wherein the first climate zone is located along a left side of the bed, and wherein the second climate zone is located along a right side of the bed.

4. The climate-conditioned bed of claim 2, wherein the first climate zone comprises at least two climate subzones, said climate subzones being configured to be operated differently from each other, wherein fluid is supplied to each climate subzone from separate fluid modules.

5. The climate-conditioned bed of claim 1, wherein the at least one passageway of the upper portion is in fluid communication with a duct of a climate control system of a building in which the bed is located.

6. The climate-conditioned bed of claim 1, wherein the at least one control module of the bed is operatively connected to a control system of a climate control system of a building in which the bed is located.

7. The climate-conditioned bed of claim 1, further comprising a separate fluid source in fluid communication with the at least one passageway, wherein fluids or other materials contained within said separate fluid source are configured to be selectively delivered to through the at least one passageway, toward a top surface of the upper portion.

8. The climate-conditioned bed of claim 7, wherein the fluids or other materials contained within the separate fluid source comprise at least one of a medicament, a therapeutic agent, an insect repellent and a fragrance.

9. The climate-controlled bed of claim 8, wherein the medicament comprises an asthma medication, an anti-bacterial medication, an anti-fungal medication or an anesthetic.

10. The climate-conditioned bed of claim 1, wherein the upper portion comprises at least one viscoelastic layer.

11. The climate-controlled bed of claim 10, wherein the viscoelastic layer comprises a plurality of first openings and a plurality of second openings, said first and second openings extending throughout an entire depth of said viscoelastic layer;

wherein the second openings are larger than the first openings;

wherein the second openings are configured to generally distribute fluid being delivered from the at least one fluid module to a top of the upper portion; and wherein the first openings are configured to assist in the breathability of the viscoelastic layer.

12. The climate-conditioned bed of claim 1, wherein the control module is configured to be operatively connected to at least one separate device or system.

13. The climate-conditioned bed of claim 12, wherein the at least one separate device or system comprises a thermostat or other controller for a building's climate control system, a multimedia device, a control unit, a computer, an internet connection or another network connection.

14. The climate-conditioned bed of claim 12, wherein the at least one separate device or system comprises a Smartphone or a multimedia device.

15. The climate-conditioned bed of claim 1, wherein the at least one fluid module, the at least a first temperature sensor and the at least one control module are included within a single housing.

16. The climate-conditioned bed of claim 1, further comprising a temperature alarm configured to be activated when the temperature associated with the first climate zone exceeds a threshold temperature.

17. The climate-conditioned bed of claim 1, wherein the at least one control module is configured to thermally pre-condition the bed by activating the at least one thermal module according to a setting selected by an occupant.

18. A climate-conditioned seating assembly comprising:

at least a first climate zone;

at least one fluid module associated with the first climate zone;

wherein the at least one fluid module is configured to selectively transfer and environmentally-condition a fluid;

a control module configured to regulate the operation of the at least one fluid module;

at least one temperature sensor for detecting the temperature of fluid entering the at least one fluid module;

at least one humidity sensor for detecting the relative humidity of fluid entering the at least one fluid module;

wherein the at least one fluid module is operatively connected to the control module;

at least one user input device configured to allow an occupant to select a desired environmental control setting or mode associated with the first climate zone;

wherein the at least one fluid module is configured to deliver fluids through at least one passageway of the seating assembly, into and through at least one fluid distribution member, and toward a top surface of said seating assembly, the at least one fluid distribution member comprising at least one layer positioned along a top of the seating assembly, wherein the at least one fluid distribution member is air permeable and configured to generally distribute fluid within the at least one fluid distribution member;

wherein, for a particular environmental control setting or mode, the at least one control module is configured to adjust at least one operational parameter of the at least one fluid module based, at least in part, on the first temperature detected by the at least one temperature sensor, the relative humidity detected by the at least one humidity sensor and a target comfort zone;

wherein the target comfort zone is based on the temperature and relative humidity of fluid environmentally conditioned by the at least one fluid module and delivered to the at least one fluid distribution member; and wherein the at least one control module is further configured to adjust at least one operational parameter of the at least one fluid module to reduce the likelihood of condensate formation.

19. The seating assembly of claim 18, wherein the assembly comprises a consumer bed, a medical bed, a wheelchair or a vehicle seat.

20. A climate-conditioned bed assembly comprising:

a first climate zone and at least a second climate zone;

at least one first fluid module associated with the first climate zone;

at least one second fluid module associated with the second climate zone;

each of the at least one first fluid module and the at least one second fluid module comprising a fluid transfer device and a thermal conditioning device, wherein said fluid transfer device is configured to transfer fluids through the bed assembly, and wherein the thermal conditioning device is configured to selectively thermally-condition such fluids;

wherein the at least one first fluid module is configured to deliver fluids to the first climate zone, the first climate zone comprising at least one first fluid distribution member, the at least one first fluid distribution member comprising at least one layer positioned along a top of the bed assembly, wherein the at least one first fluid distribution member is air permeable and configured to generally distribute fluid within the at least one first fluid distribution member;

wherein the at least one second fluid module is configured to deliver fluids to the second climate zone, the second climate zone comprising at least one second fluid distribution member, the at least one second fluid distribution member comprising at least one layer positioned along a top of the bed assembly, wherein the at least one second fluid distribution member is air permeable and configured to generally distribute fluid within the at least one second fluid distribution member;

at least one control module configured to regulate the operation of the at least one first fluid module and the at least one second fluid module;

wherein each of the fluid modules is operatively connected to the at least one control module; and at least one occupant input device configured to allow an occupant to select a climate control setting or mode for at least one of the first climate zone and the second climate zone;

wherein the at least one control module is configured to adjust at least one operational parameter of at least one of the fluid modules based, at least in part, on the climate control setting or mode selected by an occupant, a temperature of fluid entering the fluid modules detected by at least one temperature sensor and a relative humidity of fluid entering the fluid modules detected by at least one humidity sensor;

wherein the control module is configured to adjust at least one operational parameter of at least one of the fluid modules in order to maintain the desired climate control setting or mode in at least one of the first climate zone and the second climate zone along an upper portion of the bed assembly, and wherein the at least one control module is further configured to adjust at least one operational parameter of the at least one fluid module to reduce the likelihood of condensate formation; and wherein the first climate zone is configured to be controlled independently of the second climate zone.

21. The climate-conditioned bed assembly of claim 20, wherein an operational parameter of at least one fluid module comprises at least one of a level of heating or cooling of the thermal conditioning device and a flowrate of the fluid transfer device.

22. The climate-conditioned bed assembly of claim 20, wherein the desired climate control setting or mode is configured to vary over time as determined by a control algorithm.

23. The climate-conditioned bed assembly of claim 20, wherein the at least one control module is configured to regulate at least one of the fluid modules to adjust a temperature along the upper portion of at least one of the first climate zone and the second climate zone to help awaken an occupant positioned thereon.

24. The climate-conditioned bed assembly of claim 20, further comprising a timer operatively connected to the at least one control module, said timer being configured to regulate at least one of the fluid modules.

25. The climate-conditioned bed of claim 1, wherein the thermal conditioning device comprises a thermoelectric device.

26. The climate-conditioned bed of claim 1, wherein the thermal conditioning device comprises a convective heater.

27. The climate-conditioned bed assembly of claim 20, wherein the thermal conditioning comprises at least one of a thermoelectric device and a convective heater.

* * * * *